US009656488B2

(12) United States Patent
Yamaguchi et al.

(10) Patent No.: US 9,656,488 B2
(45) Date of Patent: May 23, 2017

(54) TAPE CASSETTE

(71) Applicant: Brother Kogyo Kabushiki Kaisha, Nagoya-shi, Aichi-ken (JP)

(72) Inventors: Koshiro Yamaguchi, Kakamigahara (JP); Takashi Horiuchi, Kariya (JP); Akira Sago, Seto (JP); Yasuhiro Iriyama, Mie-gun (JP); Yasuhiro Shibata, Okazaki (JP); Tsuyoshi Nagae, Kasugai (JP); Masato Kato, Kasugai (JP); Teruo Imamaki, Nissin (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/920,398

(22) Filed: Oct. 22, 2015

(65) Prior Publication Data

US 2016/0039230 A1 Feb. 11, 2016

Related U.S. Application Data

(63) Continuation of application No. 14/141,673, filed on Dec. 27, 2013, now Pat. No. 9,498,987, which is a (Continued)

(30) Foreign Application Priority Data

Mar. 31, 2009 (JP) ..... 2009-088440
Mar. 31, 2009 (JP) ..... 2009-088441

(Continued)

(51) Int. Cl.
*B41J 11/44* (2006.01)
*B41J 15/00* (2006.01)

(Continued)

(52) U.S. Cl.
CPC ..... *B41J 15/044* (2013.01); *B41J 3/4075* (2013.01); *B41J 11/009* (2013.01); *B41J 32/00* (2013.01)

(58) Field of Classification Search
CPC . B41J 15/042; B41J 15/04; B41J 35/00; B41J 15/044
See application file for complete search history.

(56) References Cited

U.S. PATENT DOCUMENTS 3,901,372 A 8/1975 Denley
4,127,883 A * 11/1978 Mestdagh ..... G11B 15/1883 360/251.1

(Continued)

FOREIGN PATENT DOCUMENTS

CH 121073 6/1927
CH 136498 11/1929

(Continued)

OTHER PUBLICATIONS

Apr. 9, 2015—(US) Non-Final Office Action—U.S. Appl. No. 14/641,681.

(Continued)

*Primary Examiner* — David Banh
(74) *Attorney, Agent, or Firm* — Banner & Witcoff, Ltd.

(57) ABSTRACT

A tape cassette includes a housing. The housing includes a top wall having a top surface and a bottom wall having a bottom surface. The bottom surface has a first surface portion being a flat surface portion and a second surface portion being a flat surface portion. The second surface portion extends generally parallel to the first surface portion and is located between the top surface and the first surface portion in a first direction. The first direction is orthogonal to the top surface or the first surface portion. A first indicator portion is provided on the second surface portion. The first indicator portion has a first protrusion protruding from the (Continued)

second surface portion. The first protrusion has a protruding end being located between the second surface portion and the first surface portion in the first direction.

16 Claims, 20 Drawing Sheets

Related U.S. Application Data continuation of application No. 12/732,828, filed on Mar. 26, 2010, now Pat. No. 8,764,326.

(30) Foreign Application Priority Data

| | | |
|---|---|---|
| Mar. 31, 2009 | (JP) | 2009-088456 |
| Mar. 31, 2009 | (JP) | 2009-088460 |
| Mar. 31, 2009 | (JP) | 2009-088468 |
| Jun. 30, 2009 | (JP) | 2009-156355 |
| Jun. 30, 2009 | (JP) | 2009-156357 |
| Jun. 30, 2009 | (JP) | 2009-156369 |
| Jun. 30, 2009 | (JP) | 2009-156371 |

(51) Int. Cl.

| | |
|---|---|
| ***B41J 15/04*** | (2006.01) |
| ***B41J 11/00*** | (2006.01) |
| ***B41J 32/00*** | (2006.01) |
| ***B41J 3/407*** | (2006.01) |

(56) References Cited

U.S. PATENT DOCUMENTS

| | | | | |
|---|---|---|---|---|
| 4,226,547 | A | 10/1980 | Bradshaw et al. | |
| 4,360,278 | A | 11/1982 | Paque | |
| D267,330 | S | 12/1982 | Worrell | |
| 4,391,539 | A | 7/1983 | Connoy | |
| 4,402,619 | A | 9/1983 | Paque et al. | |
| 4,557,617 | A | 12/1985 | Richardson et al. | |
| 4,567,488 | A | 1/1986 | Moriguchi et al. | |
| 4,678,353 | A | 7/1987 | Richardson et al. | |
| 4,725,155 | A | 2/1988 | Kittel et al. | |
| 4,773,775 | A | 9/1988 | Bradshaw et al. | |
| 4,815,871 | A | 3/1989 | McGourty et al. | |
| 4,815,874 | A | 3/1989 | Richardson et al. | |
| 4,815,875 | A | 3/1989 | Richardson et al. | |
| 4,832,514 | A | 5/1989 | Basile | |
| 4,844,636 | A | 7/1989 | Paque | |
| 4,880,325 | A * | 11/1989 | Ueda | B41J 3/46 400/144.2 |
| 4,892,425 | A | 1/1990 | Shimizu et al. | |
| D307,296 | S | 4/1990 | Ivarson et al. | |
| 4,915,516 | A | 4/1990 | Shimizu et al. | |
| 4,917,514 | A | 4/1990 | Richardson et al. | |
| D307,918 | S | 5/1990 | Goda | |
| 4,927,278 | A | 5/1990 | Kuzuya et al. | |
| 4,930,913 | A | 6/1990 | Basile | |
| D311,416 | S | 10/1990 | Richardson et al. | |
| 4,966,476 | A | 10/1990 | Kuzuya et al. | |
| 4,983,058 | A | 1/1991 | Nagae | |
| 5,022,771 | A | 6/1991 | Paque | |
| D319,070 | S | 8/1991 | Lavander | |
| D320,391 | S | 10/1991 | Paque | |
| 5,056,940 | A | 10/1991 | Basile | |
| 5,078,523 | A | 1/1992 | McGourty et al. | |
| 5,098,208 | A | 3/1992 | Martinez | |
| 5,104,247 | A | 4/1992 | Ohshima | |
| 5,111,216 | A | 5/1992 | Richardson et al. | |
| 5,188,469 | A | 2/1993 | Nagao et al. | |
| 5,193,919 | A | 3/1993 | Godo et al. | |
| 5,195,835 | A | 3/1993 | Collins | |
| 5,203,951 | A | 4/1993 | Hattori et al. | |
| 5,223,939 | A | 6/1993 | Imaizumi et al. | |
| 5,227,477 | A | 7/1993 | Auerbach et al. | |
| 5,239,437 | A | 8/1993 | Hoge et al. | |
| D342,275 | S | 12/1993 | Cooper | |
| RE34,521 | E | 1/1994 | Shimizu et al. | |
| 5,277,503 | A | 1/1994 | Nagao | |
| 5,318,370 | A | 6/1994 | Nehowig | |
| 5,348,406 | A | 9/1994 | Yoshiaki et al. | |
| 5,350,243 | A | 9/1994 | Ichinomiya et al. | |
| D352,305 | S | 11/1994 | Cooper | |
| 5,374,132 | A | 12/1994 | Kimura | |
| D356,333 | S | 3/1995 | Pearce et al. | |
| 5,395,173 | A | 3/1995 | Ueno et al. | |
| 5,399,033 | A | 3/1995 | Putman | |
| D357,497 | S | 4/1995 | Gray et al. | |
| 5,411,339 | A | 5/1995 | Bahrabadi et al. | |
| 5,419,648 | A | 5/1995 | Nagao et al. | |
| D359,303 | S | 6/1995 | Gray et al. | |
| 5,424,757 | A | 6/1995 | Thom | |
| 5,429,443 | A | 7/1995 | Kobayashi et al. | |
| 5,431,504 | A | 7/1995 | Beadman et al. | |
| 5,435,657 | A | 7/1995 | Pearce et al. | |
| 5,466,076 | A | 11/1995 | Kobayashi et al. | |
| 5,492,282 | A | 2/1996 | Okuchi et al. | |
| 5,492,420 | A | 2/1996 | Nunokawa et al. | |
| 5,494,362 | A | 2/1996 | Kobayashi et al. | |
| 5,506,736 | A | 4/1996 | Ota | |
| 5,511,891 | A | 4/1996 | Nehowig et al. | |
| 5,518,328 | A | 5/1996 | Okuchi et al. | |
| D372,044 | S | 7/1996 | Ware et al. | |
| 5,533,818 | A | 7/1996 | Bahrabadi | |
| 5,536,092 | A | 7/1996 | Yamaguchi | |
| 5,538,352 | A | 7/1996 | Sugiura | |
| 5,540,510 | A | 7/1996 | Sims et al. | |
| 5,541,796 | A | 7/1996 | Sawada | |
| 5,553,952 | A | 9/1996 | Umbach | |
| 5,564,843 | A | 10/1996 | Kawaguchi | |
| 5,593,237 | A | 1/1997 | Nozaki et al. | |
| 5,595,447 | A | 1/1997 | Takayama et al. | |
| 5,599,119 | A | 2/1997 | Nunokawa et al. | |
| 5,605,404 | A | 2/1997 | Nunokawa et al. | |
| 5,620,268 | A | 4/1997 | Yamaguchi et al. | |
| 5,634,728 | A | 6/1997 | Nunokawa et al. | |
| 5,653,542 | A * | 8/1997 | Sugimoto | B26D 5/00 400/207 |
| 5,658,083 | A | 8/1997 | Day et al. | |
| 5,659,441 | A | 8/1997 | Eckberg et al. | |
| 5,709,486 | A | 1/1998 | Day | |
| 5,727,888 | A | 3/1998 | Sugimoto et al. | |
| 5,730,536 | A | 3/1998 | Yamaguchi | |
| 5,739,839 | A | 4/1998 | Iwai et al. | |
| 5,752,777 | A | 5/1998 | Nunokawa et al. | |
| 5,765,954 | A | 6/1998 | Nunokawa et al. | |
| 5,771,803 | A | 6/1998 | Takami | |
| 5,795,086 | A | 8/1998 | Watanabe et al. | |
| 5,813,773 | A | 9/1998 | Kawai | |
| 5,813,779 | A | 9/1998 | Palmer et al. | |
| 5,823,689 | A | 10/1998 | Nehowig et al. | |
| 5,825,724 | A | 10/1998 | Matsumoto et al. | |
| 5,826,995 | A | 10/1998 | Day et al. | |
| 5,857,788 | A | 1/1999 | Gutsell et al. | |
| 5,860,752 | A | 1/1999 | Watanabe et al. | |
| 5,887,993 | A | 3/1999 | Nunokawa et al. | |
| 5,961,225 | A | 10/1999 | Nunokawa et al. | |
| 5,964,539 | A | 10/1999 | Yamaguchi et al. | |
| 5,967,678 | A | 10/1999 | Nunokawa et al. | |
| 5,997,194 | A | 12/1999 | Nunokawa et al. | |
| 6,012,860 | A | 1/2000 | Nunokawa et al. | |
| 6,042,280 | A | 3/2000 | Yamaguchi et al. | |
| 6,048,118 | A | 4/2000 | Martinez et al. | |
| 6,050,672 | A | 4/2000 | Matsuhashi | |
| 6,050,734 | A | 4/2000 | Watanabe et al. | |
| 6,059,469 | A | 5/2000 | Hirumi | |
| 6,106,171 | A | 8/2000 | Nunokawa et al. | |
| 6,116,796 | A | 9/2000 | Yamaguchi et al. | |
| 6,132,120 | A | 10/2000 | Yamaguchi et al. | |
| 6,146,034 | A | 11/2000 | Watanabe et al. | |
| 6,149,325 | A | 11/2000 | Nunokawa et al. | |
| 6,160,679 | A | 12/2000 | Maekawa et al. | |
| 6,167,696 | B1 | 1/2001 | Maaseidvaag et al. | |
| 6,168,328 | B1 | 1/2001 | Ueda et al. | |

(56) References Cited

U.S. PATENT DOCUMENTS 6,190,065 B1 2/2001 Brzuskiewicz
6,190,069 B1 2/2001 Yamaguchi et al.
6,196,740 B1 3/2001 Yamaguchi et al.
6,227,477 B1 * 5/2001 Komatsuzaki ..... G11B 15/07 242/338
6,232,993 B1 5/2001 Kobayashi et al.
6,270,269 B1 8/2001 Watanabe et al.
6,317,156 B1 11/2001 Nagasaki et al.
6,334,724 B2 1/2002 Yamaguchi et al.
6,406,202 B1 6/2002 Unno et al.
6,419,648 B1 7/2002 Vitek et al.
6,429,443 B1 8/2002 Mankos et al.
6,435,744 B1 8/2002 Dunn et al.
6,476,838 B1 11/2002 Italiano
6,485,206 B1 11/2002 Takahashi
6,520,696 B2 2/2003 Huss et al.
6,644,876 B2 11/2003 Carriere et al.
D486,853 S 2/2004 Wilken et al.
6,709,179 B2 3/2004 Yamaguchi et al.
6,910,819 B2 6/2005 Carriere et al.
6,929,415 B2 8/2005 Wilken
6,955,318 B2 10/2005 Nonomura
D519,522 S 4/2006 Lee
7,070,347 B2 7/2006 Carriere et al.
7,070,348 B2 7/2006 Sugimoto et al.
7,097,372 B1 8/2006 Heyse et al.
7,121,751 B2 10/2006 Harada et al.
7,128,483 B2 10/2006 Harada et al.
D534,203 S 12/2006 Harada et al.
7,201,522 B2 4/2007 Bandholz et al.
D542,334 S 5/2007 Harada et al.
7,232,268 B2 6/2007 Sugimoto et al.
7,287,715 B2 10/2007 Ban
7,296,941 B2 11/2007 Suzuki et al.
7,357,585 B2 4/2008 Kurashina
7,404,684 B2 7/2008 Sugimoto et al.
D579,942 S 11/2008 Terry et al.
7,503,714 B2 3/2009 Yamamoto et al.
7,841,790 B2 11/2010 Yamaguchi et al.
7,942,594 B2 5/2011 Kumazaki et al.
7,965,308 B2 6/2011 Jauert et al.
8,045,288 B2 10/2011 Ota et al.
8,109,684 B2 2/2012 Yamaguchi
8,162,553 B2 4/2012 Vandermeulen
8,164,609 B2 4/2012 Liu et al.
8,382,389 B2 2/2013 Yamaguchi et al.
D681,727 S 5/2013 Van Den Broecke
8,529,142 B2 9/2013 Tanaka
8,540,444 B2 9/2013 Vandermeulen et al.
8,562,228 B2 10/2013 Yamaguchi et al.
8,641,304 B2 2/2014 Yamaguchi et al.
8,734,035 B2 5/2014 Suva et al.
8,740,482 B2 6/2014 Yamaguchi et al.
8,757,907 B2 6/2014 Yamaguchi et al.
8,764,326 B2 7/2014 Yamaguchi et al.
8,770,877 B2 7/2014 Yamaguchi et al.
2002/0006303 A1 1/2002 Yamaguchi et al.
2002/0012558 A1 1/2002 Huss et al.
2002/0047063 A1 4/2002 Kaneda et al.
2002/0135938 A1 9/2002 Hiraguchi et al.
2003/0081978 A1 5/2003 Carriere et al.
2004/0056143 A1 * 3/2004 Nonomura ..... B41J 3/4075 242/596.8
2004/0062586 A1 4/2004 Harada et al.
2004/0233269 A1 11/2004 Tsubota
2004/0265027 A1 12/2004 Hine et al.
2005/0036816 A1 2/2005 Carriere et al.
2005/0152732 A1 7/2005 Bandholz et al.
2005/0172981 A1 8/2005 Byun
2006/0088802 A1 4/2006 Akaiwa
2006/0182921 A1 8/2006 Hioki et al.
2006/0193669 A1 8/2006 Takada et al.
2006/0204304 A1 9/2006 Hioki et al.
2006/0216099 A1 9/2006 Sakano et al.
2006/0216100 A1 9/2006 Minoya et al.
2006/0233582 A1 10/2006 Horiuchi
2006/0238600 A1 10/2006 Vandermeulen et al.
2006/0239743 A1 10/2006 Naito
2007/0009302 A1 1/2007 Vandermeulen
2007/0009306 A1 1/2007 Harada et al.
2007/0031171 A1 2/2007 Heyse et al.
2007/0041772 A1 2/2007 Harada et al.
2007/0070168 A1 3/2007 Mindler et al.
2007/0098473 A1 5/2007 Heyse et al.
2007/0172293 A1 7/2007 Vandermeulen
2007/0212149 A1 9/2007 Ota et al.
2007/0231041 A1 10/2007 Ueda et al.
2007/0237562 A1 10/2007 Kato et al.
2007/0264070 A1 11/2007 Loo et al.
2007/0283249 A1 12/2007 Nose et al.
2008/0050160 A1 2/2008 Yamaguchi et al.
2008/0056793 A1 3/2008 Yokoyama
2008/0080922 A1 4/2008 Vandermeulen
2008/0181703 A1 7/2008 Ito et al.
2008/0181708 A1 7/2008 Yamaguchi et al.
2008/0226373 A1 9/2008 Yamaguchi et al.
2008/0232886 A1 9/2008 Kato et al.
2008/0310904 A1 12/2008 Yamaguchi et al.
2009/0016795 A1 1/2009 Caveney et al.
2009/0190988 A1 7/2009 Vereecken et al.
2009/0202283 A1 8/2009 Kumazaki et al.
2009/0285617 A1 11/2009 Vandermeulen
2010/0119281 A1 5/2010 Ford et al.
2010/0166475 A1 7/2010 Yamaguchi et al.
2010/0166478 A1 7/2010 Yamaguchi et al.
2010/0166479 A1 7/2010 Yamaguchi et al.
2010/0232862 A1 9/2010 Vandermeulen
2010/0247208 A1 9/2010 Yamaguchi et al.
2010/0247209 A1 9/2010 Yamaguchi et al.
2010/0247210 A1 9/2010 Yamaguchi et al.
2010/0272492 A1 10/2010 Van Britsom et al.
2011/0058884 A1 3/2011 Kato et al.
2012/0008999 A1 1/2012 Yamaguchi et al.
2012/0027485 A1 2/2012 Suva et al.
2012/0027486 A1 2/2012 Suva et al.
2012/0027487 A1 2/2012 Suva et al.
2012/0057917 A1 3/2012 Van Britsom et al.
2012/0080550 A1 4/2012 Yamaguchi et al.
2012/0170959 A1 7/2012 Vandermeulen et al.
2012/0188325 A1 7/2012 Yamaguchi et al.
2012/0189366 A1 7/2012 Yamaguchi et al.
2012/0201588 A1 8/2012 Yamaguchi et al.
2014/0205350 A1 7/2014 Yamaguchi et al.
2014/0218458 A1 8/2014 Suva et al.

FOREIGN PATENT DOCUMENTS

CN 1119146 A 3/1996
CN 1146954 A 4/1997
CN 1148547 A 4/1997
CN 1148548 A 4/1997
CN 1166155 A 11/1997
CN 1289293 A 3/2001
CN 1085151 C 5/2002
CN 1376115 A 10/2002
CN 1397431 A 2/2003
CN 1415482 A 5/2003
CN 1415484 A 5/2003
CN 1415485 A 5/2003
CN 1469811 A 1/2004
CN 1493462 A 5/2004
CN 1636755 A 7/2005
CN 1642746 A 7/2005
CN 1663807 A 9/2005
CN 1744994 A 3/2006
CN 1762720 A 4/2006
CN 1799850 A 7/2006
CN 1799851 A 7/2006
CN 1820940 A 8/2006
CN 1827386 A 9/2006
CN 1835867 A 9/2006
CN 1865012 A 11/2006
CN 1914045 A 2/2007
CN 1990261 A 7/2007

(56) References Cited

FOREIGN PATENT DOCUMENTS

| | | | |
|---|---|---|---|
| CN | 1331684 | C | 8/2007 |
| CN | 101028771 | A | 9/2007 |
| CN | 101039807 | A | 9/2007 |
| CN | 101060985 | A | 10/2007 |
| CN | 101128324 | A | 2/2008 |
| CN | 101229724 | A | 7/2008 |
| CN | 101264701 | A | 9/2008 |
| CN | 101264702 | A | 9/2008 |
| CN | 101310989 | A | 11/2008 |
| CN | 101327696 | A | 12/2008 |
| CN | 101356061 | A | 1/2009 |
| CN | 101516628 | A | 8/2009 |
| CN | 101758676 | A | 6/2010 |
| CN | 102616025 | A | 8/2012 |
| CN | 202895934 | U | 4/2013 |
| EP | 214466 | A2 | 3/1987 |
| EP | 0329369 | A2 | 8/1989 |
| EP | 0511602 | A1 | 11/1992 |
| EP | 0555954 | A2 | 8/1993 |
| EP | 0629509 | A2 | 12/1994 |
| EP | 0635375 | A2 | 1/1995 |
| EP | 0644506 | A2 | 3/1995 |
| EP | 0684143 | A2 | 11/1995 |
| EP | 734878 | A2 | 10/1996 |
| EP | 0760291 | A2 | 3/1997 |
| EP | 0863021 | B1 | 9/1998 |
| EP | 0644506 | B1 | 4/1999 |
| EP | 1199179 | A1 | 4/2002 |
| EP | 1284196 | A2 | 2/2003 |
| EP | 1502758 | A1 | 2/2005 |
| EP | 1516739 | A1 | 3/2005 |
| EP | 1552949 | A1 | 7/2005 |
| EP | 1700705 | A1 | 9/2006 |
| EP | 1707395 | A1 | 10/2006 |
| EP | 2236303 | A1 | 10/2010 |
| EP | 2236304 | A1 | 10/2010 |
| EP | 2448762 | B1 | 9/2013 |
| JP | S56-20944 | U | 2/1981 |
| JP | S58-139415 | U | 9/1983 |
| JP | S58-220783 | A | 12/1983 |
| JP | S59-78879 | A | 5/1984 |
| JP | S60-99692 | U | 7/1985 |
| JP | S61-179776 | A | 8/1986 |
| JP | 562-173944 | U | 11/1987 |
| JP | S63-81063 | U | 5/1988 |
| JP | S63-166557 | A | 7/1988 |
| JP | S63-203348 | A | 8/1988 |
| JP | S63-254085 | A | 10/1988 |
| JP | H01-195088 | A | 8/1989 |
| JP | H01-146945 | U | 10/1989 |
| JP | H02-56664 | U | 4/1990 |
| JP | H02-56665 | U | 4/1990 |
| JP | H02-56666 | U | 4/1990 |
| JP | H02-147272 | A | 6/1990 |
| JP | H03-14865 | A | 1/1991 |
| JP | H03-63155 | | 3/1991 |
| JP | H03-93584 | A | 4/1991 |
| JP | H03-151261 | A | 6/1991 |
| JP | H03-118672 | U | 12/1991 |
| JP | H03-120680 | U | 12/1991 |
| JP | H11-263055 | U | 12/1991 |
| JP | H04-16113 | U | 2/1992 |
| JP | H04-37575 | A | 2/1992 |
| JP | H04-133756 | A | 5/1992 |
| JP | H04-168086 | A | 6/1992 |
| JP | H05-16342 | U | 3/1993 |
| JP | H05-18853 | U | 3/1993 |
| JP | H05-63067 | A | 3/1993 |
| JP | H05-104840 | A | 4/1993 |
| JP | H05-155067 | A | 6/1993 |
| JP | H05-54225 | U | 7/1993 |
| JP | H05-78565 | U | 10/1993 |
| JP | H05-80765 | U | 11/1993 |
| JP | H05-294051 | A | 11/1993 |
| JP | H05-301435 | A | 11/1993 |
| JP | H06-12053 | U | 2/1994 |
| JP | H06-52560 | A | 2/1994 |
| JP | H06-21953 | U | 3/1994 |
| JP | H06-122239 | A | 5/1994 |
| JP | H06-122249 | A | 5/1994 |
| JP | H06-124406 | A | 5/1994 |
| JP | H06-127094 | A | 5/1994 |
| JP | H06-152907 | A | 5/1994 |
| JP | H06-53560 | U | 7/1994 |
| JP | H06-183117 | A | 7/1994 |
| JP | H06-191081 | A | 7/1994 |
| JP | H06-210889 | A | 8/1994 |
| JP | H06-255145 | A | 9/1994 |
| JP | H06-74348 | U | 10/1994 |
| JP | H06-328800 | A | 11/1994 |
| JP | H07-1782 | | 1/1995 |
| JP | H07-1805 | A | 1/1995 |
| JP | H07-9743 | A | 1/1995 |
| JP | H07-25122 | A | 1/1995 |
| JP | H07-25123 | A | 1/1995 |
| JP | H07-47737 | A | 2/1995 |
| JP | H07-20725 | | 3/1995 |
| JP | H07-61009 | A | 3/1995 |
| JP | H07-68814 | A | 3/1995 |
| JP | H07-68877 | A | 3/1995 |
| JP | H07-69497 | A | 3/1995 |
| JP | H07-89115 | A | 4/1995 |
| JP | H07-89196 | A | 4/1995 |
| JP | H07-101133 | A | 4/1995 |
| JP | H07-108702 | A | 4/1995 |
| JP | H07-108730 | A | 4/1995 |
| JP | H07-137327 | A | 5/1995 |
| JP | H07-40456 | U | 7/1995 |
| JP | H07-214876 | A | 8/1995 |
| JP | H07-237314 | A | 9/1995 |
| JP | H07-251539 | A | 10/1995 |
| JP | H07-276695 | A | 10/1995 |
| JP | H07-290803 | A | 11/1995 |
| JP | H07-314862 | A | 12/1995 |
| JP | H07-314864 | A | 12/1995 |
| JP | H07-314865 | A | 12/1995 |
| JP | H07-314866 | A | 12/1995 |
| JP | H08-25768 | A | 1/1996 |
| JP | H08-39909 | A | 2/1996 |
| JP | H08-058211 | A | 3/1996 |
| JP | H08-118738 | A | 5/1996 |
| JP | H08-165035 | A | 6/1996 |
| JP | H08-216461 | A | 8/1996 |
| JP | H08-252964 | A | 10/1996 |
| JP | H08-267839 | A | 10/1996 |
| JP | H08-290618 | A | 11/1996 |
| JP | H09-39347 | | 2/1997 |
| JP | 2596263 | B2 | 4/1997 |
| JP | H09-109533 | A | 4/1997 |
| JP | H09-118044 | A | 5/1997 |
| JP | H09-123579 | A | 5/1997 |
| JP | H09-134557 | A | 5/1997 |
| JP | H09-141986 | A | 6/1997 |
| JP | H09-141997 | A | 6/1997 |
| JP | H09-188049 | A | 7/1997 |
| JP | H09-188050 | A | 7/1997 |
| JP | H09-240158 | A | 9/1997 |
| JP | H10-56604 | A | 2/1998 |
| JP | H10-181063 | A | 7/1998 |
| JP | H10-301701 | A | 11/1998 |
| JP | H11-78188 | A | 3/1999 |
| JP | H11-78189 | A | 3/1999 |
| JP | H11-91144 | A | 4/1999 |
| JP | H11-105351 | A | 4/1999 |
| JP | H11-129563 | A | 5/1999 |
| JP | H11-263056 | A | 9/1999 |
| JP | 2000-006481 | A | 1/2000 |
| JP | 2000-006501 | A | 1/2000 |
| JP | 2000-025316 | A | 1/2000 |
| JP | 2998617 | B2 | 1/2000 |
| JP | 2000025251 | A | 1/2000 |
| JP | 2000-043337 | A | 2/2000 |
| JP | 2000043336 | A | 2/2000 |
| JP | 2000-076372 | A | 3/2000 |

(56) References Cited

FOREIGN PATENT DOCUMENTS

| | | | |
|---|---|---|---|
| JP | 2000085224 | A | 3/2000 |
| JP | 3031439 | B2 | 4/2000 |
| JP | 2000103129 | A | 4/2000 |
| JP | 2000103131 | A | 4/2000 |
| JP | 2000135843 | A | 5/2000 |
| JP | 2000198258 | A | 7/2000 |
| JP | 2000-211193 | A | 8/2000 |
| JP | 2000-229750 | A | 8/2000 |
| JP | 2001011594 | A | 1/2001 |
| JP | 2001048389 | A | 2/2001 |
| JP | 2001088359 | A | 4/2001 |
| JP | 2001121797 | A | 5/2001 |
| JP | 3207860 | B2 | 9/2001 |
| JP | 2001310540 | A | 11/2001 |
| JP | 2001319447 | A | 11/2001 |
| JP | 2002-053248 | A | 2/2002 |
| JP | 2002042441 | A | 2/2002 |
| JP | 3266736 | B2 | 3/2002 |
| JP | 3266739 | B2 | 3/2002 |
| JP | 2002-103762 | A | 4/2002 |
| JP | 2002104568 | A | 4/2002 |
| JP | 2002-166606 | A | 6/2002 |
| JP | 2002-167084 | A | 6/2002 |
| JP | 2002166605 | A | 6/2002 |
| JP | 2002179300 | A | 6/2002 |
| JP | 2002192769 | A | 7/2002 |
| JP | 2002308481 | A | 10/2002 |
| JP | 2002308518 | A | 10/2002 |
| JP | 3357128 | B2 | 12/2002 |
| JP | 2002367333 | A | 12/2002 |
| JP | 2003-011454 | A | 1/2003 |
| JP | 2003-026164 | A | 1/2003 |
| JP | 2003-506235 | A | 2/2003 |
| JP | 3378622 | B2 | 2/2003 |
| JP | 2003048337 | A | 2/2003 |
| JP | 2003-072127 | A | 3/2003 |
| JP | 2003145902 | A | 5/2003 |
| JP | 3426983 | B2 | 7/2003 |
| JP | 2003-251904 | A | 9/2003 |
| JP | 2003251902 | A | 9/2003 |
| JP | 2003285522 | A | 10/2003 |
| JP | 2004-018077 | A | 1/2004 |
| JP | 2004-155150 | A | 6/2004 |
| JP | 3543659 | B2 | 7/2004 |
| JP | 2004-255656 | A | 9/2004 |
| JP | 3564848 | B2 | 9/2004 |
| JP | 3567469 | B2 | 9/2004 |
| JP | 2004291591 | A | 10/2004 |
| JP | 2004323241 | A | 11/2004 |
| JP | 3106187 | U | 12/2004 |
| JP | 2005-059504 | A | 3/2005 |
| JP | 2005088597 | A | 4/2005 |
| JP | 2005-178206 | A | 7/2005 |
| JP | 2005231203 | A | 9/2005 |
| JP | 2005-298031 | A | 10/2005 |
| JP | 2005280008 | A | 10/2005 |
| JP | 2005297348 | A | 10/2005 |
| JP | 2006021432 | A | 1/2006 |
| JP | 2006096030 | A | 4/2006 |
| JP | 2006142835 | A | 6/2006 |
| JP | 2006168974 | A | 6/2006 |
| JP | 2006182034 | A | 7/2006 |
| JP | 2006-240310 | A | 9/2006 |
| JP | 2006248059 | A | 9/2006 |
| JP | 2006-264337 | A | 10/2006 |
| JP | 2006272895 | A | 10/2006 |
| JP | 2006272977 | A | 10/2006 |
| JP | 2006289991 | A | 10/2006 |
| JP | 2007111863 | A | 5/2007 |
| JP | 2007196654 | A | 8/2007 |
| JP | 2007-268815 | A | 10/2007 |
| JP | 4003068 | B2 | 11/2007 |
| JP | 2007296863 | A | 11/2007 |
| JP | 2008044180 | A | 2/2008 |
| JP | 4061507 | B2 | 3/2008 |
| JP | 2008080668 | A | 4/2008 |
| JP | 2008083432 | A | 4/2008 |
| JP | 2008094103 | A | 4/2008 |
| JP | 2008509823 | A | 4/2008 |
| JP | 2008-213462 | A | 9/2008 |
| JP | 2008-229855 | A | 10/2008 |
| JP | 2008254384 | A | 10/2008 |
| JP | 2008-279678 | A | 11/2008 |
| JP | 2008265180 | A | 11/2008 |
| JP | 2008265278 | A | 11/2008 |
| JP | 2008-307703 | A | 12/2008 |
| JP | 2009001020 | A | 1/2009 |
| JP | 2009028976 | A | 2/2009 |
| JP | 2009509812 | A | 3/2009 |
| JP | 2009184832 | A | 8/2009 |
| JP | 2009-214431 | A | 9/2009 |
| JP | 2010-234697 | A | 10/2010 |
| JP | 2011-011407 | A | 1/2011 |
| JP | 2011011401 | A | 1/2011 |
| JP | 2011110843 | A | 6/2011 |
| JP | 2011110845 | A | 6/2011 |
| JP | 2011110848 | A | 6/2011 |
| WO | 0032401 | A1 | 6/2000 |
| WO | 0110649 | A1 | 2/2001 |
| WO | 0232680 | A1 | 4/2002 |
| WO | 03080350 | A1 | 10/2003 |
| WO | 2005101306 | A1 | 10/2005 |
| WO | 2006013466 | A2 | 2/2006 |
| WO | 2006024913 | A2 | 3/2006 |
| WO | 2006033431 | A1 | 3/2006 |
| WO | 2006033432 | A1 | 3/2006 |
| WO | 2006090842 | A1 | 8/2006 |
| WO | 2009107534 | A1 | 9/2009 |
| WO | 2010-113782 | A1 | 10/2010 |
| WO | 2010113445 | A1 | 10/2010 |

OTHER PUBLICATIONS

Apr. 9, 2015—(US) Notice of Allowance—U.S. Appl. No. 13/431,277.

Apr. 10, 2015—(US) Non-Final Office Action—U.S. Appl. No. 13/430,080.

Apr. 13, 2015—(CN) Notification of Third Office Action—App 201210071810.7—Eng. Tran.

Apr. 14, 2015—(US) Notice of Allowance—U.S. Appl. No. 13/240,266.

Apr. 17, 2015—(US) Final Office Action—U.S. Appl. No. 14/226,367.

Apr. 20, 2015 (AU) Office Action in Application No. 2010231426.

Apr. 21, 2015—(US) Final Office Action—U.S. Appl. No. 14/226,428.

Aug. 4, 2015—(US) Notice of Allowance—U.S. Appl. No. 14/141,576.

Aug. 6, 2015—(CN) Office Action—App 201410046812.X—Eng Tran.

Aug. 11, 2015—(AU) Patent Examination Report 1—App 2014221250.

Aug. 13, 2015—(US) Final Office Action—U.S. Appl. No. 13/431,371.

Aug. 24, 2015—(US) Final Office Action—U.S. Appl. No. 14/226,402.

Feb. 6, 2015—(EP) Extended Search Report—App. 14189221.6.

Feb. 10, 2015—(US) Notice of Allowance—U.S. Appl. No. 14/226,380.

Feb. 12, 2015—(US) Final Office Action—U.S. Appl. No. 12/732,257.

Feb. 12, 2015—(US) Final Office Action—U.S. Appl. No. 13/431,350.

Feb. 12, 2015—(US) Final Office Action—U.S. Appl. No. 14/226,417.

Feb. 13, 2015—(US) Non-Final Office Action—U.S. Appl. No. 13/240,322.

Feb. 17, 2015—(US) Final Office Action—U.S. Appl. No. 14/141,673.

Feb. 19, 2015 (CA) Office Action in Application No. 2755885.

(56) References Cited

OTHER PUBLICATIONS

Jan. 2, 2015—(US) Non-Final Office Action—U.S. Appl. No. 14/226,262.
Jan. 5, 2015—(US) Non-final Office Action—U.S. Appl. No. 14/226,201.
Jan. 16, 2015—(US) Non-Final Office Action—U.S. Appl. No. 14/226,402.
Jan. 20, 2015—(US) Non-Final Office Action—U.S. Appl. No. 13/431,371.
Jan. 22, 2015—(US) Non-Final Office Action—U.S. Appl. No. 14/226,411.
Jan. 22, 2015—(US) Notice of Allowance—U.S. Appl. No. 12/732,457.
Jan. 23, 2015 (AU) Office Action in Application No. 2010231426.
Jan. 28, 2015—(US) Notice of Allowance—U.S. Appl. No. 13/431,277.
Jan. 29, 2015—(TW) Office Action—App 099132599.
Jul. 7, 2015—(US) Notice of Allowance—U.S. Appl. No. 14/141,673.
Jul. 16, 2015—(US) Non-Final Office Action—U.S. Appl. No. 14/226,417.
Jul. 31, 2015—(US) Final Office Action—U.S. Appl. No. 14/226,411.
Jun. 1, 2015—(CN) Notification of First Office Action—App 201310717842.4—Eng Tran.
Jun. 1, 2015—(CN) Notification of First Office Action—App 201310717871.0—Eng Tran.
Jun. 2, 2015—(US) Final Office Action—U.S. Appl. No. 14/226,262.
Jun. 2, 2015—(US) Non-Final Office Action—U.S. Appl. No. 14/226,256.
Jun. 5, 2015—(US) Notice of Allowance—U.S. Appl. No. 14/226,380.
Jun. 17, 2015—(US) Final Office Action—U.S. Appl. No. 14/226,325.
Jun. 19, 2015—(CN) Notification of First Office Action—App 201310659875.8—Eng Tran.
Jun. 25, 2015—(US) Non-Final Office Action—U.S. Appl. No. 13/431,350.
Mar. 2, 2015 (TW) Office Action in Application No. 101110368.
Mar. 4, 2015—(US) Final Office Action—U.S. Appl. No. 14/141,576.
Mar. 4, 2015—(US) Non-Final Office Action—U.S. Appl. No. 14/226,386.
Mar. 6, 2015 (AU) Office Action in Application No. 2010231425.
Mar. 6, 2015—(US) Final Office Action—U.S. Appl. No. 14/226,424.
Mar. 10, 2015—(JP) Office Action in Application No. 2014-095027.
Mar. 12, 2015—(EP) Search Report in Application No. 14156840.2.
Mar. 13, 2015—(US) Notice of Allowance in U.S. Appl. No. 14/226,165.
Mar. 17, 2015—(US) Notice of Allowance—U.S. Appl. No. 13/848,750.
Mar. 23, 2015 (US) Notice of Allowance in U.S. Appl. No. 13/934,512.
May 1, 2015—(US) Notice of Allowance—U.S. Appl. No. 12/644,572.
May 6, 2015—(US) Final Office Action—U.S. Appl. No. 14/226,259.
May 6, 2015—(US) Final Office Action—U.S. Appl. No. 14/226,373.
May 19, 2015—(US) Notice of Allowance—U.S. Appl. No. 14/226,201.
May 19, 2015—(US) Final Office Action—U.S. Appl. No. 14/226,289.
May 20, 2015—(US) Notice of Allowance—U.S. Appl. No. 13/848,750.
May 22, 2015—(US) Non-Final Office Action—U.S. Appl. No. 12/732,257.
May 26, 2015—(CN) Office Action—App 201310659625.4.
May 29, 2015—(MY) Substantive Examination Adverse Report—App. PI 2013702520—Eng Tran.
May 29, 2015—(US) Notice of Allowance—U.S. Appl. No. 14/226,165.
Sep. 1, 2015—(US) Notice of Allowance—U.S. Appl. No. 14/226,259.
Sep. 8, 2015—(JP) Office Action—App 2014-210427—Eng Tran.
Sep. 8, 2015—(US) Notice of Allowance—U.S. Appl. No. 14/141,673.
Sep. 9, 2015—(US) Final Office Action—U.S. Appl. No. 14/226,386.
Jul. 16, 2013 (US) Office Action in U.S. Appl. No. 12/817,556.
Mar. 23, 2015—(US) Notice of Allowance in U.S. Appl. No. 13/934,512.
Sep. 17, 2015—(US) Non-Final Office Action—U.S. Appl. No. 14/226,424.
Sep. 18, 2015—(US) Non-Final Office Action—U.S. Appl. No. 14/226,428.
Oct. 1, 2015—(US) Notice of Allowance—U.S. Appl. No. 12/732,457.
Oct. 5, 2015—(US) Notice of Allowance—U.S. Appl. No. 12/644,572.
Oct. 5, 2015—(US) Notice of Allowance—U.S. Appl. No. 14/141,673.
Oct. 7, 2015—(US)—Final Office Action—U.S. Appl. No. 13/240,322.
Oct. 13, 2015—(US) Notice of Allowance—U.S. Appl. No. 13/430,033.
Oct. 20, 2015—(US) Notice of Allowance—U.S. Appl. No. 14/226,201.
Mar. 30, 2012 (US) Office Action issued in U.S. Appl. No. 12/644,451.
Apr. 11, 2012 (PCT) International Preliminary Report on Patentability issued in PCT/JP2010/055310.
Apr. 11, 2012 (US) Office Action in U.S. Appl. No. 12/644,572.
May 8, 2012 (JP) Office Action issued in Japanese Patent Application No. 2009-086239.
May 10, 2012 (US) Office Action in U.S. Appl. No. 13/431,371.
May 22, 2012 (JP) Japanese Office Action issued in Japanese Patent Application No. 2010-041323.
Jun. 4, 2012 (US) Office Action in U.S. Appl. No. 13/431,350.
Jun. 6, 2012 (US) Office Action in U.S. Appl. No. 12/732,747.
Jun. 8, 2012 (US) Office Action in U.S. Appl. No. 13/431,277.
Jun. 12, 2012 (JP) Office Action issued in Japanese Patent Application No. 2009-086222.
Jun. 12, 2012 (JP) Office Action issued in Japanese Patent Application No. 2010-084499.
Jun. 12, 2012 (US) Office Action in U.S. Appl. No. 12/732,828.
Jun. 15, 2012 (US) Office Action in U.S. Appl. No. 12/732,404.
Jul. 3, 2012 (JP) Office Action issued in Japanese Patent Application No. 2010-084500.
Jul. 3, 2012 (JP) Office Action issued in Japanese Patent Application No. 2010-084501.
Jul. 3, 2012 (JP) Office Action issued in Japanese Patent Application No. 2010-084502.
Jul. 10, 2012 (PCT) International Preliminary Report on Patentability issued in PCT/JP2009/070971.
Jul. 13, 2012 (US) Office Action in U.S. Appl. No. 12/644,413.
Jul. 20, 2012 (US) Office Action in U.S. Appl. No. 12/817,556.
Jul. 30, 2012 (US) Final Office Action in U.S. Appl. No. 12/732,247.
Aug. 3, 2012 (US) Office Action in U.S. Appl. No. 12/644,373.
Aug. 14, 2012 (PCT) International Preliminary Report on Patentability issued in PCT/JP2009/071812.
Aug. 27, 2012 (US) Office Action in U.S. Appl. No. 12/644,572.
Aug. 28, 2012 (US) Office Action in U.S. Appl. No. 12/644,451.
Aug. 28, 2012 (US) Office Action in U.S. Appl. No. 12/732,257.
Aug. 28, 2012 (US) Office Action in U.S. Appl. No. 12/732,457.
Aug. 30, 2012 (US) Office Action in U.S. Appl. No. 12/732,647.
Sep. 6, 2012 (EP) European Communication issued in European Patent Application No. 10711477.9.
Sep. 11, 2012 (JP) Office Action issued in Japanese Patent Application No. 2009-086172.

(56) References Cited

OTHER PUBLICATIONS

Sep. 11, 2012 (JP) Office Action issued in Japanese Patent Application No. 2009-088449.
Sep. 28, 2012 (NZ) Examination Report issued in New Zealand Patent Application No. 596044.
Oct. 16, 2012 (US) Office Action in U.S. Appl. No. 12/873,633.
Oct. 23, 2012 (US) Office Action in U.S. Appl. No. 12/732,404.
Nov. 13, 2012 (JP) Office Action issued in Japanese Patent Application No. 2009-270056.
Nov. 13, 2012 (JP) Office Action issued in Japanese Patent Application No. 2009-297502.
Dec. 18, 2012 (JP) Office Action issued in Japanese Patent Application No. 2009-156369.
Nov. 22, 2013 (EP) Office Action issued in European Patent Application No. 10711776.4.
Nov. 26, 2013 (JP) Office Action issued in Japanese Patent Application No. 2011-507142.
Jan. 17, 2013 (US) Office Action in U.S. Appl. No. 12/732,747.
Jan. 22, 2013 (US) Office Action in U.S. Appl. No. 12/732,247.
Jan. 29, 2013 (JP) Office Action issued in Japanese Patent Application No. 2011-506968.
Jan. 30, 2013 (US) Office Action in U.S. Appl. No. 13/431,277.
Feb. 28, 2013 (US) Office Action in U.S. Appl. No. 12/817,556.
Mar. 1, 2013 (US) Office Action in U.S. Appl. No. 12/732,647.
Mar. 8, 2013 (CN) Office Action issued in Chinese Patent Application No. 200980158165.9.
Apr. 2, 2013 (JP) Office Action issued in Japanese Patent Application No. 2009-156399.
Apr. 2, 2013 (JP) Office Action issued in Japanese Patent Application No. 2009-156404.
Apr. 2, 2013 (JP) Office Action issued in Japanese Patent Application No. 2009-156281.
Apr. 2, 2013 (JP) Office Action issued in Japanese Patent Application No. 2009-156350.
Apr. 2, 2013 (JP) Office Action issued in Japanese Patent Application No. 2009-156355.
Apr. 2, 2013 (JP) Office Action issued in Japanese Patent Application No. 2009-156357.
Apr. 2, 2013 (JP) Office Action issued in Japanese Patent Application No. 2009-156371.
Apr. 2, 2013 (JP) Office Action issued in Japanese Patent Application No. 2009-156398.
Apr. 2, 2013 (JP) Office Action issued in Japanese Patent Application No. 2009-156403.
Apr. 2, 2013 (JP) Office Action issued in Japanese Patent Application No. 2009-270325.
Apr. 8, 2013 (EP) European Search Report issued in European Patent Application No. 09852278.2.
Apr. 15, 2013 (CN) Office Action issued in Chinese Patent Application No. 201080013099.9.
Apr. 19, 2013 (CN) Office Action issued in Chinese Patent Application No. 200910262678.6.
Apr. 23, 2013 (JP) Office Action issued in Japanese Patent Application No. 2010-73748.
Apr. 23, 2013 (JP) Office Action issued in Japanese Patent Application No. 2010-73750.
Apr. 23, 2013 (US) Office Action in Application No. 13430080.
Apr. 26, 2013 (CN)Office Action issued in Chinese Patent Application No. 200910262676.7.
Apr. 26, 2013 (US) Office Action in U.S. Appl. No. 13/755,174.
May 2, 2013 (CN) Office Action issued in Chinese Patent Application No. 200910262677.1.
May 2, 2013 (CN) Office Action issued in Chinese Patent Application No. 200910262679.0.
May 2, 2013 (CN) Office Action issued in Chinese Patent Application No. 200910262680.3.
May 7, 2013 (US) Office Action in U.S. Appl. No. 12/732,404.
May 14, 2013 (JP) Office Action issued in Japanese Patent Application No. 2010-073747.
May 14, 2013 (US) Office Action in U.S. Appl. No. 13/431,350.
May 14, 2013 (US) Office Action in U.S. Appl. No. 13/431,371.
May 21, 2013 (JP) Office Action issued in Japanese Patent Application No. 2009-154698.
May 21, 2013 (JP) Office Action issued in Japanese Patent Application No. 2009-154699.
May 21, 2013 (Jp) Office Action issued in Japanese Patent Application No. 2010-073749.
May 21, 2013 (JP) Office Action issued in Japanese Patent Application No. 2010-073755.
May 21, 2013 (US) Office Action in U.S. Appl. No. 12/732,257.
May 21, 2013 (US) Office Action in U.S. Appl. No. 12/732,828.
May 22, 2013 (US) Office Action in U.S. Appl. No. 12/644,413.
May 22, 2013 (US) Office Action in U.S. Appl. No. 12/873,633.
May 28, 2013 (JP) Office Action issued in Japanese Patent Application No. 2010-073751.
May 30, 2013 (US) Office Action in U.S. Appl. No. 12/732,247.
Jun. 4, 2013 (CN) Office Action issued in Chinese Patent Application No. 200980161443.6.
Jun. 4, 2013 (JP) Office Action issued in Japanese Patent Application No. 2010-073754.
Jun. 19, 2013 (US) Office Action in U.S. Appl. No. 12/644,373.
Jul. 2, 2013 (JP) Office Action issued in Japanese Patent Application No. 2009-156281.
Jul. 2, 2013 (JP) Office Action issued in Japanese Patent Application No. 2009-156350.
Jul. 10, 2013 (NZ) (Office Action issued in New Zealand Patent Application No. 596044.
Jul. 16, 2013 (US) Office Action issued in U.S. Appl. No. 12/817,556.
Aug. 1, 2013 (US) Office Action in U.S. Appl. No. 12/732,747.
Aug. 7, 2013 (CN) Office Action issued in Chinese Patent Application No. 200910262675.2
Aug. 9, 2013 (US) Office Action in U.S. Appl. No. 13/431,350.
Aug. 22, 2013 (CN) Office Action issued in Chinese Patent Application No. 201080013339.5.
Aug. 27, 2013 (US) Office Action in U.S. Appl. No. 12/644,451.
Aug. 27, 2013 (US) Office Action in U.S. Appl. No. 12/644,572.
Sep. 3, 2013 (CN) Office Action issued in Chinese Patent Application No. 201010150928.X.
Sep. 3, 2013 (JP) Office Action issued in Japanese Patent Application No. 2011507143.
Sep. 9, 2013 (US) Office Action issued in U.S. Appl. No. 12/732,404.
Sep. 11, 2013 (US) Office Action in U.S. Appl. No. 13/430,080.
Sep. 12, 2013 (US) Office Action in U.S. Appl. No. 12/732,457.
Sep. 12, 2013 (US) Office Action in U.S. Appl. No. 12/732,828.
Sep. 17, 2013 (US) Office Action in U.S. Appl. No. 12/732,647.
Sep. 22, 2013 (CN) Office Action issued in Chinese Patent Application No. 201010150109.5.
Sep. 25, 2013 (NZ) Office Action issued in New Zealand Patent Application No. 596044.
Sep. 26, 2013 (CN) Office Action issued in Chinese Patent Application No. 201010150090.4.
Sep. 30, 2013 (CN) Office Action issued in Chinese Patent Application No. 201010150088.7.
Oct. 1, 2013 (JP) Office Action issued in Japanese Patent Application No. 2011547222.
Oct. 16, 2013 (US) Non-Final Office Action issued in corresponding U.S. Appl. No. 13/240,266.
Oct. 28, 2013 (CN) Office Action issued in Chinese Patent Application No. 200980158165.9.
Nov. 1, 2013 (CN) Office Action Issued in Chinese Patent Application No. 200980161405.0.
Nov. 6, 2013 (EP) European Search Report issued in European Patent Application No. 09842716.4.
Nov. 8, 2013 (NZ) Office Action issued in New Zealand Patent Application No. 596044.
Nov. 12, 2013 (EP) European Search Report issued in European Patent Application No. 10758310.6.
Nov. 13, 2013 (US) Office Action issued in corresponding U.S. Appl. No. 13/240,216.
Nov. 19, 2013 (US) Office Action issued in corresponding U.S. Appl. No. 13/934,512.

(56) References Cited

OTHER PUBLICATIONS

Dec. 3, 2013 (JP) Office Action issued in Japanese Patent Application No. 2011-507049.
Dec. 16, 2013 (EP) Extended European Search Report in European Patent Application No. 12160324.5.
Dec. 18, 2013 (EP) Extended European Search Report in European Patent Application No. 12160192.6.
Dec. 19, 2013 (CN) Office Action issued in Chinese Patent Application No. 200910262674.8.
Dec. 20, 2013 (EP) Extended European Search Report issued in European Patent Application No. 12161271.7.
Dec. 23, 2013 (US) Final Office Action issued in U.S. Appl. No. 13/431,350.
Dec. 30, 2013 (CN) Office Action issued in Chinese Application No. 201010209208.6.
Dec. 30, 2013 (CN) Office Action issued in Chinese Patent Application No. 201210070147.9.
Aug. 12, 2014—(CN) Notice of Second Office Action—App 201210071810.7—Eng Tran.
Aug. 26, 2014—(CN) Notice of Second Office Action—App 201010274378.2—Eng Tran.
Aug. 28, 2014—(US) Non-Final Office Action—U.S. Appl. No. 13/240,216.
Dec. 1, 2014—(US) Non-Final Office Action—U.S. Appl. No. 14/226,289.
Dec. 5, 2014—(US) Non-Final Office Action—U.S. Appl. No. 14/226,325.
Dec. 16, 2014—(US) Non-Final Office Action—U.S. Appl. No. 14/226,259.
Dec. 16, 2014—(US) Notice of Allowance—U.S. Appl. No. 13/240,216.
Dec. 26, 2014—(CN) Office Action in Application No. 201080013339.5.
Feb. 4, 2014 (US) Notice of Allowance issued in U.S. Appl. No. 12/732,404.
Feb. 19, 2014 (US) Notice of Allowance issued in U.S. Appl. No. 12/732,747.
Feb. 24, 2014 (US) Notice of Allowance issued in U.S. Appl. No. 12/644,451.
Jan. 3, 2014 (AU) Office Action issued in Australian Patent Application No. 2010231426.
Jan. 27, 2014 (US) Notice of Allowance issued in U.S. Appl. No. 12/732,828.
Jul. 7, 2014 (US) Final Office Action issued in U.S. Appl. No. 13/430,080.
Jul. 8, 2014 (CA) Office Action issued in Canadian Patent Application No. 2,755,882.
Jul. 8, 2014 (JP) Office Action issued in Japanese Patent Application No. 2013-153421.
Jul. 8, 2014 (JP) Office Action issued in Japanese Patent Application No. 2013-153495.
Jul. 16, 2014 (US)—Restriction requirement in U.S. Appl. No. 13/848,750.
Jul. 18, 2014 (US) Office Action in U.S. Appl. No. 13/431,350.
Jul. 22, 2014 (US) Office Action in U.S. Appl. No. 12/732,257.
Jul. 25, 2014—(CN) Notice of Second Office Action—App 201010150090.4—Eng Tran.
Jul. 28, 2014—(CN) Notice of Second Office Action—App 201010150088.7—Eng Tran.
Jun. 26, 2014—(CN) Office Action—App 200980161405.
Jun. 27, 2014 (AU) Office Action issued in Australian Patent Application No. 2010231426.
Nov. 4, 2014—(US) Non-Final Office Action—U.S. Appl. No. 14/226,367.
Nov. 4, 2014—(US) Non-Final Office Action—U.S. Appl. No. 14/226,428.
Nov. 5, 2014—(US) Non-Final Office Action—U.S. Appl. No. 14/226,373.
Nov. 12, 2014 (MX) Office Action in Application No. MX/a/2011/013553.
Nov. 25, 2014—(US) Notice of Allowance—U.S. Appl. No. 13/934,512.
Mar. 5, 2010 (PCT) International Search Report in International Application No. PCT/JP2009/007088.
Mar. 16, 2010 (PCT) International Search Report and Written Opinion issued in International Application No. PCT/JP2009/071812.
Mar. 16, 2010 (PCT) International Search Report in International Application No. PCT/JP2010/050253.
Mar. 23, 2010 (PCT) International Search Report in International Application No. PCT/JP2009/070971.
Mar. 23, 2010 (PCT) International Search Report in International Application No. PCT/JP2009/071568.
May 20, 2010 (PCT) International Search Report in International Application No. PCT/JP2009/007085.
May 20, 2010 (PCT) International Search Report in International Application No. PCT/JP2009/007086.
May 20, 2010 (PCT) International Search Report in International Application No. PCT/JP2009/007087.
May 21, 2010 (PCT) International Search Report in International Application No. PCT/JP2009/007089.
May 21, 2010 Extended European Search Report in European Patent Application No. 09180351.
May 21, 2010 Extended European Search Report in European Patent Application No. 09180354.
Jun. 22, 2010 (PCT) International Search Report in International Application No. PCT/JP2010/055305.
Jun. 22, 2010 (PCT) International Search Report in International Application No. PCT/JP2010/055310.
Jun. 22, 2010 (PCT) International Search Report in International Application No. PCT/JP2010/055311.
Jun. 22, 2010 (PCT) International Search Report in International Application No. PCT/JP2010/055324.
Jun. 22, 2010 (PCT) International Search Report in International Application No. PCT/JP2010/055326.
Jun. 28, 2010 (PCT) International Search Report in International Application No. PCT/JP2010/002170.
Jul. 2, 2010 Extended European Search Report in European Patent Application No. 10157994.
Jul. 12, 2010 Extended European Search Report in European Patent Application No. 10158024.
Jul. 30, 2010 (PCT) International Search Report in International Application No. PCT/JP2010/002165.
Jul. 30, 2010 (PCT) International Search Report in International Application No. PCT/JP2010/002169.
Aug. 3, 2010 (PCT) International Search Report in International Application No. PCT/JP2010/002154.
Aug. 3, 2010 (PCT) International Search Report in International Application No. PCT/JP2010/002161.
Aug. 24, 2010 (PCT) International Search Report in International Application No. PCT/JP2010/004076.
Oct. 12, 2010 Extended European Search Report in European Patent Application No. 10155348.
Dec. 3, 2010 Extended European Search Report in European Patent Application No. 10175769.
Oct. 11, 2011 (JP) Office Action issued in Japanese Patent Application No. 2008-331634.
Oct. 11, 2011 (JP) Office Action issued in Japanese Patent Application No. 2009-088227.
Oct. 11, 2011 (JP) Office Action issued in Japanese Patent Application No. 2009-088238.
Oct. 11, 2011 (JP) Office Action issued in Japanese Patent Application No. 2009-088441.
Oct. 11, 2011 (JP) Office Action issued in Japanese Patent Application No. 2009-088460.
Oct. 11, 2011—(JP) Office Action issued in Japanese Patent Application No. 2009-088440.
Nov. 15, 2011 (JP) Office Action issued in Japanese Patent Application No. 2009-088241.
Nov. 15, 2011 (PCT) International Preliminary Report on Patentability issued in PCT/JP2009/071568.
Nov. 15, 2011 (PCT) International Preliminary Report on Patentability issued in PCT/JP2010/050253.

(56) References Cited

OTHER PUBLICATIONS

Nov. 15, 2011 (PCT) International Preliminary Report on Patentability issued in PCT/JP2010/055324.
Nov. 15, 2011 (PCT) International Preliminary Report on Patentability issued in PCT/JP2010/055326.
Jan. 17, 2012 (JP) Office Action issued in Japanese Patent Application No. 2009-088456.
Feb. 14, 2012 (PCT) International Preliminary Report on Patentability in International Application No. PCT/JP2010/055305.
Feb. 14, 2012 (PCT) International Preliminary Report on Patentability in International Application No. PCT/JP2010/055311.
Mar. 7, 2012 (US) Office Action issued in U.S. Appl. No. 12/732,404.
Mar. 8, 2012 (US) Office Action issued in U.S. Appl. No. 12/732,247.
Mar. 9, 2012 (US) Office Action issued in U.S. Appl. No. 12/732,257.
Mar. 26, 2012 (US) Office Action issued in U.S. Appl. No. 12/732,457.
Mar. 27, 2012 (JP) Office Action issued in Japanese Patent Application No. 2008-331638.
Mar. 27, 2012 (JP) Office Action issued in Japanese Patent Application No. 2008-331639.
Mar. 27, 2012 (JP) Office Action issued in Japanese Patent Application No. 2009-156405.
Mar. 27, 2012 (JP) Office Action issued in Japanese Patent Application No. 2009-156406.
Mar. 27, 2012 (JP) Office Action issued in Japanese Patent Application No. 2009-156407.
Mar. 27, 2012 (JP) Office Action issued in Japanese Patent Application No. 2009-270221.
Oct. 2, 2014—(US) Non-Final Office Action—U.S. Appl. No. 13/430,033.
Oct. 10, 2014—(US) Notice of Allowance—U.S. Appl. No. 12/732,457.
Oct. 27, 2014—(US) Non-Final Office Action—U.S. Appl. No. 14/141,576.
Oct. 30, 2014 (US) Final Office Action U.S. Appl. No. 14/226,256.
Sep. 2, 2014—(US) Non-Final Office Action—U.S. Appl. No. 14/226,165.
Sep. 9, 2014—(US) Non-Final Office Action—U.S. Appl. No. 14/226,380.
Sep. 9, 2014—(US) Non-Final Office Action—U.S. Appl. No. 14/226,417.
Sep. 10, 2014—(US) Notice of Allowance—U.S. Appl. No. 13/934,512.
Sep. 11, 2014—(US) Election Requirement—U.S. Appl. No. 13/240,322.
Sep. 11, 2014—(US) Non-Final Office Action—U.S. Appl. No. 13/848,750.
Sep. 12, 2014—(US) Final Office Action—U.S. Appl. No. 13/431,371.
Sep. 12, 2014—(US) Non-Final Office Action—U.S. Appl. No. 14/226,386.
Sep. 22, 2014—(US) Non-Final Office Action—U.S. Appl. No. 14/141,673.
Sep. 24, 2014—(JP) Notification of Rejection—App 2013-142488—Eng Tran.
Sep. 24, 2014—(US) Notice of Allowance—U.S. Appl. No. 13/431,277.
Sep. 25, 2014—(US) Non-Final Office Action—U.S. Appl. No. 14/226,424.
Jan. 17, 2014 (CN) Office Action issued in Chinese Patent Application No. 201210071810.7.
Jan. 22, 2014 (CN) Office Action issued in Chinese Patent Application No. 201010274378.2.
Feb. 5, 2014 (EP) Extended European Search Report issued in European Patent Application No. 09852818.5.
Mar. 10, 2014 (US) Non-Final Office Action issued in U.S. Appl. No. 13/430,080.
Mar. 13, 2014 (CN) Office Action issued in Chinese Application No. 201010150928.
Mar. 25, 2014 (US) Non-Final Office Action issued in U.S. Appl. No. 13/431,371.
Mar. 26, 2014 (US) Final Office Action issued in U.S. Appl. No. 12/732,457.
Mar. 27, 2014 (US) Notice of Allowance issued in U.S. Appl. No. 13/240,266.
Apr. 1, 2014 (JP) Office Action issued in Japanese Patent Application No. 2013-035990.
Apr. 2, 2014 (CN) Office Action issued in Chinese Patent Application No. 201210070968.
Apr. 10, 2014 (CN) Office Action issued in Chinese Application No. 201010150109.
Apr. 11, 2014 (US) Notice of Allowance issued in U.S. Appl. No. 12/644,572.
Apr. 15, 2014 (AU) Office Action issued in Australian Patent Application No. 2009332345.
Apr. 17, 2014 (RU) Office Action issued in Russian Patent Application No. 2011143817.
Apr. 25, 2014 (MX) Mexican Office Action issued in Mexican Application No. MX/a/20111013553.
May 6, 2014 (CN) Chinese Office Action issued in Chinese Application No. 201010150087.2.
May 6, 2014 (CN) Chinese Office Action issued in Chinese Application No. 201010150878.5.
May 6, 2014 (US) Notice of Allowance issued in U.S. Appl. No. 13/934,512.
May 7, 2014 (US) Final Office Action issued in U.S. Appl. No. 13/240,216.
May 9, 2014 (VN) Office Action issued in Vietnamese Patent Application No. 1-2011-02491.
May 13, 2014 (CN) Chinese Office Action issued in Chinese Application No. 201080013339.5.
May 21, 2014 (EP) Extended European Search Report issued in European Application No. 10758552.3.
May 22, 2014 (US) Non-Final Office Action issued in U.S. Appl. No. 14/226,256.
Jun. 2, 2014 (AU) Office action issued in Australian Patent Application No. 2010231425.
Jun. 6, 2014 (US) Restriction Requirement issued in corresponding U.S. Appl. No. 13/430,033.
Jun. 10, 2014 (JP) Japanese Office Action issued Japanese Application No. 2013-142488.
Jun. 20, 2014 (CN) Office action issued in Chinese Patent Application No. 201210070147.
Jun. 24, 2014 (JP) Japanese Office Action issued Japanese Application No. 2013-153250.
Jun. 24, 2014 (JP) Japanese Office Action issued Japanese Application No. 2013-153340.
Apr. 1, 2015—(US) Notice of Allowance—U.S. Appl. No. 12/732,457.
Apr. 1, 2015—(US) Notice of Allowance—U.S. Appl. No. 13/430,033.
Apr. 2, 2015 (EP) Office Action in Application No. 10711776.4.
Apr. 7, 2015 (TW) Office Action in Application No. 99132600.
Apr. 9, 2015—(TW) Office Action—App 099132598—Eng. Tran.
Oct. 22, 2015—(US) Final Office Action—U.S. Appl. No. 14/641,681.
Sep. 2, 2015—(Cn) Notification of First Office Action—App 201410200475.5.
Oct. 23, 2015—(US) Final Office Action—U.S. Appl. No. 13/431,350.
Oct. 26, 2015—(US)—Non-Final Office Action—U.S. Appl. No. 14/643,865.
Oct. 30, 2015—(US)—Non-Final Office Action—U.S. Appl. No. 14/226,373.
Nov. 3, 2015—(US) Notice of Allowance—U.S. Appl. No. 14/226,259.
Feb. 11, 2016—(US) Notice of Allowance—U.S. Appl. No. 14/226,402.
Feb. 12, 2016—(US) Notice of Allowance—U.S. Appl. No. 13/431,277.

(56) References Cited

OTHER PUBLICATIONS

Feb. 16, 2016—(US) Non-Final Office Action—U.S. Appl. No. 14/867,877.
Feb. 24, 2016—(US) Non-Final Office Action—U.S. Appl. No. 14/226,262.
Feb. 25, 2016—(US) Non-Final Office Action—U.S. Appl. No. 14/141,568.
Feb. 22, 2016—(US) Non-Final Office Action—U.S. Appl. No. 14/226,386.
Nov. 27, 2015—(CN) Office Action—App 201410311930.9.
Dec. 3, 2015—(CN) Office Action—App 201510088644.5.
Sep. 22, 2016—(KR) Notice of Final Rejection—App 10-2011-7021961, Eng Tran.
Mar. 4, 2016—(US) Notice of Allowance—U.S. Appl. No. 14/643,865.
Mar. 29, 2016—(US) Notice of Allowance—U.S. Appl. No. 13/431,350.
Mar. 29, 2016—(US) Notice of Allowance—U.S. Appl. No. 14/641,681.
Apr. 19, 2016—(US) Notice of Allowance—U.S. Appl. No. 14/226,417.
Apr. 21, 2016—(US) Notice of Allowance—U.S. Appl. No. 14/226,428.
Jan. 12, 2016—(US) Notice of Allowance—U.S. Appl. No. 13/431,371.
Jan. 15, 2016—(US) Notice of Allowance—U.S. Appl. No. 12/732,257.
Jan. 29, 2016—(US) Notice of Allowance—U.S. Appl. No. 14/226,411.
Dec. 24, 2015—(TW) Decision of Rejection—App 101110368—Eng Tran.
Feb. 5, 2016—(US) Non-Final Office Action—U.S. Appl. No. 13/240,322.
Nov. 9, 2015—(US) Notice of Allowance—U.S. Appl. No. 13/848,750.
Nov. 13, 2015—(US) Non-Final Office Action—U.S. Appl. No. 14/226,289.
Nov. 25, 2015—(US) Final Office Action—U.S. Appl. No. 14/226,256.
Nov. 27, 2015—(US) Notice of Allowance—U.S. Appl. No. 14/226,367.
Dec. 4, 2015—(US) Notice of Allowance—U.S. Appl. No. 14/226,325.
Dec. 10, 2015—(US) Non-Final Office Action—U.S. Appl. No. 14/755,141.
Nov. 20, 2015—(KR) Office Action—App 10-2015-7006347.
Nov. 20, 2015—(KR) Office Action—App 10-2011-7017238.
Dec. 11, 2015—(US) Notice of Allowance—U.S. Appl. No. 14/226,165.
Dec. 21, 2015—(US) Notice of Allowance—U.S. Appl. No. 13/934,512.
Dec. 23, 2015—(US) Final Office Action—U.S. Appl. No. 14/226,417.
Oct. 27, 2015—(CN) Office Action—App 201410195767.4.
Dec. 24, 2015—(US) Non-Final Office Action—U.S. Appl. No. 14/226,380.

* cited by examiner

FIG. 18

520

521 522

| | ST1 | ST2 | ST3 | ST4 | ST5 | FIRST COLOR TABLE | | SECOND COLOR TABLE | |
|---|---|---|---|---|---|---|---|---|---|
| | | | | | | TAPE COLOR | INK COLOR | TAPE COLOR | INK COLOR |
| 0 | 0 | 1 | 1 | 1 | 0 | White | Black | Mat white | Black |
| 1 | 0 | 1 | 1 | 0 | 0 | Clear | Black | Mat Clear | Black |
| 2 | 1 | 0 | 1 | 0 | 0 | Yellow | Black | SPARE | Black |
| 3 | 0 | 0 | 1 | 1 | 0 | Blue | Black | SPARE | Black |
| 4 | 0 | 1 | 0 | 1 | 0 | Red | Black | SPARE | Black |
| 5 | 1 | 0 | 1 | 1 | 0 | Green | Black | SPARE | Black |
| 6 | 1 | 1 | 1 | 0 | 0 | Flu.Orange | Black | SPARE | Black |
| 7 | 0 | 1 | 0 | 0 | 0 | Flu.Yellow | Black | SPARE | Black |
| 8 | 1 | 0 | 0 | 1 | 0 | Mat Silver | Black | Silver | Black |
| 9 | 1 | 0 | 0 | 0 | 0 | Flu.Green | Black | SPARE | Black |
| 10 | 1 | 1 | 0 | 0 | 0 | Gold | Black | SPARE | Black |
| 11 | 0 | 0 | 0 | 1 | 0 | SPARE | Black | SPARE | Black |
| 12 | 0 | 0 | 1 | 0 | 0 | SPARE | Black | SPARE | Black |
| 13 | 1 | 1 | 1 | 1 | 0 | SPARE | Black | SPARE | Black |
| 14 | 1 | 1 | 0 | 1 | 0 | SPARE | Black | SPARE | Black |
| 15 | 0 | 0 | 0 | 0 | 0 | ERROR | | ERROR | |
| 16 | 0 | 1 | 1 | 1 | 1 | White | Blue | White | Red |
| 17 | 0 | 1 | 1 | 0 | 1 | Clear | Blue | Clear | Red |
| 18 | 1 | 0 | 1 | 0 | 1 | Yellow | Blue | SPARE | SPARE |
| 19 | 0 | 0 | 1 | 1 | 1 | Blue | Blue | Mat Silver | Gold |
| 20 | 0 | 1 | 0 | 0 | 1 | Pink | Blue | Pink | Red |
| 21 | 1 | 0 | 1 | 1 | 1 | Blue | White | Mat Gray | White |
| 22 | 1 | 1 | 1 | 0 | 1 | Clear | White | Mat Green | White |
| 23 | 0 | 1 | 0 | 1 | 1 | Red | White | Mat Pink | White |
| 24 | 0 | 0 | 0 | 1 | 1 | Black | White | Mat Gold | White |
| 25 | 1 | 0 | 0 | 1 | 1 | Black | Gold | Mat Silver | Red |
| 26 | 1 | 0 | 0 | 0 | 1 | SPARE | SPARE | COLOR 1 | |
| 27 | 1 | 1 | 0 | 0 | 1 | SPARE | SPARE | COLOR 2 | |
| 28 | 0 | 0 | 1 | 0 | 1 | SPARE | SPARE | COLOR 3 | |
| 29 | 0 | 0 | 0 | 0 | 1 | SPARE | SPARE | SPARE | SPARE |
| 30 | 1 | 1 | 1 | 1 | 1 | SPARE | SPARE | SPARE | SPARE |
| 31 | 1 | 1 | 0 | 1 | 1 | ERROR | | ERROR | |

TAPE CASSETTE

CROSS-REFERENCE TO RELATED APPLICATION

This application is a Continuation Application of U.S. Ser. No. 14/141,673, filed on Dec. 27, 2013, which is a continuation of U.S. Ser. No. 12/732,828, filed on Mar. 26, 2010, now U.S. Pat. No. 8,764,326; which claims priority to Japanese Patent Application Nos. 2009-088440, 2009-088441, 2009-088456, 2009-088460, and 2009-088468, respectively filed on Mar. 31, 2009, and Japanese Patent Application Nos. 2009-0156355, 2009-156357, 2009-156369, and 2009-156371, respectively filed on Jun. 30, 2009. The disclosure of the foregoing applications is herein incorporated by reference in its entirety.

BACKGROUND

The present invention relates to a tape cassette that is detachably installed in a tape printer.

A tape cassette has been known that, when installed in a housing portion of a tape printer, selectively presses a plurality of detecting switches provided on the cassette housing portion to cause the tape printer to detect color information of the tape cassette (a tape color, a character color, etc.). More specifically, a cassette detection portion is provided on a section of the bottom surface of the tape cassette, where through-holes are formed in a pattern corresponding to the color information. When the tape cassette is installed in the cassette housing portion, the plurality of detecting switches, which are constantly urged in an upward direction, are selectively pressed in accordance with the pattern of the through-holes formed in the cassette detection portion. The tape printer detects the color information of the tape cassette installed in the cassette housing portion based on a combination of the pressed and non-pressed switches among the plurality of detecting switches.

SUMMARY

The pattern of through-holes formed in the cassette detection portion is basically only designed to allow the tape printer to detect the color information. Accordingly, different patterns are allocated randomly in accordance with the color information. In other words, the patterns of through-holes are not formed in a pattern in accordance with rules to allow them to be identified from the outward appearance. Therefore, it is difficult for a person to visually identify the color information. For that reason, for example, in a tape cassette manufacturing process, it may be difficult for a worker to visually identify a tape and an ink ribbon etc. that should be mounted inside the cassette case from the external appearance of the tape cassette.

An object of the present invention is to provide a tape cassette that allows color information to be recognized by visually checking an external appearance of the tape cassette.

Embodiments herein provide a tape cassette that includes a housing. The housing includes a top wall having a top surface and a bottom wall having a bottom surface. The bottom surface has a first surface portion being a flat surface portion and a second surface portion being a flat surface portion. The second surface portion extends generally parallel to the first surface portion and is located between the top surface and the first surface portion in a first direction. The first direction is orthogonal to the top surface or the first surface portion. A first indicator portion is provided on the second surface portion. The first indicator portion has a first protrusion protruding from the second surface portion. The first protrusion has a protruding end being located between the second surface portion and the first surface portion in the first direction.

BRIEF DESCRIPTION OF THE DRAWINGS

Exemplary embodiments of the present disclosure will be described below in detail with reference to the accompanying drawings in which:

FIG. 18 is a diagram showing a data structure of a color information table 520;

DETAILED DESCRIPTION OF EXEMPLARY EMBODIMENTS

Figure 1:
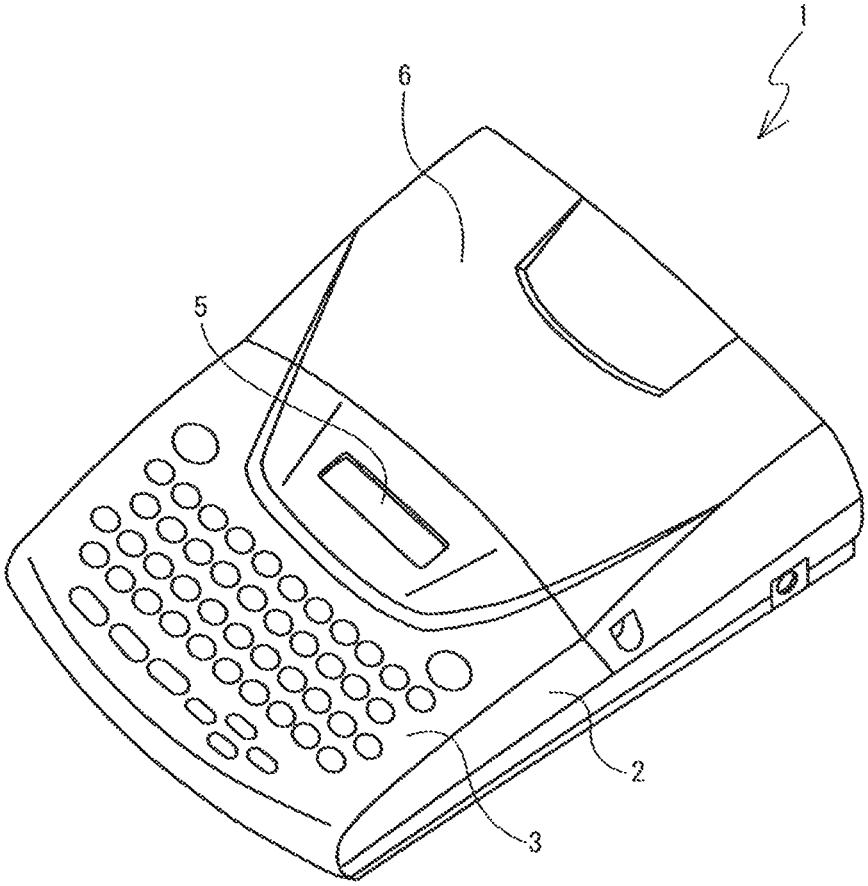
FIG. 1 is a perspective view of a tape printer 1 when a cassette cover 6 is closed.

Exemplary embodiments of the present invention will be explained below with reference to the figures. The configurations of the apparatuses, the flowcharts of various processing and the like shown in the drawings are merely exemplary and do not intend to limit the present invention.

A tape printer 1 and a tape cassette 30 according to the present embodiment will be explained hereinafter with reference to FIG. 1 to FIG. 20. In the explanation of the present embodiment, the lower left side, the upper right side, the lower right side, and the upper left side in FIG. 1 are respectively defined as the front side, the rear side, the right side, and the left side of the tape printer 1. In addition, the lower right side, the upper left side, the upper right side, and the lower left side in FIG. 2 are respectively defined as the front side, the rear side, the right side, and the left side of the tape cassette 30.

Figure 2:
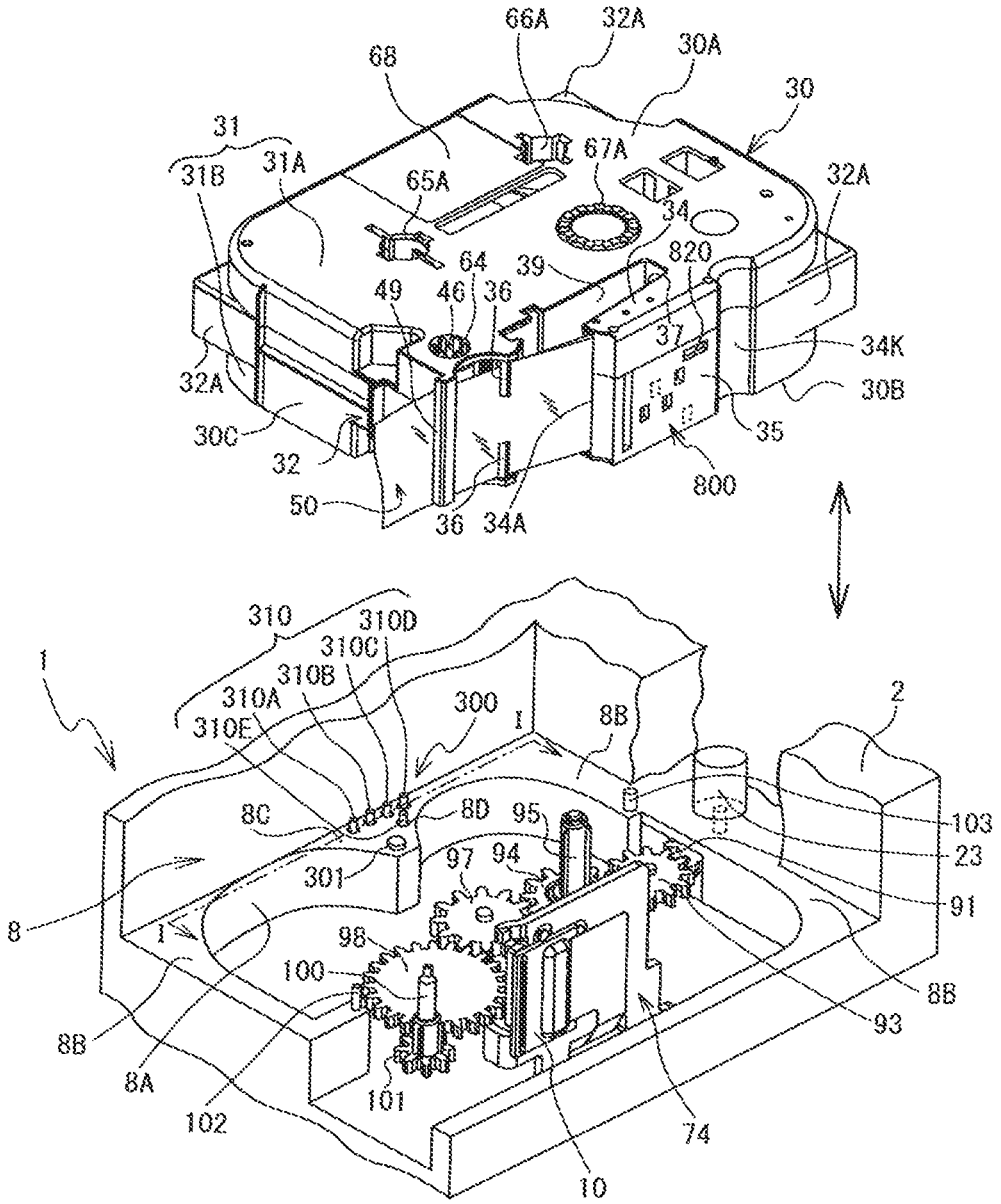
FIG. 2 is a perspective view illustrating a tape cassette 30 and a cassette housing portion 8.

Note that, in actuality, a group of gears, including gears 91, 93, 94, 97, 98 and 101 shown in FIG. 2, is covered and hidden by the bottom surface of a cavity 8A. However, for explanation purposes, the bottom surface of the cavity 8A is not shown in FIG. 2. Furthermore, in FIG. 2 to FIG. 6, side walls that form a periphery around a cassette housing portion 8 are shown schematically, but this is simply a schematic diagram, and the side walls shown in FIG. 2, for example, are depicted as thicker than they are in actuality. Moreover, in FIG. 3 to FIG. 6, for ease of understanding, the states in which various types of the tape cassette 30 are installed in the cassette housing portion 8 are shown with a top case 31A removed.

First, an outline configuration of the tape printer 1 according to the present embodiment will be explained. Hereinafter, the tape printer 1 configured as a general purpose device will be explained as an example. As the general purpose device, the tape printer 1 may commonly use a plurality of types of tape cassettes 30 with various types of tapes. The types of the tape cassettes 30 may include a thermal type tape cassette 30 that houses only a heat-sensitive paper tape, a receptor type tape cassette 30 that houses a print tape and an ink ribbon, and a laminated type tape cassette 30 that houses a double-sided adhesive tape, a film tape and an ink ribbon.

As shown in FIG. 1, the tape printer 1 is provided with a main unit cover 2 that has a rectangular shape in a plan view. A keyboard 3 is provided on the front side of the main unit cover 2. The keyboard 3 includes character keys for characters (letters, symbols, numerals, and so on), a variety of function keys, and so on. A display 5 is provided on the rear side of the keyboard 3. The display 5 displays input characters. A cassette cover 6 is provided on the rear side of the display 5. The cassette cover 6 may be opened and closed when the tape cassette 30 is replaced. Further, although not shown in the figures, a discharge slit is provided to the rear of the left side of the main unit cover 2, from which the printed tape is discharged to the outside. Also, a discharge window is formed on the left side of the cassette cover 6, such that, when the cassette cover 6 is in a closed state, the discharge slit is exposed to the outside.

Next, an internal configuration within the main unit cover 2 below the cassette cover 6 will be explained with reference to FIG. 2 to FIG. 8. As shown in FIG. 2, the cassette housing portion 8 is provided in the interior of the main unit cover 2 below the cassette cover 6. The cassette housing portion 8 is an area in which the tape cassette 30 can be installed or removed. The cassette housing portion 8 includes a cavity 8A and a cassette support portion 8B. The cavity 8A is formed as a depression that has a flat bottom surface, and the shape of the cavity 8A generally corresponds to the shape of a bottom surface of a cassette case 31 (to be described later) when the tape cassette 30 is installed. The cassette support portion 8B is a flat portion extending horizontally from the outer edge of the cavity 8A.

The plan view shape of the cassette support portion 8B generally corresponds to the plan view shape of the tape cassette 30, and is a rectangular shape that is longer in the left-and-right direction. The rear edge of the cavity 8A has a shape in which two arcs are lined up with each other in the left-and-right direction when seen in a plan view. A section of the cassette support portion 8B that is located between the two arcs is referred to as a rear support portion 8C. The rear support portion 8C is a portion that opposes a rear indentation 68C (refer to FIG. 11) of the tape cassette 30 installed in the cassette housing portion 8. The remaining part of the cassette support portion 8B except the rear support portion 8C is a portion that opposes a lower surface of a common portion 32 (more specifically, corner portions 32A to be described later) of the tape cassette 30 when the tape cassette 30 is installed in the cassette housing portion 8.

A rear support pin 301 and a rear detection portion 300 are provided on the rear support portion 8C. The rear support pin 301 is a column-shaped member that protrudes upward from the rear support portion 8C, in the vicinity of a position where the two arcs are joined at the rear edge of the cavity 8A. The rear support pin 301 supports the rear indentation 68C of the tape cassette 30 (to be described later) from underneath when the tape cassette 30 is installed in the cassette housing portion 8.

The rear detection portion 300 includes a plurality of detecting switches 310. Switch terminals 322 of the detecting switches 310 respectively protrude upward from through-holes 8D provided in the rear support portion 8C. In the present embodiment, the rear detection portion 300 includes five detecting switches 310A to 310E. Four of the detecting switches (the detecting switches 310A to 310D) are aligned in a single line along the rear end of the rear support portion 8C, in that order from the left side (the right side in FIG. 7). The remaining one detecting switch 310E is arranged to the front of the second detecting switch 310C from the right. Hereinafter, the detecting switches 310 provided in the rear detection portion 300 are referred to as the rear detecting switches 310.

Figure 7:
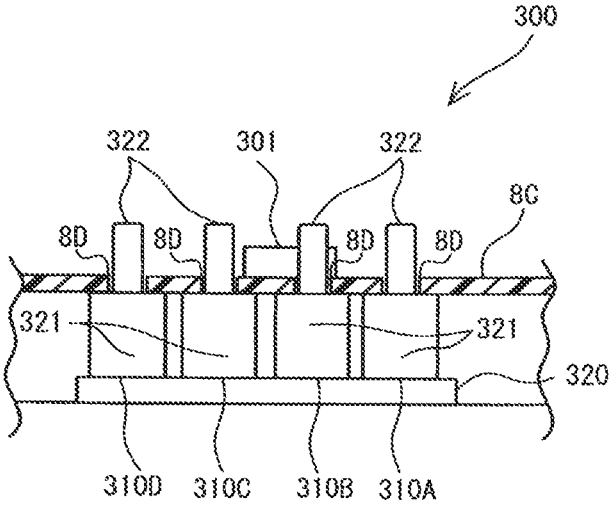
FIG. 7 is a cross-sectional view taken along a line I-I in FIG. 2 as seen in the direction of the arrows.

Here, the structure of the rear detecting switches 310 will be explained in detail with reference to FIG. 7. As shown in FIG. 7, each of the rear detecting switches 310 (the rear detecting switches 310A to 310E) includes a generally cylindrically shaped main unit 321 and a bar-shaped switch terminal 322. The main unit 321 is positioned below the rear support portion 8C, namely, inside the main unit cover 2. The switch terminal 322 can extend and retract in the direction of an axis line from one end of the main unit 321. The other end of the main unit 321 of each of the rear detecting switches 310 is attached to a switch support plate 320 and positioned inside the main unit cover 2.

In addition, on the one end of the main units 321, the switch terminals 322 can extend and retract through the through-holes 8D formed in the rear support portion 8C. Each of the switch terminals 322 is constantly maintained in a state in which the switch terminal 322 extends from the main unit 321 due to a spring member (not shown in the figures) provided inside the main unit 321. When the switch terminal 322 is not pressed, the switch terminal 322 remains extended from the main unit 321 to be in an off state. On the other hand, when the switch terminal 322 is pressed, the switch terminal 322 is pushed back into the main unit 321 to be in an on state.

As shown in FIG. 2, when the tape cassette 30 is not installed in the cassette housing portion 8, the rear detecting switches 310 are separated from the tape cassette 30. Consequently, all the rear detecting switches 310 are in the off state. On the other hand, when the tape cassette 30 is installed in the cassette housing portion 8, the rear detecting switches 310 oppose a rear indicator portion 900 (to be described later) of the tape cassette 30, and the rear detecting switches 310 are selectively pressed by the rear indicator portion 900. The type of the tape (hereinafter referred to as the tape type) mounted in the tape cassette 30 is detected based on a combination of the on and off states of the rear detecting switches 310. The detection of the tape type by the rear detection portion 300 will be described in more detail later.

Further, as shown in FIG. 2, two positioning pins 102 and 103 are provided at two positions on the cassette support portion 8B. More specifically, the positioning pin 102 is provided on the left side of the cavity 8A and the positioning pin 103 is provided on the right side of the cavity 8A. The positioning pins 102 and 103 are provided at the positions that respectively oppose pin holes 62 and 63 (refer to FIG. 11), when the tape cassette 30 is installed in the cassette housing portion 8. The pin holes 62 and 63 are two indentations formed in the lower surface of the common portion 32 of the tape cassette 30. When the tape cassette 30 is installed in the cassette housing portion 8, the positioning pins 102 and 103 are respectively inserted into the pin holes 62 and 63 to support the tape cassette 30 from underneath at the left and right positions of the peripheral portion of the tape cassette 30.

The cassette housing portion 8 is equipped with a feed mechanism, a print mechanism, and the like. The feed mechanism pulls out the tape from the tape cassette 30 and feeds the tape. The print mechanism prints characters on a surface of the tape. As shown in FIG. 2, a head holder 74 is fixed in the front part of the cassette housing portion 8, and a thermal head 10 that includes a heating element (not shown in the figures) is mounted on the head holder 74.

A tape feed motor 23 that is a stepping motor is provided outside of the cassette housing portion 8 (the upper right side in FIG. 2). A drive gear 91 is anchored to the lower end of a drive shaft of the tape feed motor 23. The drive gear 91 is meshed with a gear 93 through an opening, and the gear 93 is meshed with a gear 94. A ribbon take-up shaft 95 is standing upward on the upper surface of the gear 94. The ribbon take-up shaft 95 drives the rotation of a ribbon take-up spool 44, which will be described later. In addition, the gear 94 is meshed with a gear 97, the gear 97 is meshed with a gear 98, and the gear 98 is meshed with a gear 101. A tape drive shaft 100 is standing upward on the upper surface of the gear 101. The tape drive shaft 100 drives the rotation of a tape drive roller 46, which will be described later.

If the tape feed motor 23 is driven to rotate in the counterclockwise direction in a state where the tape cassette 30 is installed in the cassette housing portion 8, the ribbon take-up shaft 95 is driven to rotate in the counterclockwise direction via the drive gear 91, the gear 93 and the gear 94. The ribbon take-up shaft 95 causes the ribbon take-up spool 44, which is fitted with the ribbon take-up shaft 95 by insertion, to rotate. Furthermore, the rotation of the gear 94 is transmitted to the tape drive shaft 100 via the gear 97, the gear 98 and the gear 101, to thereby drive the tape drive shaft 100 to rotate in the clockwise direction. The tape drive shaft 100 causes the tape drive roller 46, which is fitted with the tape drive shaft 100 by insertion, to rotate.

As shown in FIG. 3 to FIG. 6, on the front side of the head holder 74, an arm shaped platen holder 12 is pivotably supported around a support shaft 12A. A platen roller 15 and a movable feed roller 14 are both rotatably supported on the leading end of the platen holder 12. The platen roller 15 faces the thermal head 10, and may be moved close to and apart from the thermal head 10. The movable feed roller 14 faces the tape drive roller 46 that is fitted with the tape drive shaft 100 by insertion, and may be moved close to and apart from the tape drive roller 46.

A release lever (not shown in the figures), which moves in the left-and-right direction in response to the opening and closing of the cassette cover 6, is coupled to the platen holder 12. When the cassette cover 6 is opened, the release lever moves in the right direction, and the platen holder 12 moves toward the stand-by position shown in FIG. 3. At the stand-by position shown in FIG. 3, the platen holder 12 has moved away from the cassette housing portion 8. Therefore, the tape cassette 30 can be installed into or detached from the cassette housing portion 8 when the platen holder 12 is at the stand-by position. The platen holder 12 is constantly elastically urged to remain in the stand-by position by a spiral spring that is not shown in the figures.

Figure 3:
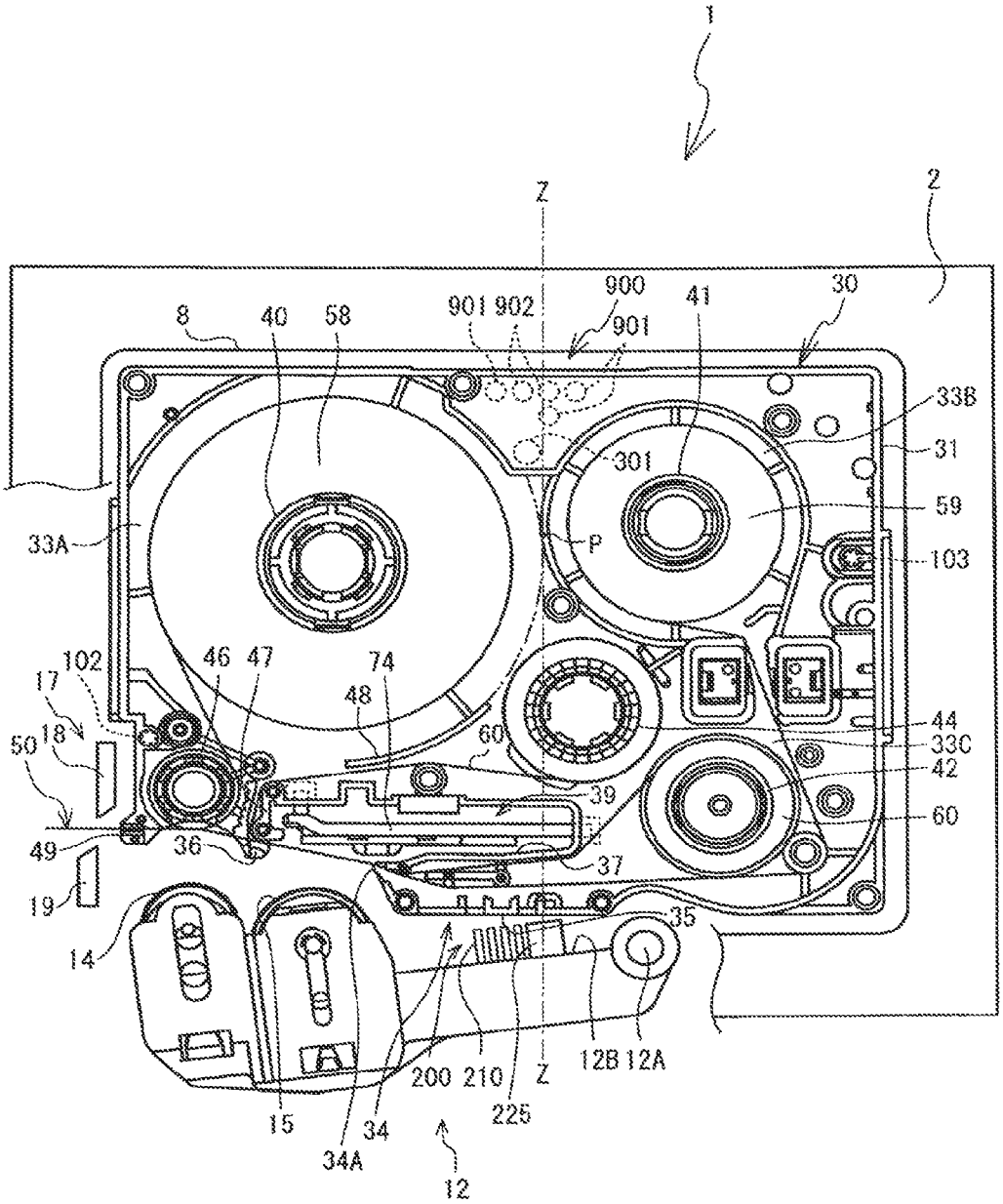
FIG. 3 is a plan view of the cassette housing portion 8 with a laminated type tape cassette 30 installed, when a platen holder 12 is at a standby position.
Figure 4:
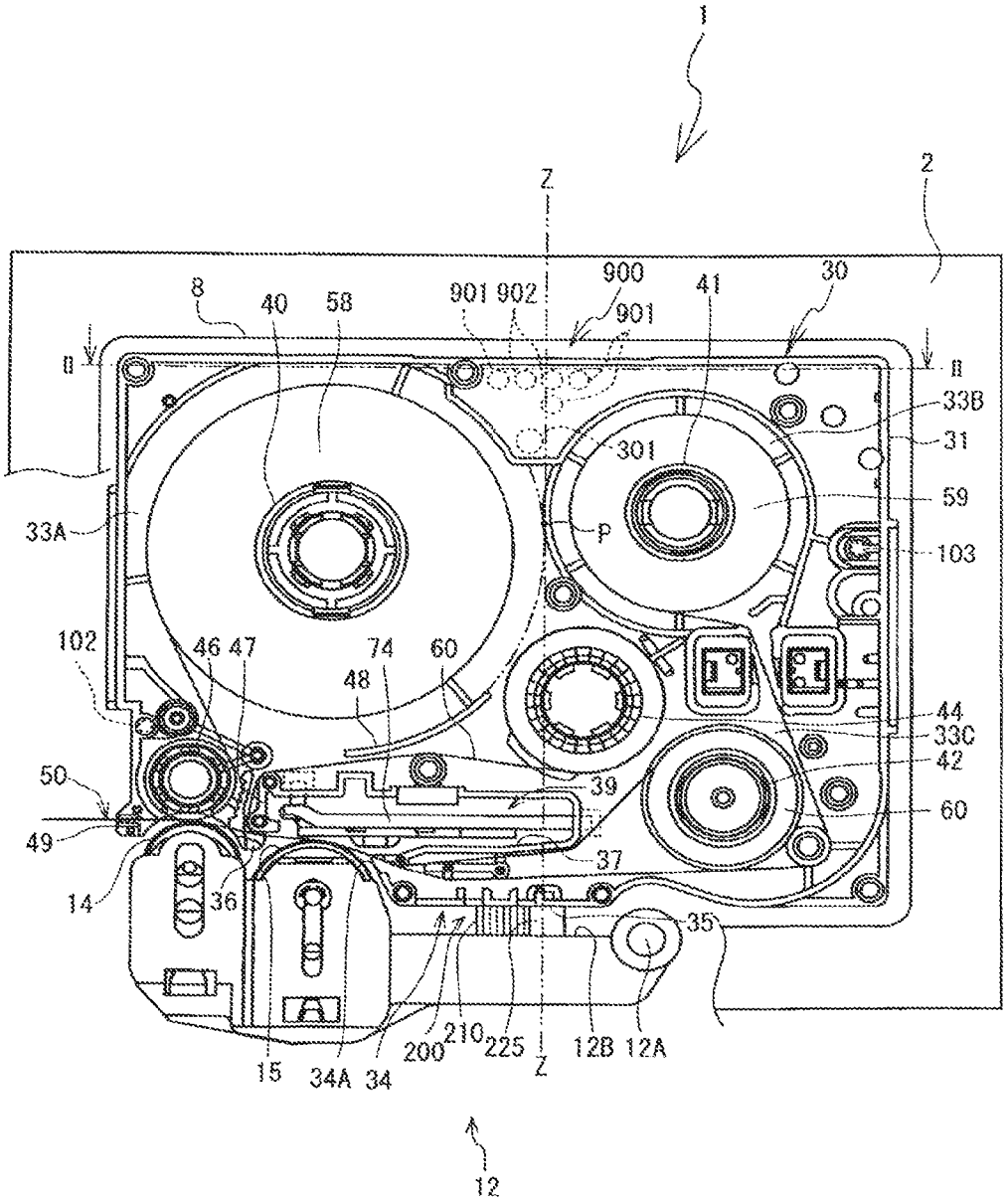
FIG. 4 is a plan view of the cassette housing portion 8 with the laminated type tape cassette 30 installed, when the platen holder 12 is at a print position.
Figure 5:
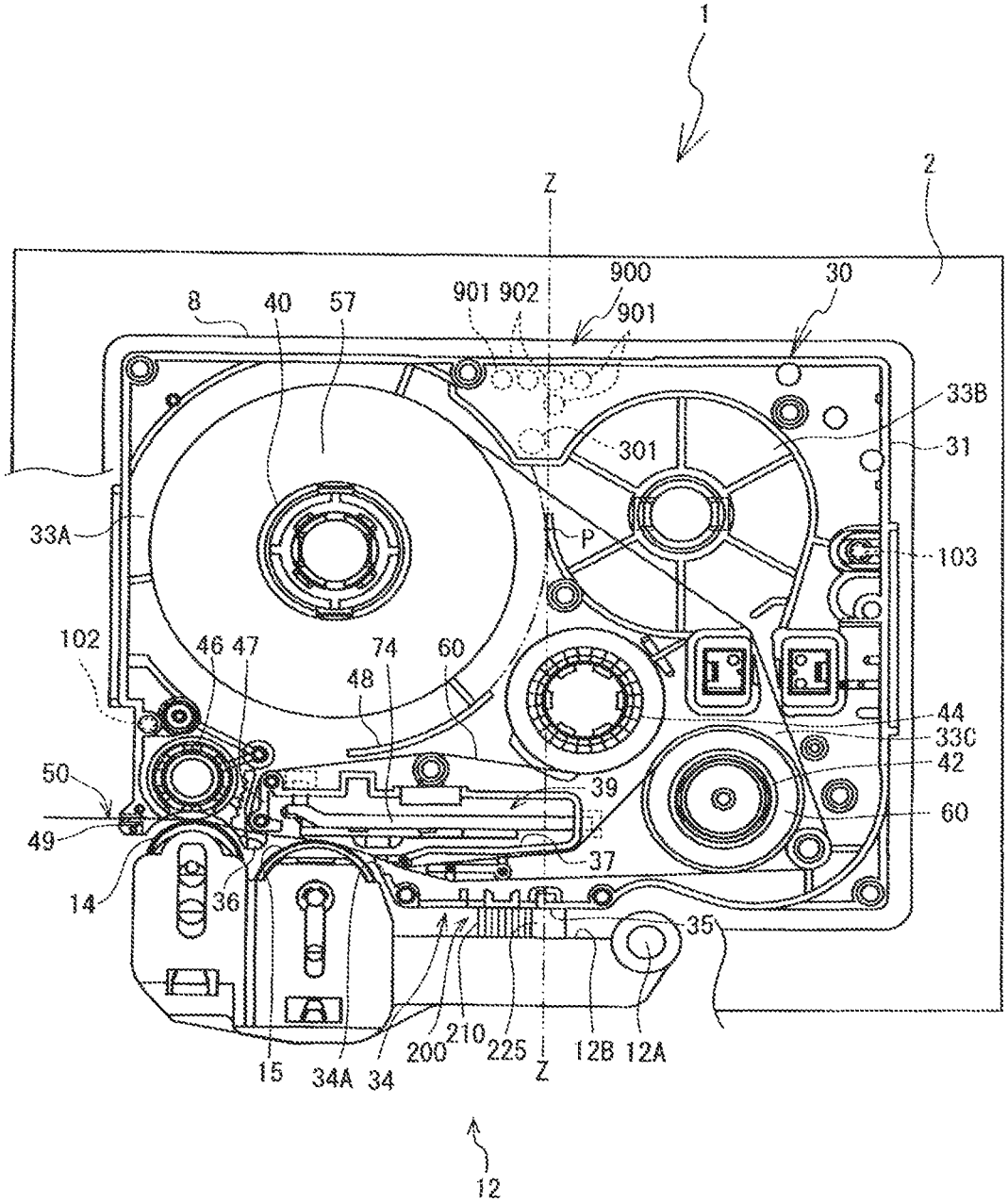
FIG. 5 is a plan view of the cassette housing portion 8 with a receptor type tape cassette 30 installed, when the platen holder 12 is at the print position.
Figure 6:
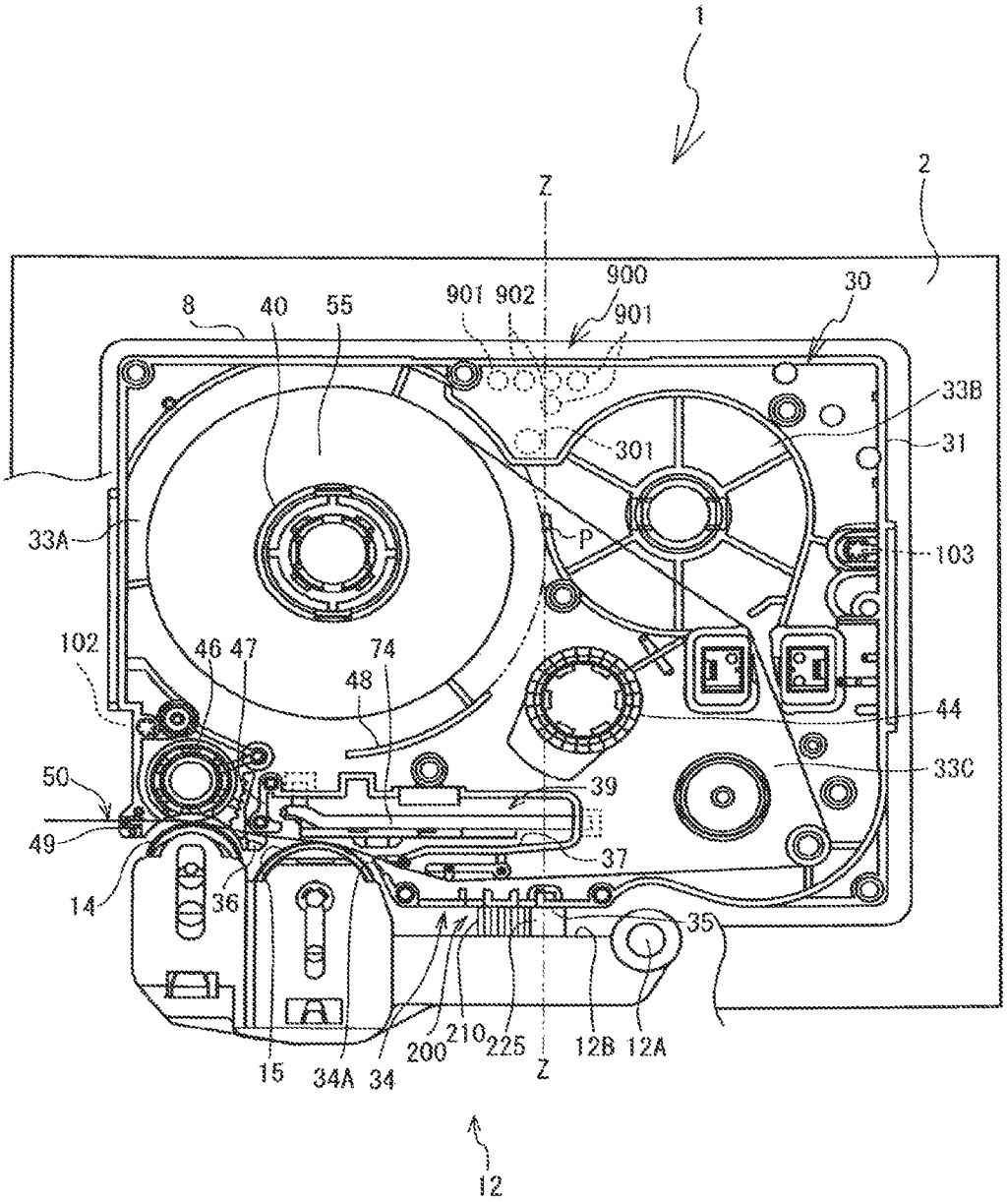
FIG. 6 is a plan view of the cassette housing portion 8 with a thermal type tape cassette 30 installed, when the platen holder 12 is at the print position.

On the other hand, when the cassette cover 6 is closed, the release lever moves in the left direction and the platen holder 12 moves toward the print position shown in FIG. 4 to FIG. 6. At the print position shown in FIG. 4 to FIG. 6, the platen holder 12 has moved close to the cassette housing portion 8. As shown in FIG. 3 and FIG. 4, when the laminated type tape cassette 30 is installed in the cassette housing portion 8, the platen roller 15 presses the thermal head 10 via a film tape 59 and an ink ribbon 60. At the same time, the movable feed roller 14 presses the tape drive roller 46 via a double-sided adhesive tape 58 and the film tape 59.

In a similar way, as shown in FIG. 5, when the receptor type tape cassette 30 is installed in the cassette housing portion 8, the platen roller 15 presses the thermal head 10 via a print tape 57 and the ink ribbon 60, while the movable feed roller 14 presses the tape drive roller 46 via the print tape 57. Further, as shown in FIG. 6, when the thermal type tape cassette 30 is installed in the cassette housing portion 8, the platen roller 15 presses the thermal head 10 via a heat-sensitive paper tape 55, while the movable feed roller 14 presses the tape drive roller 46 via the heat-sensitive paper tape 55.

As described above, at the print position shown in FIG. 4 to FIG. 6, printing can be performed using the tape cassette 30 installed in the cassette housing portion 8. The heat-sensitive paper tape 55, the print tape 57, the double-sided adhesive tape 58, the film tape 59 and the ink ribbon 60 will be explained in more detail later.

As shown in FIG. 3, a feed path along which a printed tape 50 is fed extends from a tape discharge portion 49 of the tape cassette 30 to a discharge slit (not shown in the figures) of the tape printer 1. A cutting mechanism 17 that cuts the printed tape 50 at a predetermined position is provided on the feed path. The cutting mechanism 17 includes a fixed blade 18 and a movable blade 19 that opposes the fixed blade 18 and that is supported such that it can move in the back-and-forth direction (in the up-and-down direction in FIG. 3 to FIG. 6). The movable blade 19 is moved in the back-and-forth direction by a cutter motor 24 (refer to FIG. 9).

As shown in FIG. 3 to FIG. 6, an arm detection portion 200 is provided on the rear side surface of the platen holder 12, namely, a surface on the side that opposes the thermal head 10 (hereinafter referred to as a cassette-facing surface 12B). The arm detection portion 200 is provided slightly to the right of a center position in the longitudinal direction of the cassette-facing surface 12B. The arm detection portion 200 includes a plurality of detecting switches 210. Switch terminals 222 (refer to FIG. 15) of the detecting switches 210 respectively protrude to the rear such that the detecting switches 210 oppose the front wall (more specifically, an arm front wall 35 which will be described later) of the tape cassette 30 installed in the cassette housing portion 8.

In a similar way to the above-described switch terminal 322, when the switch terminal 222 of each of the detecting switches 210 is not pressed, it is extended to be in an off state, and when the switch terminal 222 is pressed, it is pushed back to be in an on state. Note that, hereinafter, the detecting switches 210 provided in the arm detection portion 200 are referred to as the arm detecting switches 210.

Figure 8:
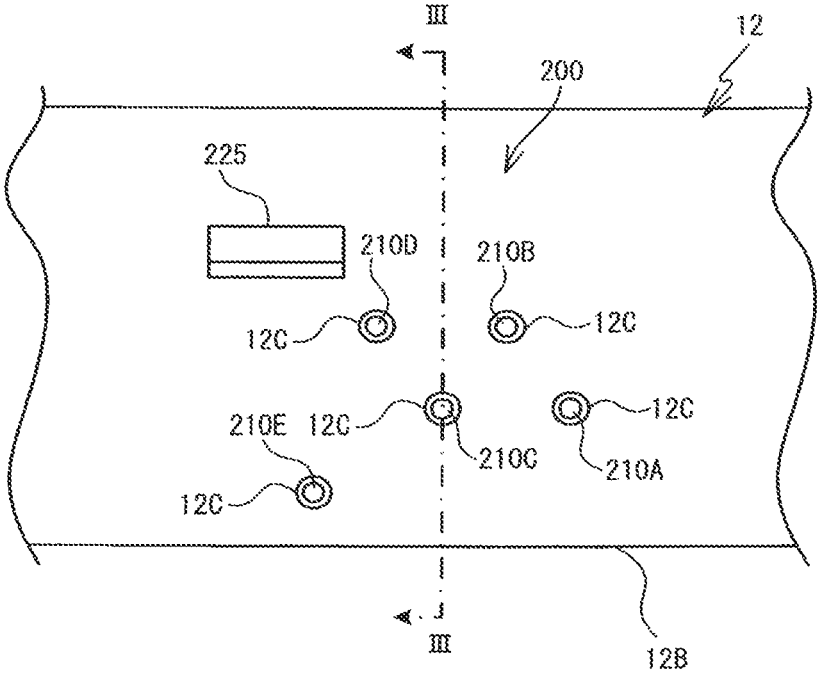
FIG. 8 is a partial enlarged view of a cassette-facing surface 12B on which is provided an arm detection portion 200.

As shown in FIG. 8, in the present embodiment, five through-holes 12C are formed in three rows in the vertical direction in the cassette-facing surface 12B of the platen holder 12. More specifically, the through-holes 12C are arranged such that two holes are arranged in an upper row, two holes are arranged in a middle row and one hole is arranged in a lower row. Positions of the through-holes 12C are different from each other in the left-and-right direction. Specifically, the five through-holes 12C are arranged in a zigzag pattern from the left side of the cassette-facing surface 12B (the right side in FIG. 8), in the following order: the left side of the middle row, the left side of the upper row, the right side of the middle row, the right side of the upper row, and then the lower row. The five arm detecting switches 210 are provided from the left side of the cassette-facing surface 12B in the order 210A, 210B, 210C, 210D, and 210E, at positions corresponding to the five through-holes 12C. The arm detecting switches 210A to 210E are each positioned at a height facing an arm indicator portion 800 (to be described later), in a state where the tape cassette 30 is installed in the cassette housing portion 8 at the proper position.

If the platen holder 12 moves toward the stand-by position (refer to FIG. 3) in a state where the tape cassette 30 is installed in the cassette housing portion 8, the arm detecting switches 210 are separated from the tape cassette 30. Consequently, all the arm detecting switches 210 are in the off state. On the other hand, if the platen holder 12 moves toward the print position (refer to FIG. 4 to FIG. 6), the arm detecting switches 210 oppose the front wall (more specifically, the arm front wall 35 that will be described later) of the tape cassette 30, and the arm detecting switches 210 are selectively pressed by the arm indicator portion 800, which will be described later. The tape type is detected based on a combination of the on and off states of the arm detecting switches 210, as will be described in more detail later.

Further, as shown in FIG. 3 to FIG. 6, a latching piece 225 is provided on the cassette-facing surface 12B of the platen holder 12. The latching piece 225 is a plate-like protrusion that extends in the left-and-right direction. In a similar way to the switch terminals 222 of the arm detecting switches 210, the latching piece 225 protrudes from the cassette-facing surface 12B in a generally horizontal manner toward the cassette housing portion 8. In other words, the latching piece 225 protrudes such that the latching piece 225 opposes the front wall (more specifically, the arm front wall 35) of the tape cassette 30 installed in the cassette housing portion 8. When the tape cassette 30 is installed in the cassette housing portion 8 at the proper position, the latching piece 225 is positioned at a height facing a latching hole 820 (refer to FIG. 2) formed in the arm front wall 35 of the tape cassette 30.

Figure 9:
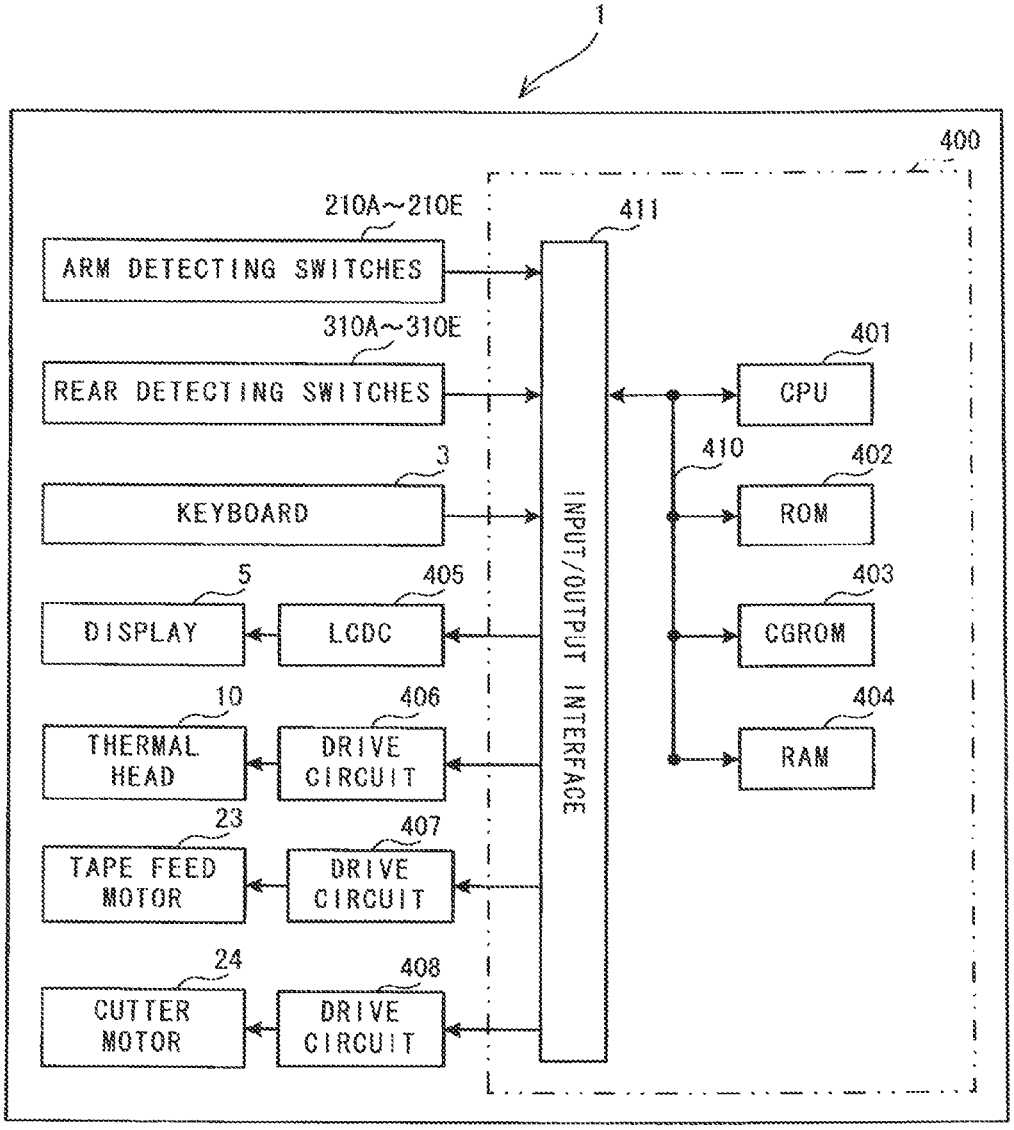
FIG. 9 is a block diagram showing an electrical configuration of the tape printer 1.

Next, the electrical configuration of the tape printer 1 will be explained with reference to FIG. 9. As shown in FIG. 9, the tape printer 1 includes a control circuit 400 formed on a control board. The control circuit 400 includes a CPU 401 that controls each instrument, a ROM 402, a CGROM 403, a RAM 404, and an input/output interface 411, all of which are connected to the CPU 401 via a data bus 410.

The ROM 402 stores various programs to control the tape printer 1, including a display drive control program, a print drive control program, a pulse number determination program, a cutting drive control program, and so on. The display drive control program controls a liquid crystal drive circuit (LCDC) 405 in association with code data of characters, such as letters, numerals and so on input from the keyboard 3. The print drive control program drives the thermal head 10 and the tape feed motor 23. The pulse number determination program determines the number of pulses to be applied corresponding to the amount of formation energy for each print dot. The cutting drive control program drives the cutter motor 24 to cut the printed tape 50 at a predetermined cutting position. The CPU 401 performs a variety of computations in accordance with each type of program. Note that the ROM 402 also stores various tables that are used to identify the tape type of the tape cassette 30 installed in the tape printer 1. The tables will be explained in more detail later.

The CGROM 403 stores print dot pattern data to be used to print various characters. The print dot pattern data is associated with corresponding code data for the characters. The print dot pattern data is categorized by font (Gothic, Mincho, and so on), and the stored data for each font includes six print character sizes (dot sizes of 16, 24, 32, 48, 64 and 96, for example).

The RAM 404 includes a plurality of storage areas, including a text memory, a print buffer and so on. The text memory stores text data input from the keyboard 3. The print buffer stores dot pattern data, including the printing dot patterns for characters and the number of pulses to be applied that is the amount of formation energy for each dot, and so on. The thermal head 10 performs dot printing in accordance with the dot pattern data stored in the print buffer. Other storage areas store data obtained in various computations and so on.

The input/output interface 411 is connected, respectively, to the arm detecting switches 210A to 210E, the rear detecting switches 310A to 310E, the keyboard 3, the liquid crystal drive circuit (LCDC) 405 that has a video RAM (not shown in the figures) to output display data to the display (LCD) 5, a drive circuit 406 that drives the thermal head 10, a drive circuit 407 that drives the tape feed motor 23, a drive circuit 408 that drives the cutter motor 24, and so on.

The configuration of the tape cassette 30 according to the present embodiment will be explained below with reference to FIG. 2 to FIG. 6 and FIG. 10 to FIG. 16. Hereinafter, the tape cassette 30 configured as a general purpose cassette will be explained as an example. As the general purpose cassette, the tape cassette 30 may be assembled as the thermal type, the receptor type and the laminated type that have been explained above, by changing, as appropriate, the type of the tape to be mounted in the tape cassette 30 and by changing the presence or absence of the ink ribbon, and so on.

FIG. 2 to FIG. 4 and FIG. 10 to FIG. 14 are figures relating to the tape cassette 30 in which a width of the tape is 36 mm, which is equal to or greater than a predetermined width (18 mm, for example). The tape cassette 30 represented in FIG. 2 to FIG. 4 and FIG. 10 to FIG. 14 is assembled as the laminated type cassette in which the double-sided adhesive tape 58 with a white base material, and the ink ribbon 60 with a black ink color are mounted.

Figure 10:
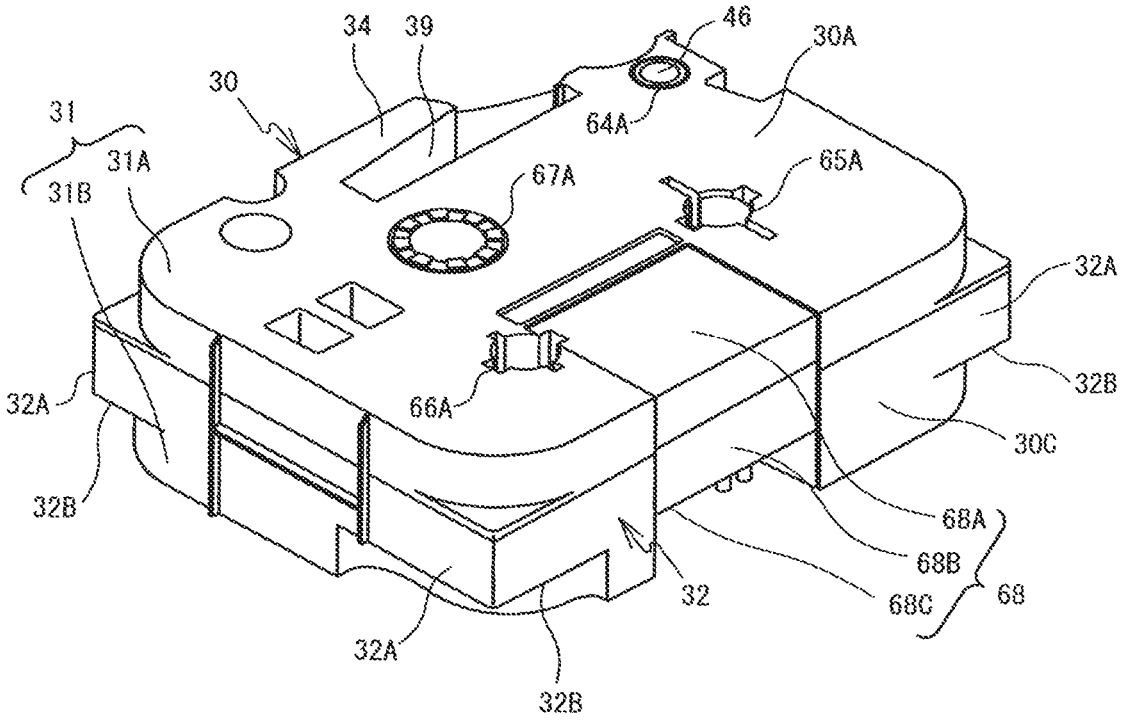
FIG. 10 is an external perspective view of the tape cassette 30 as seen from a top surface side.

As shown in FIG. 2 and FIG. 10, the tape cassette 30 includes a cassette case 31 that is a housing having a generally rectangular parallelepiped shape (box-like shape), with rounded corner portions in a plan view. The cassette case 31 includes a bottom case 31B and a top case 31A. The bottom case 31B includes a bottom wall 30B that forms the bottom surface of the cassette case 31. The top case 31A includes a top wall 30A that forms the top surface of the cassette case 31. The top case 31A is fixed to an upper portion of the bottom case 31B.

When the top case 31A and the bottom case 31B are joined, a side wall 30C of a predetermined height is formed. The side wall 30C extends between the top wall 30A and the bottom wall 30B along the peripheries of the top wall 30A and the bottom wall 30B. In other words, the cassette case 31 is a box-shaped case that has the top wall 30A and the bottom wall 30B, which are a pair of rectangular flat portions opposing each other in a vertical direction, and the side wall 30C (in the present embodiment, including four side walls of a front wall, a rear wall, a left side wall and a right side wall) that has a predetermined height and extends along the peripheries of the top wall 30A and the bottom wall 30B.

In the cassette case 31, the peripheries of the top wall 30A and the bottom wall 30B may not be entirely surrounded by the side wall 30C. A part of the side wall 30C (the rear wall, for example) may have an aperture that exposes the interior of the cassette case 31 to the outside. Further, a boss that connects the top wall 30A and the bottom wall 30B may be provided in a position facing the aperture. In the explanation below, the distance from the bottom surface to the top surface (the length in the vertical direction) is referred to as the height of the tape cassette 30 or the height of the cassette case 31. In the present embodiment, the vertical direction of the cassette case 31 (namely, the direction in which the top wall 30A and the bottom wall 30B oppose each other) generally corresponds to the direction of installation and removal of the tape cassette 30.

The cassette case 31 has the corner portions 32A that have the same width (the same length in the vertical direction), regardless of the type of the tape cassette 30. The corner portions 32A each protrude in an outward direction to form a right angle when seen in a plan view. However, the front left corner portion 32A does not form a right angle in the plan view, as the tape discharge portion 49 is provided in the corner. When the tape cassette 30 is installed in the cassette housing portion 8, the lower surface of the corner portions 32A opposes the above-described cassette support portion 8B inside the cassette housing portion 8.

The cassette case 31 includes a portion that is called the common portion 32. The common portion 32 includes the corner portions 32A and encircles the cassette case 31 along the side wall 30C at the same position as the corner portions 32A in the vertical (height) direction of the cassette case 31 and also has the same width as the corner portions 32A. More specifically, the common portion 32 is a portion that has a symmetrical shape in the vertical direction with respect to a center line in the vertical (height) direction of the cassette case 31.

The height of the tape cassette 30 differs depending on the width of the tape (the heat-sensitive paper tape 55, the print tape 57, the double-sided adhesive tape 58, the film tape 59 and so on) mounted in the cassette case 31. The height of the common portion 32, however, is set to be the same, regardless of the width of the tape of the tape cassette 30. For example, when the width of the common portion 32 is 12 mm, as the width of the tape of the tape cassette 30 is larger (18 mm, 24 mm, 36 mm, for example), the height of the cassette case 31 becomes accordingly larger, but the width of the common portion 32 remains constant.

Figure 11:
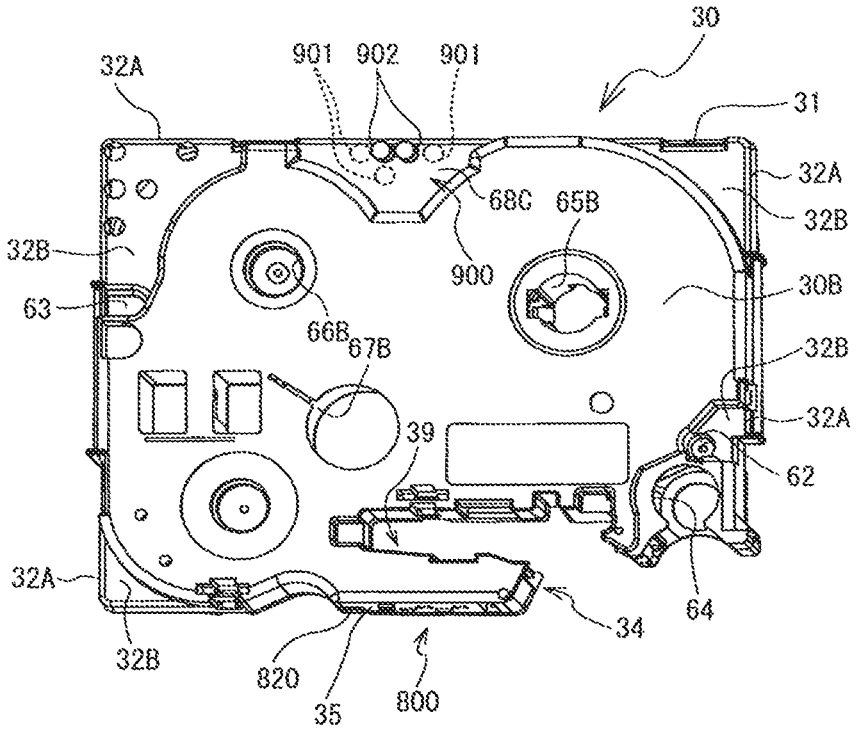
FIG. 11 is an external perspective view of the tape cassette 30 as seen from a bottom surface side.

As shown in FIG. 2, FIG. 10 and FIG. 11, the top case 31A and the bottom case 31B respectively have support holes 65A, 66A and 67A and support holes 65B, 66B and 67B that rotatably support a first tape spool 40, a second tape spool 41 and the ribbon take-up spool 44, respectively, which will be explained later. The support holes 65A and 65B are communicated with a first tape housing area 33A (refer to FIG. 3 to FIG. 6) at a substantially center position of the first tape housing area 33A when seen in a plan view. The first tape housing area 33A is provided in a left side area inside the cassette case 31. The support holes 66A and 66B are communicated with a second tape housing area 33B (refer to FIG. 3 to FIG. 6) at a substantially center position of the second tape housing area 33B when seen in a plan view. The second tape housing area 33B is provided in a right side area inside the cassette case 31.

The first tape housing area 33A has a generally circular shape in a plan view that corresponds to the tape wound on the first tape spool 40 (the double-sided adhesive tape 58 in FIG. 3 and FIG. 4). The second tape housing area 33B has a generally circular shape in a plan view that corresponds to the tape wound on the second tape spool 41 (the film tape 59 in FIG. 3 and FIG. 4). The first and second tape housing areas 33A and 33B are provided in the cassette case 31 whose longitudinal direction is the left-and-right direction, and lined up with each other in the left-and-right direction such that their outer edges are adjoined to each other in a plan view. Further, the front right portion in the cassette case 31 is provided with an ink ribbon housing area 33C that is positioned to the front of the first and second tape housing areas 33A and 33B.

In the laminated type tape cassette 30 shown in FIG. 3 and FIG. 4, the double-sided adhesive tape 58 wound on the first tape spool 40, the film tape 59 wound on the second tape spool 41 and the ink ribbon 60 wound on a ribbon spool 42 are mounted in the cassette case 31. The first tape spool 40, on which the double-sided adhesive tape 58 is wound with its release paper facing outward, is rotatably mounted in the first tape housing area 33A via the support holes 65A and 65B. The second tape spool 41, on which the film tape 59 is wound, is rotatably mounted in the second tape housing area 33B via the support holes 66A and 66B. The ink ribbon 60 that is wound on the ribbon spool 42 is rotatably arranged in the ink ribbon housing area 33C.

Between the first tape spool 40 and the ribbon spool 42 in the cassette case 31, the ribbon take-up spool 44 is rotatably supported by the support holes 67A and 67B. The ribbon take-up spool 44 pulls out the ink ribbon 60 from the ribbon spool 42 and takes up the ink ribbon 60 that has been used to print characters. A clutch spring (not shown in the figures) is attached to a lower portion of the ribbon take-up spool 44 to prevent loosening of the taken up ink ribbon 60 due to reverse rotation of the ribbon take-up spool 44.

In the receptor type tape cassette 30 shown in FIG. 5, the print tape 57 wound on the first tape spool 40 and the ink ribbon 60 wound on the ribbon spool 42 are mounted in the cassette case 31. The receptor type tape cassette 30 does not include the second tape spool 41.

In the thermal type tape cassette 30 shown in FIG. 6, the heat-sensitive paper tape 55 wound on the first tape spool 40 is mounted in the cassette case 31. The thermal type tape cassette 30 does not include the second tape spool 41 and the ribbon spool 42.

As shown in FIG. 2, a semi-circular groove 34K that has a semi-circular shape in a plan view is provided in the front wall of the cassette case 31, and extends over the height of the cassette case 31 (in other words, extends from the top surface to the bottom surface). Of the front wall of the cassette case 31, a section that stretches leftwards from the semi-circular groove 34K is referred to as the arm front wall 35. A portion that is defined by the arm front wall 35 and an arm rear wall 37 and that extends leftwards from the front right portion of the tape cassette 30 is referred to as an arm portion 34. The arm rear wall 37 is a wall separately provided at the rear of the arm front wall 35 and extends over the height of the cassette case 31.

Figure 12:
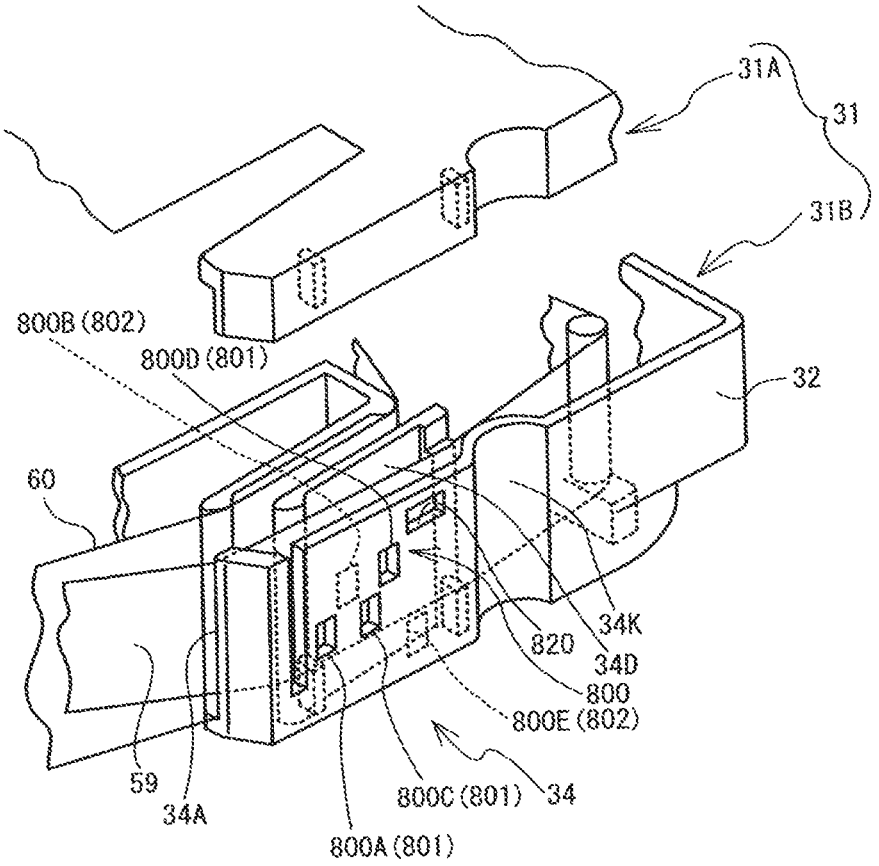
FIG. 12 is an enlarged and exploded perspective view of an arm portion 34 of the tape cassette 30.

As shown in FIG. 12, a tape feed path, along which the film tape 59 is fed, and a ribbon feed path, along which the ink ribbon 60 is fed, are formed as different feed paths separated by a separating wall 34D inside the arm portion 34. After the film tape 59 and the ink ribbon 60 are respectively guided and fed along the feed paths, the film tape 59 and the ink ribbon 60 are joined together at an exit 34A of the arm portion 34, and are discharged from the exit 34A toward a head insertion portion 39.

Although FIG. 12 shows an example of the laminated type tape cassette 30 (refer to FIG. 3 and FIG. 4), the arm portion 34 of the other types of tape cassettes 30 is similar. In the receptor type tape cassette 30 (refer to FIG. 5), the print tape 57 is guided and fed along the tape feed path, while the ink ribbon 60 is guided and fed along the ribbon feed path. In the thermal type tape cassette 30 (refer to FIG. 6), the heat-sensitive paper tape 55 is guided and fed along the tape feed path, while the ribbon feed path is not used.

When the platen holder 12 moves to the print position (refer to FIG. 4 to FIG. 6) in a state where the tape cassette 30 is installed in the cassette housing portion 8, the arm detection portion 200 and the latching piece 225 provided on the cassette-facing surface 12B oppose the arm front wall 35. As shown in FIG. 2 and FIG. 12, the arm front wall 35 is provided with the arm indicator portion 800 and the latching hole 820. The arm indicator portion 800 allows the tape printer 1 to detect the tape type, by selectively pressing the arm detecting switches 210. The latching hole 820 is a hole into which the latching piece 225 is inserted.

The arm indicator portion 800 includes a plurality of indicators. Each of the indicators is formed as one of the non-pressing portion 801 and the pressing portion 802 and provided at a position corresponding to each of the arm detecting switches 210. Specifically, the arm indicator portion 800 includes a combination of the non-pressing portion(s) 801 and the pressing portion(s) 802 arranged in a pattern that corresponds to print information. The print information, among the tape types of the tape cassette 30, is essential to perform correct printing in the tape printer 1. In the present embodiment, the arm indicator portion 800 includes five indicators 800A to 800E, each of which is formed as either the non-pressing portion 801 or the pressing portion 802, arranged at positions that respectively oppose the five arm detecting switches 210A to 210E when the tape cassette 30 is installed in the cassette housing portion 8.

The non-pressing portion 801 is a switch hole that has an upright rectangular shape in a front view. The switch terminal 222 (refer to FIG. 17) of each of the arm detecting switches 210 can be inserted into and removed from the switch hole. The arm detecting switch 210 that opposes the non-pressing portion 801 remains in the off state, because the switch terminal 222 is inserted into the non-pressing portion 801. The pressing portion 802 is a surface portion that does not allow the insertion of the switch terminal 222. The arm detecting switch 210 that opposes the pressing portion 802 is changed to the on state, because the switch terminal 222 contacts with the pressing portion 802.

The latching hole 820 is a slit-like through-hole that extends in the left-and-right direction on the upper right side of the arm indicator portion 800. The latching hole 820 is arranged to oppose the latching piece 225 (refer to FIG. 8) such that the latching piece 225 can be inserted into and removed from the latching hole 820 when the tape cassette 30 is installed in the cassette housing portion 8.

As shown in FIG. 2 to FIG. 6, the head insertion portion 39 is a space that has a generally rectangular shape in a plan view and that extends through the tape cassette 30 in the vertical direction. The head insertion portion 39 is surrounded by the arm rear wall 37 and a peripheral wall that is provided continuously from the arm rear wall 37. The head holder 74 that supports the thermal head 10 of the tape printer 1 is inserted into the head insertion portion 39, and the thermal head 10 performs printing on the tape (one of the heat-sensitive paper tape 55, the print tape 57 and the film tape 59) discharged from the exit 34A of the arm portion 34.

Further, a support hole 64 (refer to FIG. 11) is provided on the downstream side of the head insertion portion 39, in the tape feed direction from the exit 34A of the arm portion 34 to the tape discharge portion 49. The tape drive roller 46 is rotatably supported inside the support hole 64. In a case where the laminated type tape cassette 30 shown in FIG. 3 and FIG. 4 is installed in the cassette housing portion 8, the tape drive roller 46, by moving in concert with the opposing movable feed roller 14, pulls out the film tape 59 from the second tape spool 41. At the same time, the tape drive roller 46 pulls out the double-sided adhesive tape 58 from the first tape spool 40, then guides the double-sided adhesive tape 58 to the print surface of the film tape 59 to bond them together.

A pair of regulating members 36 that match in the vertical direction are provided on the upstream side of the tape drive roller 46. The base portions of the regulating members 36 regulate the printed film tape 59 in the vertical direction (in the tape width direction) on the downstream side of the thermal head 10, and direct the printed film tape 59 toward the tape discharge portion 49. The regulating members 36 regulate the film tape 59 such that it can be boned to the double-sided adhesive tape 58 appropriately without making any positional displacement.

A guide wall 47 is standing in the vicinity of the regulating members 36. The guide wall 47 serves to separate the used ink ribbon 60 that has been fed via the head insertion portion 39 from the film tape 59, and guides the used ink ribbon 60 toward the ribbon take-up spool 44. A separating wall 48 is standing between the guide wall 47 and the ribbon take-up spool 44. The separating wall 48 prevents mutual contact between the used ink ribbon 60 that is guided along the guide wall 47 and the double-sided adhesive tape 58 that is wound on and supported by the first tape spool 40.

In a case where the receptor type tape cassette 30 shown in FIG. 5 is installed in the cassette housing portion 8, the print tape 57 is pulled out from the first tape spool 40 by the tape drive roller 46 moving in concert with the movable feed roller 14. On the downstream side of the thermal head 10, the printed print tape 57 is regulated in the vertical direction (in the tape width direction) by the base portions of the regulating members 36, and is guided toward the tape discharge portion 49. In addition, the used ink ribbon 60 that has been fed via the head insertion portion 39 is separated from the print tape 57 by the guide wall 47, and guided toward the ribbon take-up spool 44.

In a case where the thermal type tape cassette 30 shown in FIG. 6 is installed, the heat-sensitive paper tape 55 is pulled out from the first tape spool 40 by the tape drive roller 46 moving in concert with the movable feed roller 14. On the downstream side of the thermal head 10, the printed heat-sensitive paper tape 55 is regulated in the vertical direction (in the tape width direction) by the base portions of the regulating members 36, and guided toward the tape discharge portion 49.

As shown in FIG. 11, the pin holes 62 and 63 are provided at two positions on the lower surface of the corner portions 32A, corresponding to the above-described positioning pins 102 and 103 of the tape printer 1. More specifically, the pin hole 62, into which the positioning pin 102 is inserted, is an indentation provided in the lower surface of the corner portion 32A to the rear (the upper side in FIG. 11) of the support hole 64 that is provided in the left front portion of the cassette case 31 (the lower right side in FIG. 11). The pin hole 63, into which the positioning pin 103 is inserted, is an indentation provided in the lower surface of the corner portion 32A in the vicinity of a central portion of the right end of the cassette case 31 (the left side in FIG. 11). Note that the tape drive roller 46 and some other components are not shown in FIG. 11.

A distance in the vertical (height) direction of the tape cassette 30 between the position of the pin holes 62 and 63 and a center position in the vertical direction of the film tape 59 that is the print medium housed in the cassette case 31 is constant, regardless of the tape type (the tape width, for example) of the tape cassette 30. In other words, the distance remains constant even when the height of the tape cassette 30 is different.

As shown in FIG. 2 and FIG. 10, a top surface affixing portion 68A, a rear surface affixing portion 68B and the rear indentation 68C are provided on a rear surface 68 of the cassette case 31. The top surface affixing portion 68A is provided in a rear portion of the top wall 30A, and has a rectangular shape in a plan view. The back surface affixing portion 68B is provided along the vertical direction of the side wall 30C, and has a rectangular shape in a rear view. The rear indentation 68C is provided in a rear portion of the bottom wall 30B, and has a generally triangular shape in a bottom view. The top surface affixing portion 68A, the back surface affixing portion 68B and the rear indentation 68C have the same width, and are provided at a substantially center position in the left-and-right direction in a rear portion of the cassette case 31. The top surface affixing portion 68A, the back surface affixing portion 68B and the rear indentation 68C form an area that extend continuously over three surfaces of the top wall 30A, the side wall 30C and the bottom wall 30B.

The top surface affixing portion 68A and the back surface affixing portion 68B are parts onto which a label sheet (not shown in the figures) to indicate the tape type etc. of the tape cassette 30 is affixed over two surfaces of the top wall 30A and the side wall 30C (specifically, a rear wall). The rear indentation 68C is a stepped portion that is formed between the first tape housing area 33A and the second tape housing area 33B (refer to FIG. 3 to FIG. 6 and FIG. 14) in the rear portion of the cassette case 31. In other words, the rear indentation 68C is provided between a rear wall 31C (refer to FIG. 13 and FIG. 14) and the first and second tape housing areas 33A and 33B. The rear wall 31C is a wall portion forming the rear surface, of the side wall 30C of the tape cassette 30.

As shown in FIG. 10 and FIG. 11, the rear indentation 68C is a flat portion that is upwardly indented in the bottom wall 30B, and has a shape that substantially matches the shape of the rear support portion 8C shown in FIG. 2. The rear indentation 68C is located at a slightly higher position than the lower surface 32B of the corner portions 32A. As described earlier, the common portion 32 is formed symmetrically in the vertical direction with respect to the center line in the vertical (height) direction of the cassette case 31, and the height T of the common portion 32 is set to be the same, regardless of the width of the tape of the tape cassette 30. Therefore, similarly to the common portion 32, the distance from the center line in the vertical (height) direction of the cassette case 31 to the rear indentation 68C is the same, regardless of the width of the tape of the tape cassette 30.

More specifically, the bottom surface formed by the bottom wall 30B includes the lower surface 32B and the rear indentation 68C, in addition to a lower end surface portion. The lower end surface portion is a flat portion that is located at the lower end of the cassette case 31 and occupies a major part of the bottom surface. The lower surface 32B and the rear indentation 68C are both flat portions extending parallel to the lower end surface portion. Of the bottom surface of the cassette case 31, the lower surface 32B is located at a higher position than the lower end surface portion, and the rear indentation 68C is located at a higher position than the lower surface 32B. In other words, these surface portions are located at different height positions. As described above, the lower surface 32B and the rear indentation 68C are respectively located at fixed positions in the vertical (height) direction of the cassette case 31, regardless of the tape width of the tape cassette 30.

When the tape cassette 30 is installed in the cassette housing portion 8 at a proper position, the rear support pin 301 provided in the rear support portion 8C contacts with the rear indentation 68C, and the rear detection portion 300 opposes the rear indentation 68C. Therefore, the rear indentation 68C is provided with the rear indicator portion 900 that is a portion that makes it possible for a person to identify the tape type, and that also allows the tape printer 1 to detect the tape type by selectively pressing the rear detecting switches 310 (refer to FIG. 2 and FIG. 7).

A pair of corner portions adjacent to the first and second tape housing areas 33A and 33B on the rear edge side of the cassette case 31 is a pair of corner portions 32A. The corner portions 32A each include the lower surface 32B. The rear indicator portion 900 is provided in the rear indentation 68C that is located between the pair of corner portions 32A. Protrusions, which will be described later, protrude downward from the rear indentation 68C. With this configuration, the rear indicator portion 900 allows a person and the tape printer 1 to identify the tape type.

The structure and the function of the rear indentation 68C that includes the rear indicator portion 900 will be explained below in detail with reference to FIG. 13 and FIG. 14.

As described above, the tape cassette 30 according to the present embodiment is structured such that when a person looks at the tape cassette 30 alone in a state in which the tape cassette 30 is not installed in the tape printer 1, the person can identify the type of the tape by visually checking the rear indicator portion 900. In addition, the tape cassette 30 is structured such that when the tape cassette 30 is installed in the cassette housing portion 8 of the tape printer 1, the tape printer 1 can identify the type of the tape by the rear detection portion 300 detecting information indicated by the rear indicator portion 900. In the present embodiment, the tape type indicated by the rear indicator portion 900 is color information relating to the tape mounted in the tape cassette 30. First, an area included in the rear indentation 68C and the structure within the area will be explained.

Figure 13:
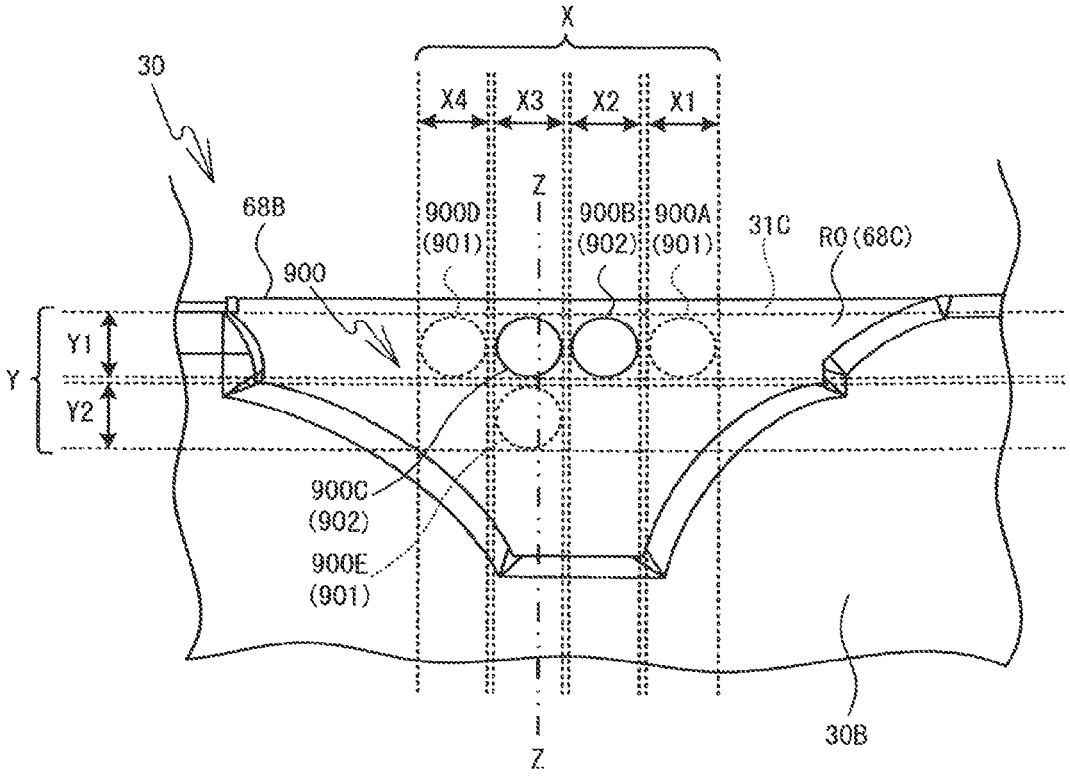
FIG. 13 is a bottom view of the tape cassette 30, in which a rear indentation 68C is enlarged.

As shown in FIG. 13, the rear indentation 68C includes a specified area RO. The specified area R0 is an area extending to the front from the rear wall 31C, which is the wall portion forming the rear surface, of the side surface 30C of the tape cassette 30. More specifically, the specified area R0 is an area adjoining the rear wall 31C in the rear indentation 68C. In the present embodiment, the entire rear indentation 68C is the specified area R0. The specified area R0 includes a plurality of vertical information sections X and a plurality of lateral information sections Y. The plurality of vertical information sections X is formed as a plurality of strip-shaped sections extending along a front-rear direction (the up-and-down direction in FIG. 13), which is a short side direction of the cassette case 31. The plurality of lateral information sections Y is formed as a plurality of strip-shaped sections extending along a left-and-right direction (the left-and-right direction in FIG. 13), which is a long side direction of the cassette case 31.

The vertical information sections X according to the present embodiment that are exemplified in FIG. 13 include four vertical information sections X1 to X4. The vertical information sections X1 to X4 are arranged at equal intervals in the left-and-right direction of the cassette case 31. Among the vertical information sections X1 to X4, the vertical information section X1 is positioned on the leftmost side (the right side in FIG. 13). The vertical information sections X2, X3 and X4 are arranged in that order from the vertical information section X1 toward the right side (the left side in FIG. 13). The widths (namely, the lengths in the left-and-right direction) of the vertical information sections X1 to X4 are approximately the same, and adjacent vertical information sections among the vertical information sections X1 to X4 are adjacent to each other at equal intervals.

The vertical information section X3 includes a part (i.e., a contact point P shown in FIG. 3 to FIG. 6) at which outer peripheral edges of the first and second tape housing areas 33A and 33B contact each other when seen in a plan view. In other words, the vertical information section X3 includes an imaginary line (hereinafter referred to as a reference line Z) that passes through the contact point P and that extends in the front-rear direction. In the vertical information section X3 according to the present embodiment, the reference line Z is positioned slightly to the left (to the right in FIG. 13) of a substantially center position in the left-and-right direction of the vertical information section X3.

The lateral information sections Y according to the present embodiment that are exemplified in FIG. 13 include two lateral information sections Y1 and Y2. The lateral information sections Y1 and Y2 are arranged in rows in the front-rear direction (the up-and-down direction in FIG. 13) of the cassette case 31. The lateral information section Y1 adjoins the rear wall 31C, in the specified area RO. The lateral information section Y2 is provided to the front (the lower side in FIG. 13) of the lateral information section Y1, in the specified area R0. The widths (namely, the lengths in the front-rear direction) of the lateral information sections Y1 and Y2 are approximately the same.

The specified area R0 is an area that opposes the rear detecting switches 310 of the tape printer 1 when the tape cassette 30 is installed in the cassette housing portion 8, and includes the rear indicator portion 900 that indicates the tape type (color information, in the present embodiment) of the tape cassette 30. At least one protrusion is formed in at least one of the lateral information sections Y1 and Y2. A pattern in which the at least one protrusion is formed in the lateral information sections Y1 and Y2 are determined in advance, according to the color information. The rear indicator portion 900 is a portion that indicates the color information by a combination of whether or not a protrusion is formed in each of the lateral information sections Y1 and Y2. A person can recognize the color information by visually checking the combination of the protrusion (s) formed in the lateral information sections Y1 and Y2 of the rear indicator portion 900.

The left-and-right direction positions of the protrusions formed in the lateral information sections Y1 and Y2 may be fixed for each of the lateral information sections Y1 and Y2. For example, among a plurality of areas where the lateral information sections Y1, Y2 and the vertical information sections X1 to X4 intersect and overlap with each other (hereinafter referred to as overlapping areas), at least one overlapping area in each of the lateral information sections Y1 and Y2 may be fixed as an indicator. In such a case, the color information may be identified based on a combination of whether or not the protrusion is formed in each of the indicators. If positions corresponding to the rear detecting switches 310 (refer to FIG. 2 and FIG. 7) of the tape printer 1 are determined as the indicators, the color information can be identified not only by human visual check but also by the tape printer 1.

Given this, in the present embodiment, five overlapping areas that respectively oppose the five rear detecting switches 310A to 310E shown in FIG. 2 and FIG. 7 when the tape cassette 30 is installed in the cassette housing portion 8 are fixed as indicators 900A to 900E. More specifically, as shown in FIG. 13, the area in which the lateral information section Y1 and the vertical information section X1 intersect and overlap with each other functions as the indicator 900A that opposes the rear detecting switch 310A. The area in which the lateral information section Y1 and the vertical information section X2 intersect and overlap with each other functions as the indicator 900B that opposes the rear detecting switch 310B. The area in which the lateral information section Y1 and the vertical information section X3 intersect and overlap with each other functions as the indicator 900C that opposes the rear detecting switch 310C. The area in which the lateral information section Y1 and the vertical information section X4 intersect and overlap with each other functions as the indicator 900D that opposes the rear detecting switch 310D. The area in which the lateral information section Y2 and the vertical information section X3 intersect and overlap with each other functions as the indicator 900E that opposes the rear detecting switch 310E.

In the example shown in FIG. 13, the protrusions are formed in the indicators 900B and 900C. On the other hand, the indicators 900A, 900D and 900E are surface portions that are in the same plane as the rear indentation 68C, and no protrusion is formed therein. In such a manner, each of the indicators 900A to 900E is formed as either a protrusion or a surface portion. The protrusion and the surface portion can be identified by human visual check. In addition, when the protrusion and the surface portion oppose the rear detecting switches 310, the protrusion and the surface portion respectively function as a pressing portion 902 that presses the rear detecting switch 310 and as a non-pressing portion 901 that does not press the rear detecting switch 310.

Thus, the protrusion and the surface portion allow the tape printer 1 to identify the color information. The relationship between the indicators 900A to 900E and the rear detecting switches 310 will be described later in detail.

In the present embodiment, one indicator is provided in each of the vertical information sections X1, X2 and X4, while a plurality of indicators are provided in the vertical information section X3. This is because the specified area R0 is the rear indentation 68C that has a generally triangular shape in a plan view and that is defined by the first and second tape housing areas 33A and 33B and the rear wall 31C, and the rear indentation 68C has the maximum length in the front-rear direction, on the above-described reference line Z. In other words, among the vertical information sections X1 to X4, the vertical information section X3 including the reference line Z has the maximum length in the front-rear direction. Accordingly, in a case where a plurality of indicators are arranged in rows in the front-rear direction in the rear indentation 68C, it may be most favorable to provide the plurality of indicators in the vertical information section X3, as described above.

With the above-described structure, in the tape cassette 30 according to the present embodiment, a person can easily recognize which of the lateral information sections Y1 and Y2, or which of the indicators 900A to 900E includes an indicator element (a protrusion or a surface portion). Hereinafter, this reason will be explained with reference to FIG. 13 and FIG. 14.

If a person can ascertain which of the respective lateral information sections Y1 and Y2 includes a protrusion by visually checking the rear indentation 68C, the person can identify the color information of the tape cassette 30 simply by visually checking the combination of the protrusions in the respective lateral information sections Y1 and Y2. The person may visually check the rear indentation 68C in either of the following two patterns. The first pattern is that the person looks at the tape cassette 30 in a plan view with the top case 31A removed, and visually checks the rear indentation 68C from above. The second pattern is that the person looks at the tape cassette 30 in a bottom view (from underneath), and visually checks the rear indentation 68C.

Figure 14:
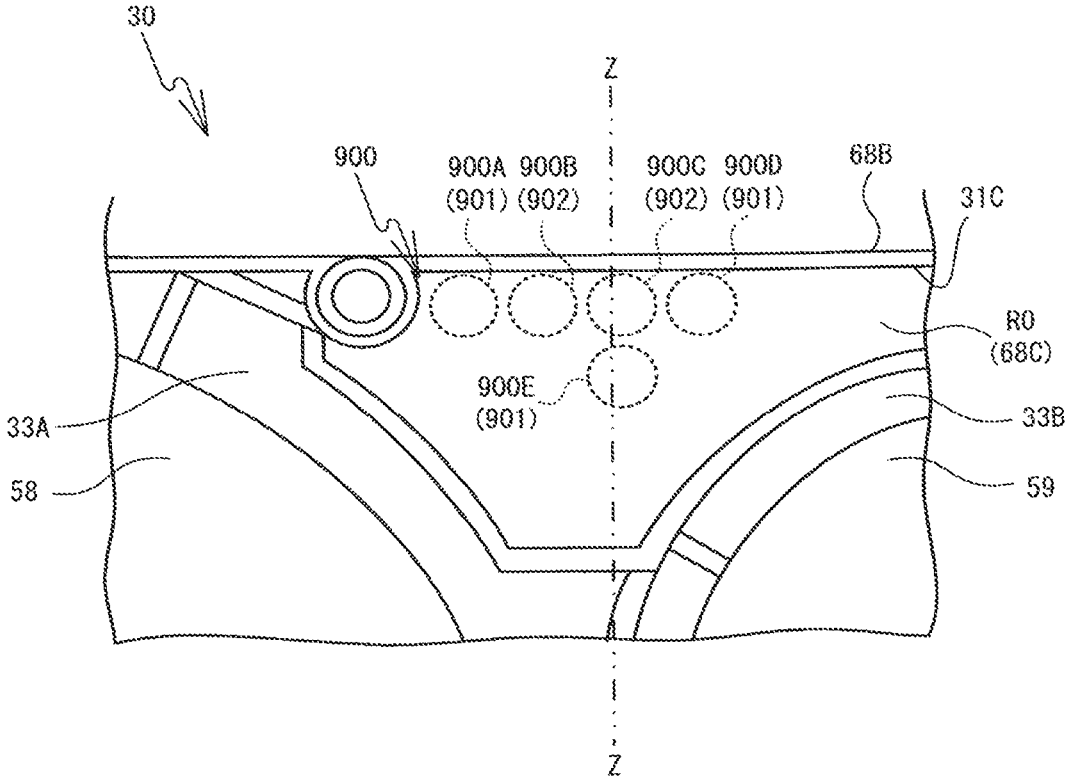
FIG. 14 is a plan view of the tape cassette 30, in which the rear indentation 68C is enlarged with a top case 31A removed.

As shown in FIG. 14, when a person visually checks the rear indentation 68C of the tape cassette 30 from above (namely, from the inner side of the bottom case 31B) with the top case 31A removed, the person may not be able to directly see the pattern in which the protrusion(s) is formed in the rear indicator portion 900. On the other hand, as shown in FIG. 13, when the person visually checks the rear indentation 68C from underneath (namely, from the outer side of the bottom case 31B), the person can directly see the pattern in which the protrusion(s) is formed in the rear indicator portion 900. Accordingly, even when the person does not know the positions of the lateral information sections Y1 and Y2, the person can identify the elements in the lateral information sections Y1 and Y2 using the following methods.

First, element identification of the lateral information section Y1 will be explained. As shown in FIG. 14, when a person visually checks the rear indentation 68C from above, the person can identify, as the lateral information section Y1, an area adjoining the rear wall 31C and extending in the left-and-right direction in a plan view. On the other hand, as shown in FIG. 13, when the person visually checks the rear indentation 68C from underneath, the person cannot directly see the rear wall 31C. However, because the rear wall 31C is a thin plate and its thickness (the length in the front-rear direction) is small, the position in the front-rear direction of the rear wall 31C generally corresponds to the position in the front-rear direction of the contour formed by the rear surface when the tape cassette 30 is seen in a bottom view. Therefore, the person can identify, as the lateral information section Y1, the area adjacent to the contour formed by the rear surface and extending in the left-and-right direction in a bottom view.

Thus, the person can identify a protrusion formed adjacent to the rear wall 31C as a protrusion formed in the lateral information section Y1. Further, the person can identify a part where the protrusion is not formed within the area adjacent to the rear wall 31C, as a surface portion provided in the lateral information section Y1.

Next, element identification of the lateral information section Y2 will be explained. In the rear indicator portion 900 according to the present embodiment, a protrusion(s) and a surface portion(s) are provided in a pattern that is determined in advance in accordance with the color information. In the present embodiment, in certain patterns that correspond to certain color information (for example, the tape color: clear, the character color: black) relating to major tapes, a pattern of the two indicators that are respectively provided in the lateral information sections Y1 and Y2 and that are arranged in rows in the front-rear direction is fixed. Specifically, for the major color information, the front indicator is provided with a surface portion, and the rear indicator is provided with a protrusion. Note that the major tape refers to a tape that has high likelihood of being mounted in the tape cassette 30. For example, in the examples shown in FIG. 13 and FIG. 14, the two indicators 900C and 900E, through which the reference line Z passes, are formed as a combination of a protrusion and a surface portion, respectively.

With this arrangement, when the rear indentation 68C is visually checked from underneath, with most of the tape cassettes 30 including the major tape, it is ensured that, of the two indicators aligned in the front-rear direction, the indicator formed as a protrusion is provided adjacent to the rear wall 31C and to the rear of the indicator formed as a surface portion. Therefore, the surface portion in the lateral information section Y2 does not adjoin the rear wall 31C (the contour of the rear surface in the bottom view). In other words, the surface portion that is located to the front of the protrusion adjoining the rear wall 31C can be identified as the surface portion of the indicator 900E provided in the lateral information section Y2. Therefore, a person can identify the position of the lateral information section Y1 by visually checking the protrusion of the indicator 900C, and the person can also identify the position of the lateral information section Y2 by visually checking the surface portion of the indicator 900E.

On the contrary, of the two indicators that are respectively provided in the lateral information sections Y1 and Y2 and that are aligned in the front-rear direction, the rear indicator may be formed as a surface portion and the front indicator may be formed as a protrusion. For example, although not shown in the figures, the two indicators 900C and 900E, through which the reference line Z passes, may be formed as a combination of a surface portion and a protrusion, respectively. With this arrangement, when the rear indentation 68C is visually checked from underneath, it is ensured that, in the two indicators aligned in the front-rear direction, the indicator formed as a protrusion is provided separately from the rear wall 31C and to the front of the indicator formed as a surface portion. Therefore, the surface portion adjoining the rear wall 31C (the contour of the rear surface in the bottom view) does not extend over the lateral information section Y2. In other words, the protrusion that is separately disposed from the rear wall 31C can be identified as the protrusion provided in the lateral information section Y2. Therefore, a person can identify the position of the lateral information section Y1 by visually checking the surface portion of the indicator 900C, and the person can also identify the position of the lateral information section Y2 by visually checking the protrusion of the indicator 900E.

In the example of FIG. 13, among the plurality of overlapping areas formed by the lateral information sections Y1, Y2 and the vertical information sections X1 to X4, the overlapping areas of the lateral information section Y1 and the vertical information sections X1 to X4 respectively function as the indicators 900A to 900D, and the overlapping area of the lateral information section Y2 and the vertical information section X3 functions as the indicator 900E. In this case, if the color information is identified by whether a protrusion is formed in each of the indicators 900A to 900E, it is also necessary to identify which of the indicators 900A to 900E includes a protrusion. If a person knows all the positions in the left-and-right direction of the vertical information sections X1 to X4 arranged in the rear indentation 68C, the person can identify to which of the indicators 900A to 900E the protrusion provided in the lateral information section Y1 or Y2 corresponds, using the vertical information sections X1 to X4 as references. In other words, the person can visually identify which of the indicators 900A to 900E, provided in the overlapping areas of the lateral information sections Y1, Y2 and the vertical information sections X1 to X4, includes the at least one protrusion provided in the specified area R0.

The positions in the left-and-right direction of the vertical information sections X1 to X4 can be identified in the following manner, by a person visually checking the rear indentation 68C. When the rear indentation 68C is visually checked from underneath (refer to FIG. 13), it may be possible to identify the position in the left-and-right direction of the vertical information section X3 that includes the indicators 900C and 900E, based on the indicators 900C and 900E that are formed by a combination of a protrusion and a surface portion aligned in the front-rear direction. Further, the vertical information sections X1 to X4 are lined up at substantially equal intervals in the left-and-right direction in the specified area RO. Therefore, by using the vertical information section X3 as a reference, it may be possible to identify the vertical information sections X2 and X1 that are lined up in this order in the left direction (in the right direction in FIG. 13) at equal intervals. It may also be possible to identify the vertical information section X4 that is arranged in the right direction (in the left direction in FIG. 13) at an equal interval. In this manner, even when the positions in the left-and-right direction of the vertical information sections X1 to X4 are not ascertained, it may be possible to identify the positions of the vertical information sections X1 to X4, by using as a reference the indicators (the combination of the protrusion and the surface portion) aligned in the front-rear direction.

For this reason, based on which of the vertical information sections X1 to X4 includes a protrusion provided in the lateral information section Y1, it may be possible to identify which of the indicators 900A to 900D is formed as a protrusion. Further, based on whether or not a protrusion provided in the lateral information section Y2 is located in the vertical information section X3, it may be possible to identify whether the indicator 900E is formed as a protrusion. In this manner, with the tape cassette 30 according to the present embodiment, it may be possible to identify the combination of the protrusion and the surface portion in the indicators 900A to 900E, by a person visually checking the rear indentation 68C.

Next, identification of the color information based on a combination of whether a protrusion is formed in each of the lateral information sections Y1 and Y2 or in each of the indicators 900A to 900E will be explained. In the present embodiment, an example will be explained in which the tape color and the character color of the tape cassette 30 are identified as the color information of the tape cassette 30. Note that the tape color included in the color information indicates a base material color of the tape (the heat-sensitive paper tape 55, the print tape 57, or the double-sided adhesive tape 58). The character color included in the color information indicates an ink color of the ink ribbon 60 when thermal-transfer printing is performed using the ink ribbon 60. The character color also indicates a color developed by the heat-sensitive paper tape 55 when thermal printing that causes the heat-sensitive paper tape 55 to develop color is performed.

Color information element that each of the lateral information sections Y1 and Y2 indicates is determined in advance. In the present embodiment, the lateral information section Y1 is determined as a section that indicates information for identifying the tape color of the color information. The lateral information section Y2 is determined as a section that indicates information for identifying the character color of the color information. In this manner, the tape cassette 30 is structured such that a corresponding color information element can be identified with each of the lateral information sections alone, regardless of the structure of the other lateral information section.

Further, in a case where specific overlapping areas in the lateral information sections Y1 and Y2 function as the indicators 900A to 900E, the color information element that each of the indicators 900A to 900E indicates is determined in accordance with which of the lateral information sections Y1 and Y2 includes each of the indicators 900A to 900E. Accordingly, the indicators 900A to 900D are indicators for identifying the tape color of the color information, and the indicator 900E is an indicator for identifying the character color of the color information. In other words, the lateral information section Y1 and the indicators 900A to 900D each function as a tape color indicator portion, and the lateral information section Y2 and the indicator 900E each function as a character color indicator portion. A method for identifying the color information based on the indicators 900A to 900E will be described below as an example.

The tape color and the character color indicated by each of the indicator portions will be described with reference to Table 1 to Table 3. For explanatory purpose, in the Tables, a case where a protrusion is formed in each of the indicators 900A to 900E is denoted by a value one (1), and a case where each of the indicators 900A to 900E is a surface portion and no protrusion is formed therein is denoted by a value zero (0). Note that, in a case where the color information is identified based on a combination of the protrusion(s) and the surface portion(s) formed in the lateral information sections Y1 and Y2, the method for identifying the major tape color described below may be used, with reference to a similar table in which the indicators 900B to 900D in Table 1 are respectively replaced with a combination of the protrusion(s) and the surface portion(s) provided at three locations in the lateral information section Y1. The method for identifying the special tape color described below may be used, with reference to a similar table in which the indicators 900A to 900D in Table 2 are replaced with a combination of the protrusion(s) and the surface portion(s) provided at four locations in the lateral information section Y1. The method for identifying the character color described below may be used, with reference to a similar table in which the indicator 900E in Table 3 is replaced with the protrusion or the surface portion provided at one location in the lateral information section Y2.

TABLE 1

| Major Tape Color (Y1) | 900B (X2) | 900C (X3) | 900D (X4) |
|---|---|---|---|
| Clear | 1 | 1 | 0 |
| Blue | 0 | 1 | 1 |
| Black | 0 | 0 | 1 |

TABLE 2

| Special Tape Color (Y1) | 900A (X1) | 900B (X2) | 900C (X3) | 900D (X4) |
|---|---|---|---|---|
| White | 0 | 1 | 1 | 1 |
| Yellow | 1 | 0 | 1 | 0 |
| Red | 0 | 1 | 0 | 1 |

TABLE 3

| Character Color (Y2) | 900E (X3) |
|---|---|
| Black | 0 |
| Other than Black | 1 |

First, a method, performed by human visual check, for identifying the color of the tape mounted in the tape cassette 30 will be described. In the present embodiment, the indicators 900A to 900D (the indicators in the lateral information section Y1) indicate the tape color based on a combination of the protrusion(s) and the surface portion(s). In particular, the tape color of the major tape that has a high likelihood of being mounted in the tape cassette 30 can be identified simply by visually checking the three indicators 900B to 900D. Further, the tape color for a special tape that has a low likelihood of being mounted in the tape cassette 30 can be identified by visually checking the four indicators 900A to 900D.

As shown in Table 1, corresponding to combinations of whether the indicators 900B to 900D, which form the tape color indicator portion, are each formed as a protrusion or as a surface portion, three colors "clear" "blue" and "black" are respectively defined as major tape colors indicated by the combinations. Therefore, a person can recognize the tape color of the major tape mounted in the tape cassette 30 simply by visually checking, of the rear indicator portion 900, the indicators 900B to 900D within the lateral information section Y1.

More specifically, if the indicators 900B to 900D are respectively a protrusion, a protrusion, and a surface portion (the combination of "1, 1, 0" in Table 1), it indicates that the tape color is "clear". If the indicators 900B to 900D are respectively a surface portion, a protrusion , and a protrusion (the combination of "0, 1, 1" in Table 1), it indicates that the tape color is "blue". If the indicators 900B to 900D are respectively a surface portion, a surface portion, and a protrusion (the combination of "0, 0, 1" in Table 1), it indicates that the tape color is "black". For example, in the tape cassette 30 shown in FIG. 13 and FIG. 14, the indicators 900B to 900D are respectively a protrusion, a protrusion, and a surface portion. Therefore, the tape color can be identified as "clear".

The indicator 900C is provided in the vertical information section X3 that can be identified by using the reference line Z as a reference. Therefore, among the indicators 900A to 900D in the lateral information section Y1, the indicator 900C can most easily be identified by human visual check. Further, the indicators 900B and 900D that are respectively provided in the vertical information sections X2 and X4, which are located to the right and left of the vertical information section X3, can also easily be identified by human visual check. Therefore, the major tape color can be identified simply by checking the indicators 900B to 900D that can be identified by human visual check, among the indicators 900A to 900D in the lateral information section Y1.

As shown in Table 2, corresponding to combinations of whether the indicators 900A to 900D, which form the tape color indicator portion, are each formed as a protrusion or a surface portion, three colors "white" "yellow" and "red" are respectively defined as special tape colors indicated by the combinations. Therefore, a person can recognize the tape color of the special tape mounted in the tape cassette 30 simply by visually checking the indicators 900A to 900D within the lateral information section Y1 of the rear indicator portion 900.

More specifically, if the indicators 900A to 900D are respectively a surface portion, a protrusion, a protrusion, and a protrusion (the combination of "0, 1, 1, 1" in Table 2), it indicates that the tape color is "white". If the indicators 900A to 900D are respectively a protrusion, a surface portion, a protrusion, and a surface portion (the combination of "1, 0, 1, 0" in Table 2), it indicates that the tape color is "yellow". If the indicators 900A to 900D are respectively a surface portion, a protrusion, a surface portion, and a protrusion (the combination of "0, 1, 0, 1" in Table 2), it indicates that the tape color is "red".

As shown in Table 3, corresponding to whether the indicator 900E, which is the character color indicator portion, is formed as a protrusion or a surface portion, "black" or "other than black" is defined as the character color. Therefore, a person can recognize the character color for the tape mounted in the tape cassette 30 by just visually checking the indicator 900E within the lateral information section Y2 of the rear indicator portion 900. More specifically, if the indicator 900E is a protrusion ("1" in Table 3), it indicates that the character color is "a color other than black". If the indicator 900E is a surface portion ("0" in Table 3), it indicates that the character color is "black". For example, in the tape cassettes 30 shown in FIG. 13 and FIG. 14, the indicator 900E is a surface portion. Therefore, the character color can be identified as "black".

In this manner, with the tape cassette 30 according to the present embodiment, regardless of whether the indicator 900E provided in the specified area R0 is formed as a protrusion or a surface portion, with respect to the major tape colors shown in Table 1, a person can identify the tape color simply by visually checking the indicators 900B to 900D. With respect to the special tape colors shown in Table 2, the person can identify the tape color simply by visually checking the indicators 900A to 900D. With respect to the character colors shown in Table 3, regardless of whether each of the indicators 900A to 900D provided in the specified area R0 is a protrusion or a surface portion, the person can identify the character color simply by visually checking the indicator 900E.

In the cassette case 31, the first and second tape housing areas 33A and 33B are provided to the rear, while the ink ribbon housing area 33C is provided to the front. Consequently, in the tape cassette 30 that uses the ink ribbon 60, the tape (the double-sided adhesive tape 58 in FIG. 3 and FIG. 4, and the print tape 57 in FIG. 5) and the ink ribbon 60 are aligned in the front-rear direction inside the cassette case 31, corresponding to the arrangement order in the front-rear direction of the lateral information sections Y1 and Y2. Therefore, the person can identify the base material color of the tape located to the rear of the ink ribbon, by visually checking the lateral information section Y1 that indicates the tape color, which is to the rear side of the lateral information section Y2. Further, the person can identify the ink color of the ink ribbon located to the front of the tape, by visually checking the lateral information section Y2 that indicates the character color, which is to the front side of the lateral information section Y1. Thus, based on the arrangement of the tape and the ink ribbon inside the cassette case 31, a person can accurately identify the color information indicated by the lateral information sections Y1 and Y2.

The contents of the color information (the tape color and the character color) indicated by each of the indicator portions are not limited to those shown in Table 1 to Table 3, and can be modified as necessary. Additionally, although the total number of combinations of the color information defined in Table 1 to Table 3 is twenty eight, all of the combinations need not necessarily be used. However, it may be preferable that the combination of the protrusion(s) and the surface portion(s) corresponding to the color information is defined at least in accordance with the following rules.

First, it may be desirable that at least one of the indicators 900A, 900B and 900D, except the indicator 900C that can easily be identified using the reference line Z as a reference, is formed as a protrusion, and at least one of the indicators 900A, 900B and 900D is formed as a surface portion. In this case, when a person visually checks the indicators 900A to 900D, it may be possible to improve visibility of the combination of the protrusion(s) and the surface portion(s) of the indicators 900A to 900D, and it may be possible for the person to easily identify the combination.

Second, it may be desirable that the following two combinations are not employed. One is a combination in which all the indicators 900A to 900D within the lateral information section Y1 are surface portions. The other is a combination in which all the indicators 900A to 900E within the specified area R0 are surface portions. In such combinations, the entire rear indentation 68C may be formed as a surface portion in which only one protrusion is formed at a position separated from the rear wall 31C, or as a surface portion including no protrusion. Then, it may be difficult for a person to ascertain that the rear indicator portion 900 is provided in the rear indentation 68C in the first place. Therefore, by providing at least one protrusion in a position adjoining the rear wall 31C, it may be possible to make clear that the rear indicator portion 900 is provided in the rear indentation 68C.

Third, for the color information of the tape that has a high likelihood of being mounted in the tape cassette 30, it may be desirable that one of the indicators 900C and 900E that are aligned in the front-rear direction in the rear indentation 68C is a protrusion, and the other indicator is a surface portion. In this case, the person can identify the element of the lateral information section Y2 by visually checking the rear indentation 68C as described above.

Fourth, when the tape color of the tape cassette 30 is identified by human visual check, regardless of whether the tape color is a major tape color or a special tape color, whether each of the indicators 900B to 900D is a protrusion or a surface portion is necessary information to identify the tape color. Therefore, it may be preferable that the color information corresponding to the special tape colors shown in Table 2 does not include the color information corresponding to the major tape colors shown in Table 1. More specifically, it may be desirable that the color information of the special tape colors (refer to Table 2) does not include combinations in which the indicators 900B to 900D are "a protrusion, a protrusion, a surface portion", "a surface portion, a protrusion, a protrusion", and "a surface portion, a surface portion, a protursion". Thus, when a person visually checks the rear indentation 68C, it may be possible to clearly distinguish whether it is the major tape color or the special color, and it may be possible to easily identify the tape color.

The structure for the rear indicator portion 900 to indicate the color information, and the method for identifying the color information by a person visually checking the rear indicator portion 900 are described above. Hereinafter, the structure of the rear indicator portion 900 in relation to the rear detecting switches 310 of the tape printer 1, and color information identification by the rear detecting switches 310 will be described.

First, the structure of the rear indicator portion 900 in relation to the rear detecting switches 310 of the tape printer 1 will be described. As described above, in the tape printer 1 of the present embodiment, the rear detection portion 300 provided in the rear support portion 8C has the five rear detecting switches 310A to 310E (refer to FIG. 2 and FIG. 7). In the tape cassette 30, the overlapping areas that respectively face the rear detecting switches 310A to 310E when the tape cassette 30 is installed in the cassette housing portion 8 are formed as the indicators 900A to 900E (refer to FIG. 13 and FIG. 14).

When the tape cassette 30 is installed in the cassette housing portion 8, the positioning pins 102 and 103 are respectively inserted in the pin holes 62 and 63. At the same time, the rear support pin 301 contacts with the rear indentation 68C (refer to FIG. 16). Thus, the tape cassette 30 is supported by the positioning pins 102 and 103, and by the rear support pin 301 at a predetermined height position. Meanwhile, the switch terminals 322 of the rear detecting switches 310 each protrude upwards toward the rear indicator portion 900. The leading end of each switch terminal 322 may extend higher than the lower surface 32B of the corner portions 32A and lower than the rear indentation 68C.

The surface portion is a part of the rear indentation 68C that opposes the leading end of the rear detecting switch 310 with a small gap therebetween when the tape cassette 30 is installed in the cassette housing portion 8. Therefore, the surface portion functions as the non-pressing portion 901 that does not press the switch terminal 322. The rear detecting switch 310 that opposes the non-pressing portion 901 remains in an off state, as the switch terminal 322 is not pressed.

The protrusion functions as the pressing portion 902 that opposes and presses the switch terminal 322 of the rear detecting switch 310 when the protrusion opposes the rear detecting switch 310. The rear detecting switch 310 that opposes the pressing portion 902 is changed to an on state, as the switch terminal 322 contacts with the pressing portion 902. For example, as shown in FIG. 11 and FIG. 13, the pressing portion 902 may be formed as a generally cylindrical protrusion that extends from the rear indentation 68C to a lower position than the lower surface 32B. The pressing portion 902 may have a circular shape that occupies an almost entire area of the each of the indicators 900A to 900E (the overlapping area) in a bottom view.

Thus, in the tape cassette 30 of the present embodiment, the non-pressing portion 901 is a part of the rear indentation 68C that is located at a higher position than the lower surface 32B, while the pressing portion 902 is a protrusion protruding downward from the rear indentation 68C to a lower position than the lower surface 32B. Therefore, when the tape cassette 30 is installed in the cassette housing portion 8, each of the rear detecting switches 310 is maintained in the off state or changed to the on state, due to the difference in the height positions of the non-pressing portion 901 and the pressing portion 902. In the examples shown in FIG. 13 and FIG. 14, the indicators 900A, 900D and 900E are the non-pressing portions 901, and the indicators 900B and 900C are the pressing portions 902.

As described above with reference to Table 1 to Table 3, either a surface portion (the non-pressing portion 901) or a protrusion (the pressing portion 902) is formed in each of the indicators 900A to 900E of the rear indicator portion 900, in accordance with a prescribed pattern that corresponds to the color information. Accordingly, the tape printer 1 can identify the color information based on the combination of the on and off states of the rear detecting switches 310 that are selectively pressed by the rear indicator portion 900. More specifically, the prescribed pattern (the combination of the protrusion(s) and the surface portion(s)) that is defined in advance for the indicators 900A to 900E as described above can be converted to a detection pattern (the combination of the on and off states) of the corresponding rear detecting switches 310A to 310E. Then, the tape printer 1 can identify the color information with reference to a table in which each detection pattern is associated with the color information.

A color information table 520 shown in FIG. 18 is an example of a table used in the tape printer 1 to identify the color information, and is stored in the ROM 402 of the tape printer 1. The color information of the tape cassette 30 is defined in the color information table 520 in accordance with the combination of the on and off states of the five rear detecting switches 310A to 310E. In the color information table 520 shown in FIG. 18, the rear detecting switches 310A to 310E respectively correspond to switches "ST1" to "ST5", and the off state (OFF) and the on state (ON) of each of the rear detecting switches 310 correspond to the values zero "0" and one "1", respectively.

The color information table 520 of the present embodiment includes a plurality of color tables to respectively identify different color information corresponding to different detection patterns of the rear detecting switches 310A to 310E. In the example shown in FIG. 18, the color information table 520 includes a first color table 521 and a second color table 522. In the first color table 521, first color information is defined in association with detection patterns of the rear detecting switches 310A to 310E. In the second color table 522, second color information is defined in association with the detection patterns of the rear detecting switches 310A to 310E. In the present embodiment, the first color table 521 is a standard color table that includes the color information that is frequently used, and the second color table 522 is a special color table that includes the color information that is less frequently used. In the tape printer 1, the first color table 521 and the second color table 522 are selectively used, and the color information (the first color information or the second color information) is identified in accordance with the detection pattern of the rear detecting switches 310A to 310E, as will be described later.

The table that can be used in the tape printer 1 is not limited to the color information table 520 shown in FIG. 18. For example, any selected color information may be newly added corresponding to "spare" field in the color information table 520. In addition, the color information that is recorded in the color information table 520 may be deleted, the correspondence between each detection pattern and the color information may be changed, or the content of the color information corresponding to each detection pattern may be changed. In such a case, the above-described pattern of the protrusion(s) that is determined for identification of the color information by a visual check may also be changed as necessary.

Next, detection modes of the tape type of the tape cassette 30 by the tape printer 1 will be explained with reference to FIG. 3 to FIG. 6, FIG. 15 and FIG. 16.

First, detection modes of the arm indicator portion 800 by the arm detection portion 200 will be explained with reference to FIG. 3 to FIG. 6 and FIG. 15. When the tape cassette 30 is installed at the proper position in the cassette housing portion 8 by the user and the cassette cover 6 is closed, the platen holder 12 moves from the stand-by position (refer to FIG. 3) to the print position (refer to FIG. 4 to FIG. 6). Then, the arm detection portion 200 and the latching piece 225 provided on the cassette-facing surface 12B of the platen holder 12 move to the positions that respectively oppose the arm indicator portion 800 and the latching hole 820 provided on the arm front wall 35 of the tape cassette 30.

In a case where the tape cassette 30 is installed in the cassette housing portion 8 at the proper position, the latching piece 225 is inserted into the latching hole 820. As a result, the latching piece 225 does not interfere with the tape cassette 30, and the switch terminals 222 of the arm detecting switches 210 that protrude from the cassette-facing surface 12B oppose the indicators 800A to 800E (the non-pressing portions 801 and the pressing portion 802) that are provided at the corresponding positions in the arm indicator portion 800, and are selectively pressed. More specifically, the arm detecting switch 210 opposing the non-pressing portion 801 remains in the off state by being inserted into the aperture that is the non-pressing portion 801. The arm detecting switch 210 opposing the pressing portion 802 is changed to the on state by being pressed by the surface portion of the arm front wall 35 that is the pressing portion 802.

Figure 15:
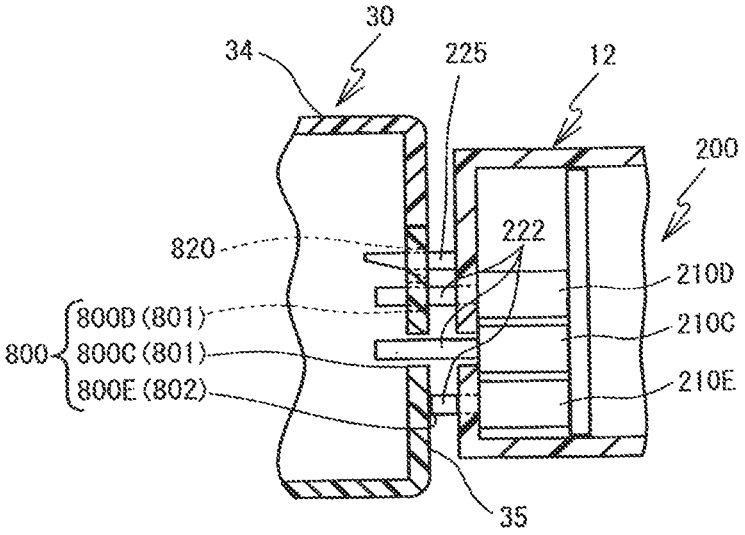
FIG. 15 is a cross-sectional view taken along a line III-III in FIG. 8 as seen in the direction of the arrows, and illustrates a state where the arm detection portion 200 shown in FIG. 8 opposes an arm indicator portion 800 shown in FIG. 12.

For example, in a case where the tape cassette 30 shown in FIG. 2 and FIG. 10 to FIG. 14 is installed at the proper position in the cassette housing portion 8, the arm detecting switches 210A, 210C and 210D are in the off state (0), because they respectively oppose the indicators 800A, 800C and 800D that are the non-pressing portions 801, as shown in FIG. 15. On the other hand, the arm detecting switches 210B and 210E are in the on state (1), because they respectively oppose the indicators 800B and 800E that are the pressing portions 802. More specifically, the values that indicate the on and off states of the arm detecting switches 210A to 210E are identified as "0", "1", "0", "0", "1", respectively.

In the tape printer 1, based on the detection pattern of the arm detection portion 200 (here, the combination of the on and off states of the five arm detecting switches 210A to 210E), the print information is identified as the tape type of the tape cassette 30. In the present embodiment, the print information of the tape cassette 30 includes the tape width and the print mode. The "tape width" included in the print information indicates one of seven types of tape width from 3.5 mm to 36 mm. The "print mode" included in the print information indicates whether the print mode is a minor image printing mode (laminated) or a normal image printing mode (receptor).

The ROM 402 of the tape printer 1 stores a print information table (not shown in the figures) in which the print information of the tape cassette 30 is defined in association with the combinations of the on and off states of the five arm detecting switches 210A to 210E. In the above-described example, with reference to the print information table (not shown in the figures), for example, "tape width: 36 mm, print mode: laminated" is identified as the print information in accordance with the on and off states "0", "1", "0", "0", "1" of the arm detecting switches 210A to 210E.

Next, detection modes of the rear indicator portion 900 by the rear detection portion 300 will be explained with reference to FIG. 16. When the tape cassette 30 is installed at the proper position in the cassette housing portion 8 by the user, the rear detection portion 300 provided in the rear support portion 8C of the tape printer 1 opposes the rear indicator portion 900 provided in the rear indentation 68C of the tape cassette 30. More specifically, the switch terminals 322 (refer to FIG. 2 and FIG. 7) of the rear detecting switches 310 that protrude from the rear support portion 8C oppose the indicators (the non-pressing portion 901 and the pressing portion 902) provided at the corresponding positions in the rear indicator portion 900, and are selectively pressed. Consequently, the rear detecting switch 310 that opposes the non-pressing portion 901 remains in an off state, without being pressed. On the other hand, the rear detecting switch 310 that opposes the pressing portion 902 is pressed by the pressing portion 902, and is changed to an on state.

Figure 16:
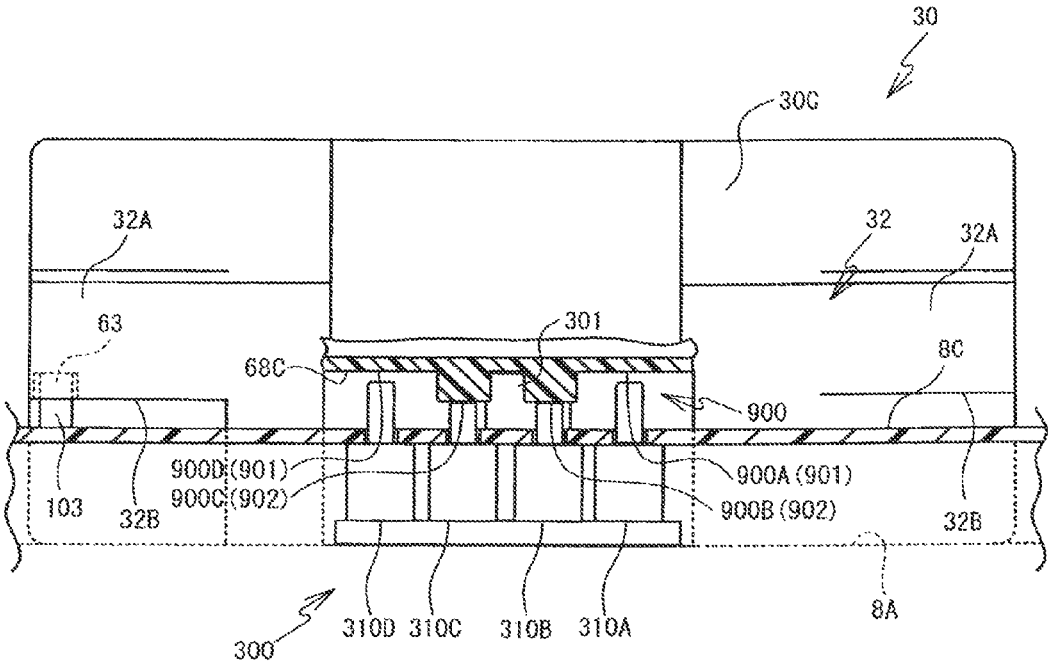
FIG. 16 is a cross-sectional view taken along a line II-II in FIG. 4 as seen in the direction of the arrows, and illustrates a state where a rear detection portion 300 shown in FIG. 7 opposes a rear indicator portion 900 shown in FIG. 13.

For example, in a case where the tape cassette 30 shown in FIG. 2 and FIG. 10 to FIG. 14 is installed at the proper position in the cassette housing portion 8, as shown in FIG. 16, the rear detecting switches 310A, 310 D and 310E respectively oppose the indicators 900A, 900D and 900E, which are the non-pressing portions 901, and therefore remain in the off state. Meanwhile, the rear detecting switches 310B and 310C respectively oppose the indicators 900B and 900C, which are the pressing portions 902, and are therefore changed to the on state. Consequently, the values indicating the on and off states of the switches "ST1" to "ST5" that respectively correspond to the rear detecting switches 310A to 310E are identified as "0", "1", "1", "0" "0", respectively.

In the tape printer 1, the color information is identified as the tape type of the tape cassette 30, based on the detection pattern (here, the combination of the on and off states of the five rear detecting switches 310A to 310E) of the rear detection portion 300. In the above-described example, with reference to the above-described color information table 520 (refer to FIG. 18), the color information corresponding to the on and off states "0", "1", "1", "0" "0" of the rear detecting switches 310A to 310E is identified. However, the identified color information varies depending on which of the color tables 521 and 522 included in the color information table 520 is used. Here, the standard first color table 521 is used in accordance with the off state of the arm detecting switch 210D to be described later, and the color information "tape color: clear, character color: black" is identified similarly to the above-described identification result by a visual check.

Next, processing relating to printing performed in the tape printer 1 according to the present embodiment will be explained with reference to FIG. 17. The processing relating to printing shown in FIG. 17 is performed by the CPU 401 based on programs stored in the ROM 402 when the power source of the tape printer 1 is switched on.

Figure 17:
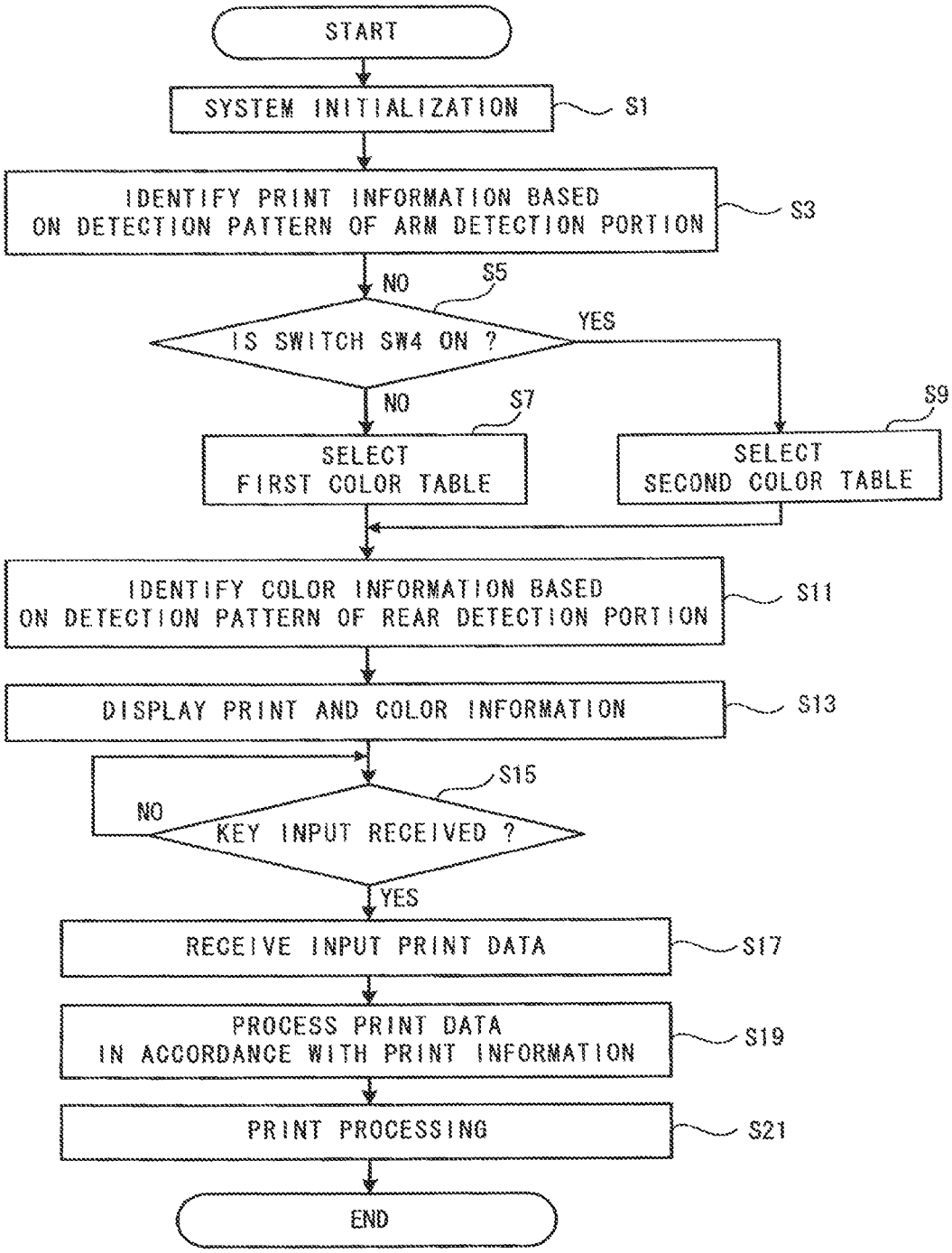
FIG. 17 is a flowchart showing processing relating to printing of the tape printer 1.

As shown in FIG. 17, in the processing relating to printing, first, system initialization of the tape printer 1 is performed (step S1). For example, in the system initialization performed at step S1, the text memory in the RAM 404 is cleared, and a counter is initialized to a default value.

Next, the print information of the tape cassette 30 is identified based on the detection pattern of the arm detection portion 200 (namely, based on the combination of the on and off states of the arm detecting switches 210) (step S3). At step S3, as described above, with reference to the print information table (not shown in the figures) stored in the ROM 402, the print information corresponding to the combination of the on and off states of the arm detecting switches 210A to 210E is identified.

Then, it is determined whether or not the arm detecting switch 210D (hereinafter referred to as the switch SW4), among the plurality of arm detecting switches 210, is in the on state (step S5). When the switch SW4 is in the off state (no at step S5), the first color table 521 is selected from among the color tables included in the color information table 520 stored in the ROM 402 (step S7). When the switch SW4 is in the on state (yes at step S5), the second color table 522 is selected from among the color tables included in the color information table 520 stored in the ROM 402 (step S9).

Next, the color information of the tape cassette 30 is identified based on the detection pattern of the rear detection portion 300 (namely, based on the combination of the on and off states of the plurality of rear detecting switches 310) (step S11). At step S11, with reference to the color table selected at step S7 or at step S9, the color information corresponding to the combination of the on and off states of the plurality of rear detecting switches 310 is identified. In the present embodiment, in the tape cassette 30 of the tape type that is manufactured in large quantities, the indicator 800D corresponding to the arm detecting switch 210D is formed as the non-pressing portion 801. For that reason, at step S11, in many cases, the color information is identified with reference to the standard first color table 521.

Thus, in the present embodiment, the color table to be used to identify the color information of the tape cassette 30 is selected in accordance with the detection state of a particular arm detecting switch 210 (here, the on or off state of the arm detecting switch 210D). Therefore, without increasing the number of the rear detecting switches 310 (namely, without increasing the area occupied by the rear detection portion 300), it may be possible to increase the number of color information patterns that can be identified by the tape printer 1.

In the processing relating to printing (refer to FIG. 17), the print information identified at step S3 and the color information identified at step S11 are displayed on the display 5 as text information (step S13). In a case where the above-described tape cassette 30 (refer to FIG. 2 and FIG. 10 to FIG. 14) is properly installed, the display 5 displays a message that reads, for example, "A 36 mm laminated-type tape cassette has been installed. The tape color is clear and the character color is black."

Next, it is determined whether there is any input from the keyboard 3 (step S15). If there is an input from the keyboard 3 (yes at step S15), the CPU 401 receives the characters input from the keyboard 3 as print data, and stores the print data (text data) in the text memory of the RAM 404 (step S17). If there is no input from the keyboard 3 (no at step S15), the processing returns to step S15 and the CPU 401 waits for an input from the keyboard 3.

Then, if there is an instruction to start printing from the keyboard 3, for example, the print data stored in the text memory is processed in accordance with the print information identified at step S3 (step S19). For example, at step S19, the print data is processed such that a print range and a print size corresponding to the tape width identified at step S3, and a print position corresponding to the print mode (the mirror image printing mode or the normal image printing mode) identified at step S3 are incorporated. Based on the print data processed at step S19, print processing is performed on the tape that is the print medium (step S21). After the print processing is performed, the processing relating to printing (refer to FIG. 17) ends.

The above-described print processing (step S21) will be explained below more specifically. In a case where the laminated type tape cassette 30 shown in FIG. 3 and FIG. 4 is installed, the tape drive roller 46, which is driven to rotate via the tape drive shaft 100, pulls out the film tape 59 from the second tape spool 41 by moving in concert with the movable feed roller 14. Further, the ribbon take-up spool 44, which is driven to rotate via the ribbon take-up shaft 95, pulls out the unused ink ribbon 60 from the ribbon spool 42 in synchronization with the print speed. The film tape 59 that has been pulled out from the second tape spool 41 passes the outer edge of the ribbon spool 42 and is fed along the feed path within the arm portion 34.

Then, the film tape 59 is discharged from the exit 34A toward the head insertion portion 39 in a state in which the ink ribbon 60 is joined to the surface of the film tape 59. The film tape 59 is then fed between the thermal head 10 and the platen roller 15 of the tape printer 1. Then characters are printed onto the print surface of the film tape 59 by the thermal head 10. Following that, the used ink ribbon 60 is separated from the printed film tape 59 at the guide wall 47 and wound onto the ribbon take-up spool 44.

Meanwhile, the double-sided adhesive tape 58 is pulled out from the first tape spool 40 by the tape drive roller 46 moving in concert with the movable feed roller 14. While being guided and caught between the tape drive roller 46 and the movable feed roller 14, the double-sided adhesive tape 58 is layered onto and affixed to the print surface of the printed film tape 59. The printed film tape 59 to which the double-sided adhesive tape 58 has been affixed (namely, the printed tape 50) is then fed toward the tape discharge portion 49, discharged from the discharge portion 49, and is cut by the cutting mechanism 17.

In a case where the receptor type tape cassette 30 shown in FIG. 5 is installed, the tape drive roller 46, which is driven to rotate via the tape drive shaft 100, pulls out the print tape 57 from the first tape spool 40 by moving in concert with the movable feed roller 14. Further, the ribbon take-up spool 44, which is driven to rotate via the ribbon take-up shaft 95, pulls out the unused ink ribbon 60 from the ribbon spool 42 in synchronization with the print speed. The print tape 57 that has been pulled out from the first tape spool 40 is bent in the leftward direction in the front right portion of the cassette case 31, and fed along the feed path within the arm portion 34.

Then, the print tape 57 is discharged from the exit 34A toward the head insertion portion 39 in a state in which the ink ribbon 60 is joined to the surface of the print tape 57. The print tape 57 is then fed between the thermal head 10 and the platen roller 15 of the tape printer 1. Then, characters are printed onto the print surface of the print tape 57 by the thermal head 10. Following that, the used ink ribbon 60 is separated from the printed print tape 57 at the guide wall 47 and wound onto the ribbon take-up spool 44. Meanwhile, the printed print tape 57 (in other words, the printed tape 50) is then fed toward the tape discharge portion 49, discharged from the discharge portion 49, and is cut by the cutting mechanism 17.

In a case where the thermal type tape cassette 30 shown in FIG. 6 is installed, when printing is performed, the tape drive roller 46, which is driven to rotate via the tape drive shaft 100, pulls out the heat-sensitive paper tape 55 from the first tape spool 40 by moving in concert with the movable feed roller 14. The heat-sensitive paper tape 55 that has been pulled out from the first tape spool 40 is bent in the leftward direction in the front right portion of the cassette case 31, and is fed along the feed path within the arm portion 34.

Then, the heat-sensitive paper tape 55 is discharged from the exit 34A of the arm portion 34, and is then fed between the thermal head 10 and the platen roller 15. Then, characters are printed onto the print surface of the heat-sensitive paper tape 55 by the thermal head 10. Following that, the printed heat-sensitive paper tape 55 (namely, the printed tape 50) is further fed toward the tape discharge portion 49 by the tape drive roller 46 moving in concert with the movable feed roller 14, discharged from the discharge portion 49, and is cut by the cutting mechanism 17.

In the above-described print processing (step S21), in a case where the laminated type tape cassette 30 is installed, mirror image printing is performed. In mirror image printing, the ink of the ink ribbon 60 is transferred onto the film tape 59 such that the characters are shown as a mirror image. On the other hand, in a case where the receptor type tape cassette 30 is installed, normal image printing is performed. In normal image printing, the ink of the ink ribbon 60 is transferred onto the print tape 57 such that the characters are shown as a normal image. Further, in a case where the thermal type tape cassette 30 is installed, thermal type normal image printing is performed on the heat-sensitive paper tape 55 such that the characters are color developed as a normal image.

In the present embodiment, the print mode "laminated" is applied to the tape cassette 30 with which minor image printing is performed, while the print mode "receptor" is applied to the tape cassette 30 with which normal image printing is performed. For that reason, the print mode "receptor" is applied not only to the receptor type tape cassette 30 shown in FIG. 5, but also to the thermal type tape cassette 30 shown in FIG. 6.

Through the above-described processing relating to printing (refer to FIG. 17), the tape type of the tape cassette 30 installed in the cassette housing portion 8 is identified by the tape printer 1, based on the detection pattern of the arm detection portion 200 and the detection pattern of the rear detection portion 300. More specifically, the arm detecting switches 210A to 210E on the arm detection portion 200 are selectively pressed by the arm indicator portion 800 provided on the arm front wall 35 of the tape cassette 30, and the print information of the tape cassette 30 is thus identified. Further, the rear detecting switches 310A to 310E on the rear detection portion 300 are selectively pressed by the rear indicator portion 900 provided on the bottom wall 30B (more specifically, the rear indentation 68C) of the tape cassette 30, and the color information of the tape cassette 30 is thus identified.

As described above, the tape cassette 30 according to the present embodiment is structured such that when a person looks at the tape cassette 30 alone, the person can identify the tape type (here, the color information) by visually checking the rear indentation 68C. In addition, the tape cassette 30 is structured such that when the tape cassette 30 is installed in the cassette housing portion 8 of the tape printer 1, the tape printer 1 can identify the tape type with the rear detection portion 300 detecting information indicated by the rear indicator portion 900. Of the foregoing structures, as a result of structuring the tape cassette 30 such that a person can recognize the color information by visually checking the rear indicator portion 900, the following effects may be particularly exhibited.

In a conventional manufacturing method for tape cassettes, it is a general practice to house a tape or the like in a cassette case in accordance with a type of a tape cassette. For example, in accordance with the color information (a combination of the tape color and the character color) of the tape to be mounted in the tape cassette, a worker mounts, in the cassette case, a tape whose base material color matches the tape color, and an ink ribbon with an ink color that matches the character color. However, there are a variety of combinations of tape colors and character colors. Therefore, when tape cassettes are manufactured, the worker may mistakenly mount a tape or an ink ribbon that does not correspond to the color information of the tape or the ink ribbon to be mounted in the tape cassette.

With the tape cassette 30 according to the present embodiment, in the manufacturing process of the tape cassette 30, a worker can check the rear indicator portion 900 by turning over the bottom case 31B before mounting a tape or the like, and visually checking the rear indentation 68C from the bottom surface side of the cassette case 31. Therefore, the worker can identify the color information intended for the cassette case 31, and can ascertain the tape color and the character color of the tape or the like that should be housed in the cassette case 31. As a consequence, in the manufacturing process of the tape cassette 30, the worker can work while confirming the contents to be housed in the cassette case 31, and thus errors in the manufacture of the tape cassette 30 may be reduced.

Furthermore, after the tape cassettes 30 has been shipped from the plant, even if the tape type or the like written on a label cannot be read for some reason, the worker can recognize the color information by visually checking the tape cassette 30 from the bottom surface side. Therefore, the worker can easily select the tape cassette 30 having desired color information from among a plurality of the tape cassettes 30.

In addition, the rear indicator portion 900 indicates the color information using a simple structure formed of a combination of a presence and an absence of a protrusion (namely, a combination of the non-pressing portion(s) 901 and the pressing portion(s) 902) in each of the lateral information sections Y1 and Y2. Therefore, the rear indicator portion 900 may be formed easily on the cassette case 31 in advance. For that reason, at the time of manufacture of the cassette case 31, there may be no need to print the contents to be housed in the cassette case 31, nor to affix labels to indicate the contents, and therefore errors in the manufacture of the tape cassette 30 can be reduced at a low cost.

Moreover, in the present embodiment, the laminated type tape cassette 30 formed from the general purpose cassette is used in the general purpose tape printer 1. Therefore, a single tape printer 1 can be used with each type of the tape cassette 30, such as the thermal type, the receptor type, and the laminated type etc., and it may not be necessary to use the different tape printer 1 for each type. Furthermore, the tape cassette 30 is normally formed by injecting plastic into a plurality of combined dies. In the case of the tape cassette 30 that corresponds to the same tape width, common dies can be used, except for the die including the portion that forms the rear indicator portion 900. Thus, costs may be significantly reduced.

In the example described above, the specified area R0 of the rear indentation 68C includes overlapping areas that function as the indicators 900A to 900E, each of which includes either a surface portion (namely, the non-pressing portion 901) or a protrusion (namely, the pressing portion 902) corresponding to the color information. In such a case, in the specified area R0, a protrusion and a surface portion may be formed freely as long as the functions of the indicators 900A to 900E are maintained.

More specifically, with the above-described tape cassette 30 shown in FIG. 2 and FIG. 10 to FIG. 14, all the areas in the specified area R0 that do not function as the indicators 900A to 900E are surface portions that are in the same plane as the non-pressing portions 901. Therefore, the protrusions (the pressing portions 902) provided in the specified area R0 are formed separately from each other. However, it may not be necessary that the protrusions are all separated from each other. For example, one continuous protrusion having a size and shape that include at least two of the pressing portions 902 may be formed in the specified area R0. Note, however, that in a case where one continuous protrusion is formed, the continuous protrusion needs to be formed such that the continuous protrusion does not include a part that functions as the non-pressing portion 901.

Figure 19:
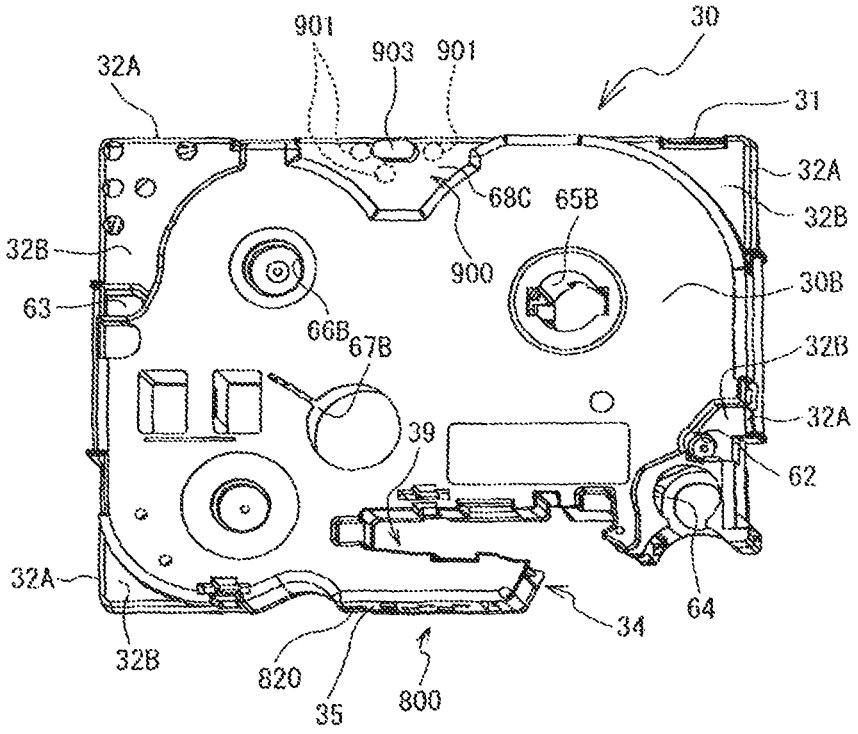
FIG. 19 is an external perspective view of a tape cassette 30 according to a modified example, as seen from the bottom surface side.
Figure 20:
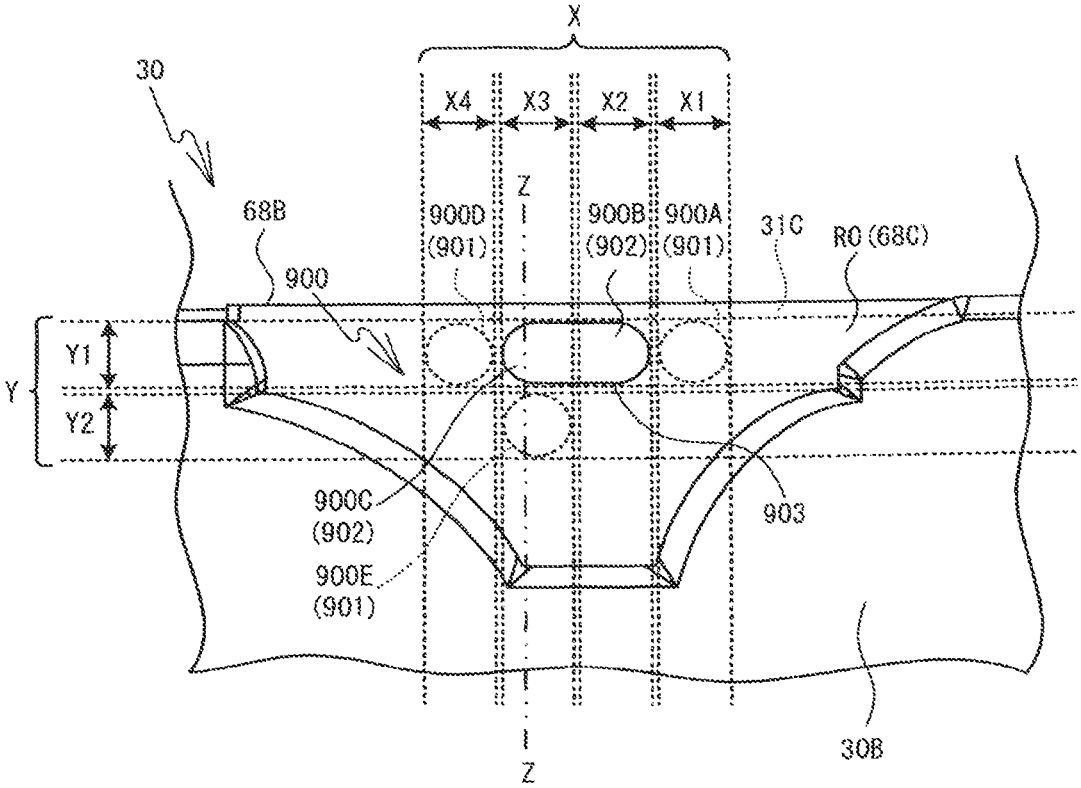
FIG. 20 is a bottom view of the tape cassette 30 according to the modified example, in which the rear indentation 68C is enlarged.

FIG. 19 and FIG. 20 show an example of the tape cassette 30 in which each of the pressing portions 902 provided in the indicators 900B and 900C are made continuous to form a continuous protrusion 903. In the tape cassette 30 shown in FIG. 19 and FIG. 20, a combination of the indicators 900A to 900E is the same with that of the tape cassette 30 shown in FIG. 2, and FIG. 10 to FIG. 14. Therefore, the same color information is identified as the tape cassette 30 shown in FIG. 2, and FIG. 10 to FIG. 14, by either detection of the rear detecting switches 310 or by human visual check.

The tape cassette 30 and the tape printer 1 of the present invention are not limited to those in the above-described embodiment, and various modifications and alterations may of course be made insofar as they are within the scope of the present invention.

The shape, size, number and arrangement pattern of the non-pressing portion(s) 901 and the pressing portion(s) 902 of the rear indicator portion 900 are not limited to the examples represented in the above-described embodiment, but can be modified as appropriate. For example, in the above-described embodiment, the pressing portion 902 (protrusion) of the rear indicator portion 900 is a generally cylindrical protrusion. However, the pressing portion 902 can be modified in size and shape as far as it is capable of pressing the opposing switch terminal 322 of the rear detecting switch 310 to make it in the on state. For example, the pressing portion 902 may be a hemispherical protrusion that has a circular shape in a bottom view that generally includes the overlapping area. Alternatively, the pressing portion 902 may be a parallelepiped protrusion that has a square shape in a bottom view that generally matches the overlapping area, or the pressing portion 902 may have any other different shape.

Further, the color information table 520 includes the first color table 521 and the second color table 522, and either the first color table 521 or the second color table 522 is selected based on the detection result of the arm detecting switch 210D. However, the color information table 520 may include a single color table.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A tape cassette, comprising:

a housing at least partially accommodating a tape, the housing including a top wall having a top surface orthogonal to a first direction, a bottom wall having a bottom surface, a front wall extending from the bottom wall toward the top wall, an arm rear wall extending from the bottom wall toward the top wall, an arm portion formed by the front wall and the arm rear wall, and a tape exit formed on the arm portion, the arm portion being configured to guide the tape toward the tape exit in a tape feed direction, the tape feed direction being a direction toward the tape exit along the front wall at the arm portion and being orthogonal to the first direction, the housing having a generally rectangular shape when viewed along the first direction;

a first surface portion provided in the bottom surface, the first surface portion being a flat surface portion and including the bottom surface at the arm portion;

a first receiving portion comprising a recess recessing from the first surface portion toward the top wall and opening downstream in the tape feed direction, the first receiving portion being connected to an upstream end of the arm rear wall in the tape feed direction;

a second surface portion provided in the bottom surface, the second surface portion being a flat surface portion extending generally parallel to the first surface portion and being located between the top surface and the first surface portion in the first direction; and a first indicator portion provided on the second surface portion, the first indicator portion having a first protrusion protruding from the second surface portion, the first protrusion having a protruding end located between the second surface portion and the first surface portion in the first direction, wherein the housing includes a plurality of corner portions, each of the plurality of the corner portions being provided at a respective corner of the generally rectangular shape, wherein a first corner portion of the plurality of the corner portions and a second corner portion of the plurality of the corner portions each include a third surface portion, the third surface portion being a flat surface portion extending generally parallel to the first surface portion, and the third surface portion being located between the first surface portion and the second surface portion in the first direction, and wherein the second surface portion is located between the first corner portion and the second corner portion when viewed from the bottom surface.

2. The tape cassette according to claim 1, wherein the protruding end is located at a same position as the third surface portion of one of the plurality of the corner portions in the first direction.

3. The tape cassette according to claim 1, wherein the first corner portion has a bottom recess formed on the third surface portion, and wherein the bottom recess recesses toward the top wall and opens along the first direction.

4. A tape cassette, comprising:

a housing at least partially accommodating a tape, the housing including a top wall having a top surface orthogonal to a first direction, a bottom wall having a bottom surface, a front wall extending from the bottom wall toward the top wall, an arm rear wall extending from the bottom wall toward the top wall, an arm portion formed by the front wall and the arm rear wall, and a tape exit formed on the arm portion, the arm portion being configured to guide the tape toward the tape exit in a tape feed direction, the tape feed direction being a direction toward the tape exit along the front wall at the arm portion and being orthogonal to the first direction, the housing having a generally rectangular shape when viewed along the first direction;

a first surface portion provided in the bottom surface, the first surface portion being a flat surface portion and including the bottom surface at the arm portion;

a first receiving portion comprising a recess recessing from the first surface portion toward the top wall and opening downstream in the tape feed direction, the first receiving portion being connected to an upstream end of the arm rear wall in the tape feed direction;

a second surface portion provided in the bottom surface, the second surface portion being a flat surface portion extending generally parallel to the first surface portion and being located between the top surface and the first surface portion in the first direction; and a first indicator portion provided on the second surface portion, the first indicator portion having a first protrusion protruding from the second surface portion, the first protrusion having a protruding end located between the second surface portion and the first surface portion in the first direction, wherein the housing includes a plurality of corner portions, each of the plurality of the corner portions being provided at a respective corner of the generally rectangular shape, at least one of the plurality of the corner portions including a third surface portion, the third surface portion being a flat surface portion extending generally parallel to the first surface portion, and the third surface portion being located between the first surface portion and the second surface portion in the first direction, wherein a first corner portion of the plurality of corner portions has a tape discharge portion provided to discharge the tape therefrom, the tape discharge portion being provided downstream of the tape exit in the tape feed direction, the first corner portion being one of the plurality of the corner portions that does not include the third surface portion, wherein a support hole is provided on the first corner portion, the support hole rotatably supporting a tape drive roller inside the support hole, and wherein a fourth surface portion is provided adjacent to the tape drive roller, the fourth surface portion being a flat surface portion extending generally parallel to the third surface portion and located at a same position of the third surface portion in the first direction, a portion of the fourth surface portion including a bottom recess recessing toward the top wall and opening along the first direction.

5. The tape cassette according to claim 1, wherein the housing further includes a front wall extending from the first surface portion of the bottom wall toward the top wall.

6. The tape cassette according to claim 5, wherein a first aperture and a second indicator portion are provided on the front wall, and wherein the second indicator portion includes a second aperture.

7. The tape cassette according to claim 6, wherein:

a front recess extending from the bottom surface to the top surface is provided on the front wall;

the tape exit provided to discharge the tape therefrom is formed on the front wall; and the first aperture is located between the tape exit and the front recess in the tape feed direction.

8. The tape cassette according to claim 6, wherein the first aperture on the front wall and the first protrusion on the bottom surface are located on a virtual line orthogonal to both the first direction and the tape feed direction when viewing along the first direction.

9. The tape cassette according to claim 6, wherein the first aperture on the front wall, the first protrusion on the bottom surface and the second indicator portion on the front wall are located on a virtual line orthogonal to both the first direction and the tape feed direction when viewing along the first direction.

10. The tape cassette according to claim 6, wherein the first aperture on the front wall, the first protrusion on the bottom surface and the second aperture on the front wall are located on a virtual line orthogonal to both the first direction and the tape feed direction when viewing along the first direction.

11. The tape cassette according to claim 6, wherein the first aperture is provided at a through-hole formed on the front wall.

12. The tape cassette according to claim 6, wherein the second aperture is provided at a through-hole formed on the front wall.

13. The tape cassette according to claim 1, wherein the first receiving portion recesses from the first surface portion to a first lower flat surface portion located between the first surface portion and the top surface.

14. The tape cassette according to claim 1, wherein:

the arm portion partially surrounds an opening extending from the top wall to the bottom wall behind the front wall, the opening being formed between the arm rear wall and an intermediate wall, the intermediate wall being located between the arm rear wall and a rear wall facing to the front wall; and a second receiving portion comprising a recess recessing from the first surface portion toward the top wall and opening along a second direction orthogonal to the first direction and the tape feed direction, the second direction extending from the arm rear wall toward the front wall, the second receiving portion being connected to a downstream end of the intermediate wall in the tape feed direction.

15. The tape cassette according to claim 14, wherein the second receiving portion recesses from the first surface portion to a second lower flat surface portion located between the first surface portion and the top surface.

16. The tape cassette according to claim 1, wherein the housing includes a rear wall extending from the bottom wall toward the top wall, the rear wall extending between the first corner portion and the second corner portion.

* * * * *